US007446719B2

(12) United States Patent
Sugimoto et al.

(10) Patent No.: US 7,446,719 B2
(45) Date of Patent: Nov. 4, 2008

(54) MOBILE ANTENNA MOUNTED ON A VEHICLE BODY

(75) Inventors: Yuji Sugimoto, Kariya (JP); Toshihiro Hattori, Okazaki (JP); Yoko Ichikawa, Aichi-ken (JP); Syuichi Kono, Okazaki (JP); Koji Numata, Toyokawa (JP); Masaaki Hisada, Oobu (JP); Toru Yamazaki, Chita (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 0 days.

(21) Appl. No.: 11/604,023

(22) Filed: Nov. 24, 2006

(65) Prior Publication Data

US 2007/0097001 A1 May 3, 2007

Related U.S. Application Data

(63) Continuation-in-part of application No. 11/139,038, filed on May 27, 2005, now abandoned.

(30) Foreign Application Priority Data

May 28, 2004 (JP) ..... 2004-159255
Mar. 29, 2005 (JP) ..... 2005-094901
Nov. 25, 2005 (JP) ..... 2005-340443

(51) Int. Cl.
*H01Q 1/32* (2006.01)

(52) U.S. Cl. ..... 343/713; 343/711

(58) Field of Classification Search ..... 343/713, 343/711, 867, 742
See application file for complete search history.

(56) References Cited

U.S. PATENT DOCUMENTS 3,599,214 A * 8/1971 Altmayer ..... 343/713
4,602,260 A 7/1986 Lindenmeier et al.
6,028,557 A * 2/2000 Oka ..... 343/713
6,198,447 B1 3/2001 Sauer (Continued)

FOREIGN PATENT DOCUMENTS

EP 0 124 055 B2 7/1997

(Continued)

OTHER PUBLICATIONS

Notification of Reasons for Rejection dated Oct. 16, 2007 in corresponding Japanese patent application No. 2005-150949 (and English translation).

(Continued)

*Primary Examiner*—Hoang V Nguyen
(74) *Attorney, Agent, or Firm*—Posz Law Group, PLC

(57) ABSTRACT

In a mobile antenna, an electrically conductive antenna element has a first portion with one end and the other end extending therefrom. The one end of the first portion is arranged at least adjacent to any one of a first support portion, a second support portion, and a corner portion of a body of a vehicle. The one end of the first portion is electrically connected to a feeding point. The other end of the first portion is arranged along a surface of the window such that polarized surfaces formed by the antenna element are non-orthogonal to a polarized surface of each of a vertically polarized wave and a horizontally polarized wave in radio waves.

30 Claims, 26 Drawing Sheets

U.S. PATENT DOCUMENTS

| | | | |
|---|---|---|---|
| 6,437,749 | B2 | 8/2002 | Nagayama et al. |
| 6,822,613 | B2 | 11/2004 | Kubota |
| 7,037,144 | B2 | 5/2006 | Wang et al. |
| 2004/0008144 | A1 | 1/2004 | Kubota |
| 2005/0140555 | A1 | 6/2005 | Fujii et al. |
| 2005/0212709 | A1 | 9/2005 | Doi et al. |
| 2005/0264461 | A1 | 12/2005 | Sugimoto et al. |
| 2007/0001915 | A1 | 1/2007 | Kono et al. |
| 2007/0097001 | A1 | 5/2007 | Sugimoto et al. |

FOREIGN PATENT DOCUMENTS

| | | |
|---|---|---|
| GB | 2 221 352 A | 1/1990 |
| JP | UM-A-S61-121010 | 7/1986 |
| JP | A-62-045201 | 2/1987 |
| JP | A-H10-013125 | 1/1998 |
| JP | UM-A-H02-00811 | 1/1999 |
| JP | 2001-230616 | 8/2001 |
| JP | A-2002-135025 | 5/2002 |
| JP | 2004-031068 | 1/2004 |
| JP | 2004-072419 | 3/2004 |
| JP | 2004-104696 | 4/2004 |
| JP | A-2005-167391 | 6/2005 |
| JP | 2005-260659 | 9/2005 |

OTHER PUBLICATIONS

Notification of Reasons for Rejection dated Jul. 31, 2007 in corresponding Japanese patent application No. 2005-150949 (and English translation).
European Search Report dated Jul. 31, 2007 listing 3 references.
USPTO Office Action issued on Jun. 4, 2007 in corresponding parent application (U.S. Appl. No. 11/139,038).

* cited by examiner

MOBILE ANTENNA MOUNTED ON A VEHICLE BODY

CROSS REFERENCE TO RELATED APPLICATIONS

This application is a continuation-in-part of U.S. application Ser. No. 11/139,038 filed on May 27, 2005 (now abandoned), which was based on Japanese Patent Application No. 2004-159255 flied on May 28, 2004 and Japanese Patent Application No. 2005-94901 filed on Mar. 29, 2005, and claimed the benefit of priority therefrom.

In addition, this application is based on Japanese Patent Application No. 2005-340443 filed on Nov. 25, 2005. This application claims the benefit of priority therefrom.

Accordingly, the descriptions of each of the three Japanese Patent Applications are all incorporated herein by reference.

BACKGROUND OF THE INVENTION

1. Field of the Invention

The present invention relates to mobile antennas mounted on the body of a vehicle and configured to receive radio waves within, for example, television broadcast bands.

2. Description of the Related Art

Mobile antennas for receiving radio waves within television broadcast bands include rod antennas, film antennas, and the like. In recent years, film antennas have been becoming mainstream because they have hard deformation characteristic and low impact on the appearance of the vehicle body without causing wind noises.

These types of mobile antennas require to have a wideband characteristic capable of receiving a plurality of channels within the VHF band and the UHF band, and a nondirectional characteristic for receiving radio waves in all directions independently of any direction of travel.

An example of these types of mobile antennas is disclosed in Japanese Unexamined Patent Publication No. 2004-72419.

Assuming that a mobile antenna disclosed in the Patent Publication is mounted at the middle portion of the top edge of a front windshield of a vehicle, if radio waves are transmitted from the front side of the vehicle, the mobile antenna can efficiently receive the radio waves transmitted from the front side of the vehicle.

In contrast, in this assumption, if radio waves are transmitted from the rear side of the vehicle, because the radio waves are shielded by the vehicle body, the mobile antenna may not efficiently receive the radio waves transmitted from the rear side of the vehicle. This may cause the receiving efficiency of the mobile antenna with respect to the radio waves transmitted from the rear side of the vehicle to decrease.

In order to solve the problem, it is to be considered that the mobile antennas disclosed in FIG. 13 of the Patent Publication are mounted to be spaced along the top edge of a front windshield of a vehicle to constitute a diversity system. Specifically, the diversity system is configured such that output signals from the mobile antennas based on the received radio waves thereby are combined to give a single signal. It may be difficult for the diversity system, however, to improve the receiving efficiency of each of the mobile antennas with respect to radio waves transmitted from the rear side of a vehicle.

SUMMARY OF THE INVENTION

In view of the background, an object of an aspect of the present invention to provide mobile antennas each of which is used to be mounted on a body of vehicles, and each of which is capable of stably receiving radio waves independently of any direction of the vehicle's travel and/or any direction from which the radio waves are transmitted.

According to one aspect of the present invention, there is provided a mobile antenna mounted on an electrically conductive body of a vehicle. The body of the vehicle has a first support portion extending substantially parallel to the ground on which the vehicle is disposed, a second support portion extending substantially orthogonal to the ground, and a corner portion at which the first support portion and the second support portion meet. The first support portion, the second support portion, and the corner portion support at least corner portion of a window of the vehicle. The mobile antenna includes an electrically conductive antenna element having a first portion with one end and the other end extending therefrom. The one end of the first portion is arranged at least adjacent to any one of the first support portion, the second support portion, and the corner portion. The one end of the first portion is electrically connected to a feeding point. The other end of the first portion is arranged along a surface of the window such that polarized surfaces formed by the antenna element are non-orthogonal to a polarized surface of each of a vertically polarized wave and a horizontally polarized wave in radio waves.

According to another aspect of the present invention, there is provided a mobile antenna system mounted on an electrically conductive body of a vehicle. The body of the vehicle has a first support portion extending substantially parallel to the ground on which the vehicle is to be disposed, a second support portion extending substantially orthogonal to the ground, and a corner portion at which the first support portion and the second support portion meet. The first support portion, the second support portion, and the corner portion support at least corner portion of a first window of the vehicle, and the first support portion supports a second window of the vehicle. The mobile antenna system includes a first mobile antenna. The first mobile antenna includes a first electrically conductive antenna element having a first portion with one end and the other end extending therefrom. The one end of the first portion is arranged at least adjacent to any one of the first support portion, the second support portion, and the corner portion. The one end of the first portion is electrically connected to a first feeding point. The other end of the first portion is arranged along a surface of the first window such that polarized surfaces formed by the first antenna element are non-orthogonal to a polarized surface of each of a vertically polarized wave and a horizontally polarized wave in radio waves. The first mobile antenna also includes a second mobile antenna. The second mobile antenna includes a second electrically conductive antenna element having a second portion with one end and the other end extending therefrom. The one end of the second portion is electrically connected to a second feeding point. The other end of the second portion is arranged along a surface of any one of the first window and the second window such that polarized surfaces formed by the second antenna element are non-orthogonal to a polarized surface of each of a vertically polarized wave and a horizontally polarized wave in radio waves. The second mobile antenna is arranged such that the first and second mobile antennas are symmetric with each other in the body of the vehicle.

According to a further aspect of the present invention, there is provided an electrically conductive body of a vehicle to be disposed on the ground. The body includes a first support portion extending substantially parallel to the ground, and a second support portion extending substantially orthogonal to the ground. The body also includes a corner portion at which the first support portion and the second support portion meet. The first support portion, the second support portion, and the corner portion support at least corner portion of a window of the vehicle. The body includes a mobile antenna provided with an electrically conductive antenna element having a first portion with one end and the other end extending therefrom. The one end of the first portion is arranged at least adjacent to any one of the first support portion, the second support portion, and the corner portion. The one end of the first portion is electrically connected to a feeding point. The other end of the first portion is arranged along a surface of the window such that polarized surfaces formed by the antenna element are non-orthogonal to a polarized surface of each of a vertically polarized wave and a horizontally polarized wave in radio waves.

According to a still further aspect of the present invention, there is provided a method of installing a mobile antenna in an electrically conductive body of a vehicle. The body of the vehicle has a first support portion extending substantially parallel to the ground on which the vehicle is to be disposed, and a second support portion extending substantially orthogonal to the ground, The body also has a corner portion at which the first support portion and the second support portion meet. The first support portion, the second support portion, and the corner portion support at least corner portion of a window of the vehicle. A corner angle of the corner portion is formed by a window-side edge of the first support portion and a window-side edge of the second support portion. The method includes providing a first film member having opposing first and second surfaces. A first conductive trace with one end and the other end is mounted onto the first surface of the first film member. The method includes providing a second film member having opposing first and second surfaces. A second conductive trace with one and the other end is mounted onto the first surface of the second film member. The method includes individually adhering the first and second film members onto the surface of the window such that the one end of the first conductive trace is arranged at least adjacent to the corner portion and the other end thereof is located between the window-side edge of the first support portion and a center line of the corner angle, and the one end of the second conductive trace is arranged at least adjacent to the corner portion and the other end thereof and the other end thereof is located between the window-side edge of the second support portion and the center line of the corner angle.

BRIEF DESCRIPTION OF THE DRAWINGS

Other objects and aspects of the invention will become apparent from the following description of embodiments with reference to the accompanying drawings in which.

DETAILED DESCRIPTION OF EMBODIMENTS OF THE INVENTION

Embodiments of the present invention will be described hereinafter with reference to the accompanying drawings.

Note that the terms "front", "rear" or "back", "left", "right", "upper" or "top", and "lower" or "bottom", are used herein to refer to various directions based on a driver or a human operator sitting behind a steering wheel of the vehicle.

First Embodiment

Figure 1:
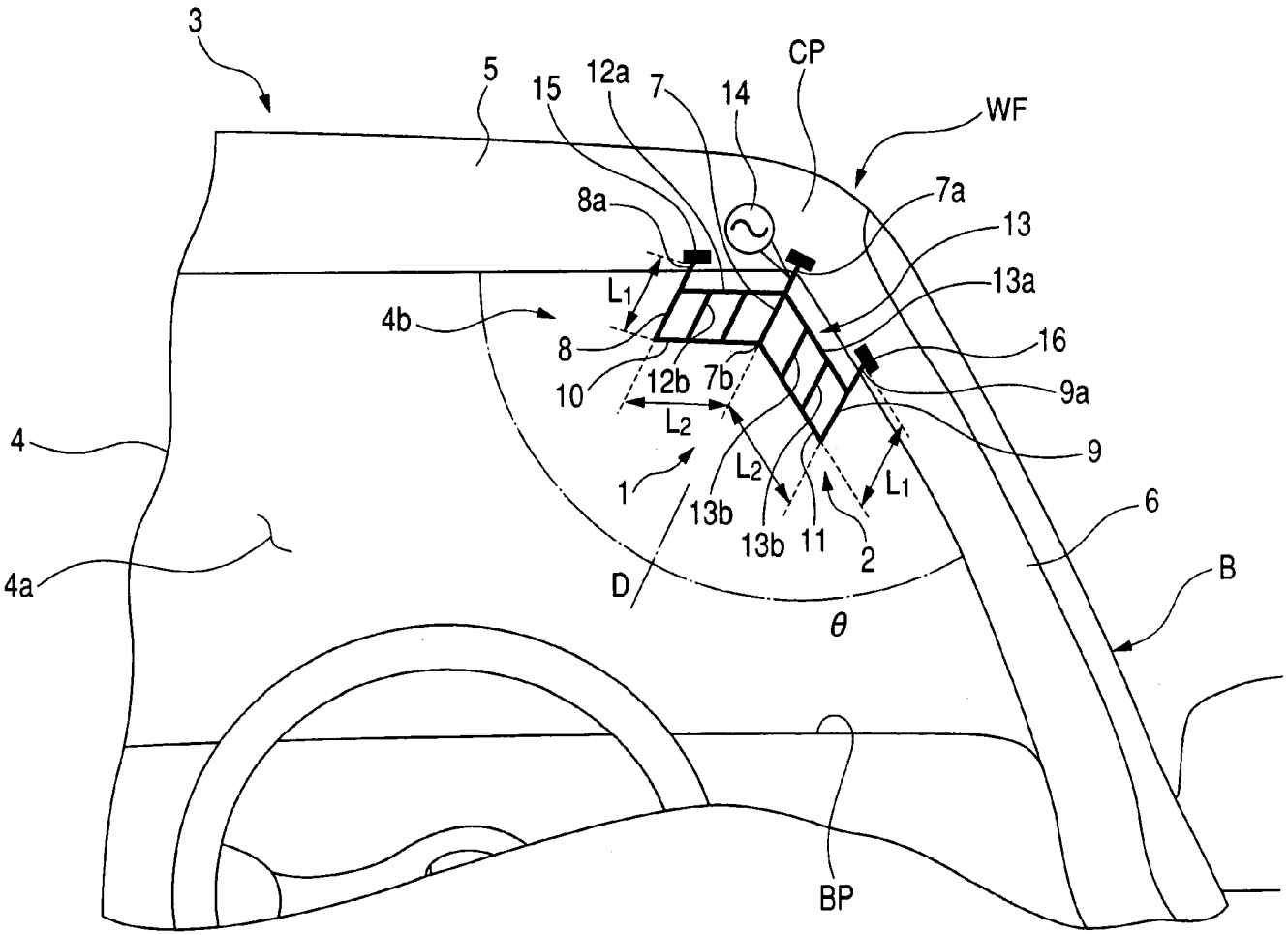
FIG. 1 is a view schematically illustrates a mobile antenna according to a first embodiment of the present invention.

FIG. 1 schematically illustrates a mobile antenna 1 according to a first embodiment of the present invention, which is mounted on an electrically-conductive body frame B of a vehicle, such as a passenger car, 3.

As illustrated in FIG. 1, the mobile antenna 1 is formed as, for example, a film antenna. Specifically, the mobile antenna 1 is provided with an antenna element 2, which can be produced from any electrically conductive member, such as a wire, a rod, a tube, or the like, and formed in a loop. The antenna element 2 is, for example, attached on an inner surface 4*a* of a rectangular front windshield (windshield glass) 4 through, for example, a film member (not shown). The film member can be made of, for example, a transparent insulation material, such as a transparent resin, and can have a substantially similar shape as the antenna element 2.

The antenna element 2 is located at, for example, the upper-right corner portion 4*b* of the inner surface 4*a* of the front windshield 4.

The body frame B is provided with a front windshield frame portion WF. The front windshield frame WF is composed of a front edge of a roof panel 5 (top portion), and a bottom portion BP opposite to the top portion. In addition, the front windshield frame WF is composed of a right portion (right front pillar 6) joined to the top and bottom portions, and a left portion (left front pillar 20, see FIG. 6) joined to the top and bottom portions and opposite to the right portion. The front windshield frame portion WF is configured to support the front windshield 4.

The upper-right corner portion 4*b* is for example close to the upper-right corner portion CP at which one end (right end) of the front edge of a roof panel 5 of the body frame B and the upper end of the windshield-side edge of a right front pillar 6 thereof meet.

The antenna element 2 has a linear inner portion 7, a pair of linear outer portions 8 and 9, and a pair of linear connection portions 10 and 11.

The inner portion 7 has one end 7*a* and the other end 7*b*. The inner portion 7 is arranged along the center direction D of a corner angle θ formed by the front edge of the roof panel 5 and the windshield-side edge of the right front pillar 6. The one end 7*a* of the inner portion 7 is located at least adjacent to the upper-right corner portion CP. A feeding point (feeder) 14 is electrically connected to the one end 7*a* of the inner portion 7 such that power is to be fed to the antenna element 2 through the feeding point 14. The other end 7*b* of the inner portion 7 is arranged on the center direction D of the corner angle θ.

One end of each of the connection portions 10 and 11 is joined to the other end 7*b* of the inner portion 7. The connection portion 10 is arranged to be parallel to the front edge of the roof panel 5, and the other end of the connection electric portion 10 is joined to one end of the outer portion 8. The connection portion 11 is arranged to be parallel to the windshield-side edge of the right front pillar 6, and the other end of the connection portion 11 is joined to one end of the outer portion 9.

The outer portion 8 is arranged to be parallel to the inner portion 7. The other end 8*a* of the outer portion 8 extends onto the front edge of the roof panel 5.

Moreover, the antenna element 2 has a pair of ground points (ground traces) 15 and 16. The ground point 15 is mounted on an inner surface of the front edge of the roof panel 5 so as to be grounded thereto. The ground point 15 is arranged to be electrically connected to the other end 8*a* of the outer portion 8.

In addition, the outer portion 9 is arranged to be parallel to the inner portion 7. The other end 9*a* of the outer portion 9 extends onto the right front pillar 6. The ground point 16 is mounted on an inner surface of the windshield-side edge of the right front pillar 6 so as to be grounded thereto. The ground point 16 is arranged to be electrically connected to the other end 9*a* of the outer portion 9, Furthermore, the antenna element 2 has a pair of mesh portions 12 and 13.

The mesh portion 12 is composed of a linear portion 12*a*. For example, the liner portion 12*a* is arranged to be substantially parallel to the front edge of the roof panel 5 with clearances therebetween. The linear portion 12*a* is joined between an intermediate portion of the inner portion 7 and that of the outer portion 8.

The mesh portion 12 is also composed of a plurality of, such as two, bars 12*b*. The bars 12*b* are joined between the connection portion 10 and the linear portion 12*a* to be parallel to the inner portion 7 such that they have intervals along the connection portion 10 (linear portion 12*a*). Specifically, as illustrated in FIG. 1, the inner portion 7, the connection portion 10, the outer portion 8, the linear portion 12*a*, and the bars 12*b* provide a plurality of current paths (loops).

Similarly, the mesh portion 13 is composed of a linear portion 13*a*. For example, the liner portion 13*a* is arranged to be substantially parallel to the windshield-side edge of the right front pillar 6 with clearances therebetween.

The linear portion 13*a* is joined between an intermediate portion of the inner portion 7 and that of the outer portion 9.

In addition, the mesh portion 13 is also composed of a plurality of, such as two, bars 13*b*. The bars 13*b* are joined between the connection portion 11 and the linear portion 13*a* to be parallel to the inner portion 7 such that they have regular intervals along the connection portion 11 (linear portion 13*a*). Specifically, as illustrated in FIG. 1, the inner portion 7, the connection portion 11, the outer portion 9, the linear portion 13*a*, and the bars 13*b* provide a plurality of current paths (loops).

In the first embodiment, the antenna element 2 is designed to receive radio waves each of which has a predetermined wavelength (target wavelength) with utmost efficiency. Reference character λ is assigned to the predetermined wavelength.

To realize the utmost-efficient receiving of the radio waves each having the wavelength λ, the inner portion 7, and the outer portions 8 and 9 are designed to have the same length L1 of 0.15λ. In addition, to realize that, the connection portions 10 and 11 are designed to have the same length L2 of 0.2λ.

The lengths of the portions 7 to 11 of the antenna element 2 are designed with fractional shortening of the wavelength λ due to a dielectric constant of the windshield glass 4; this fractional shortening is set to a value within the range from 0.7 to 0.8. That is, the length L1 of 0.15λ and the length L2 of the 0.2λ are amended by multiplying them by the value within the range from 0.7 to 0.8.

In the structure of the mobile antenna 1, as set forth above, the inner portion 7, the connection portions 10 and 11, the outer portions 8 and 9, and the mesh portions 12 and 13 provide a plurality of paths (loops). The plurality of paths (loops) have different path lengths, respectively, and these different path lengths respectively correspond to different antenna lengths. For example, the inner portion 7, the connection portion 10, and the outer portion 8 provide a first current path (loop), and the first current path is designed to have a predetermined length of 0.5λ

$$\left(\frac{1}{2}\lambda\right),$$

which is calculated by "L1×2+L2".

Similarly, the inner portion 7, the connection portion 11, and the outer portion 9 provide a second current path (loop), and the second current path is designed to have a predetermined length of 0.5λ

$$\left(\frac{1}{2}\lambda\right),$$

which is calculated by "L1×2+L2".

The path length $$\left(\frac{1}{2}\lambda\right)$$

of each of the first and second current paths allows the radio waves each with the wavelength λ to be effectively received by each of the first and second current paths (loops).

In addition, the one end 7*a* of the inner portion 7, the linear portion 12*a*, and the other end 8*a* of the outer portion 8 provide a third current path (loop). A path length of the third current path is different from the first path length, so that the resonance frequency corresponding to the third current path is different from that corresponding to the first current path.

Similarly, the one end 7*a* of the inner portion 7, the linear portion 13*a*, and the other end 9*a* of the outer portion 9 provide a fourth current path (loop). A path length of the fourth current path is different from the second path length, so that the resonance frequency corresponding to the fourth current path is different from that corresponding to the second current path.

Specifically, these different path lengths (antenna lengths) provided by the antenna element 2 have corresponding different resonant frequencies, respectively; these different resonant frequencies correspond to a broad frequency band.

In addition, the clearances between the front edge of the roof panel 5 (body frame B) acting as ground and the linear portion 12*a* of the antenna element 2 are adjusted in consideration of changes of capacitive components occurring between the roof panel 5 (body frame B) and the linear portion 12*a*. This is because the capacitive components between the roof panel 5 and the linear portion 12*a* vary depending on the changes of the clearances therebetween.

Similarly, the clearances between the windshield-side edge of the right front pillar 6 (body frame B) acting as ground and the linear portion 13*a* of the antenna element 2 are adjusted in consideration of changes of capacitive components occurring between the right front pillar 6 (body frame B) and the linear portion 13*a* of the antenna element 2. This is because the capacitive components between the right front pillar 6 and the linear portion 13*a* vary depending on the changes of the clearances therebetween.

Operations of the mobile antenna 1 will be described hereinafter with reference to FIGS. 2 to 5.

In the structure of the mobile antenna 1, when power fed to the antenna element 2 through the feeding point 14 allows an antenna current to flow through the inner portion 7 from the feeding point 14.

Figure 2A:
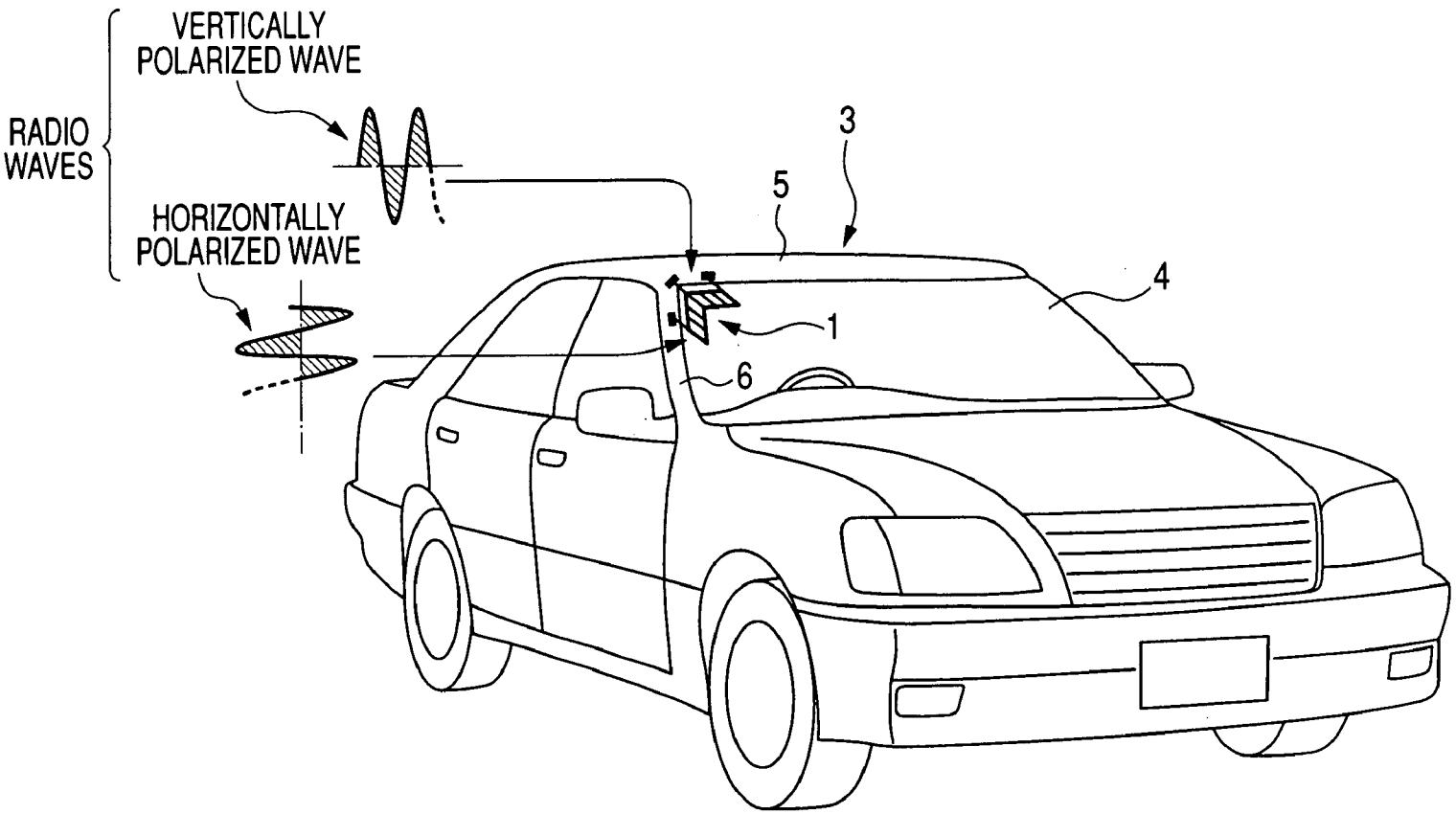
FIG. 2A is a schematically perspective view of a vehicle on which the mobile antenna according to the first embodiment is mounted.
Figure 2B:
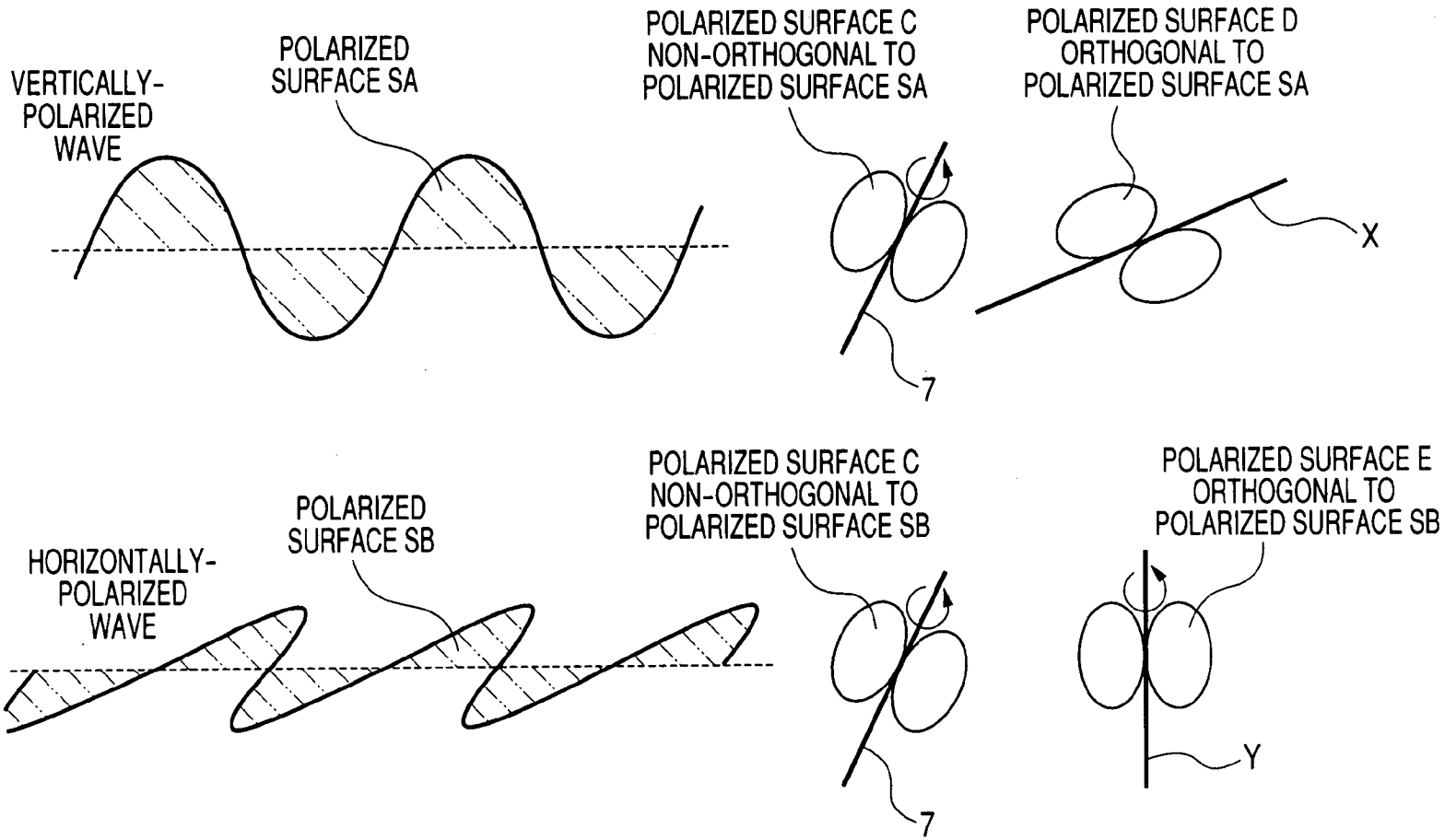
FIG. 2B is a view schematically illustrating polarized surfaces of the mobile antenna, and those of vertically polarized waves and horizontally polarized waves.

The inner portion 7 is arranged along the center direction D of the corner angle θ, so that it is inclined with respect to the vertical and horizontal directions with respect to the ground (road surface). This structure allows, as shown in FIGS. 2A and 2B, polarized surfaces C of the inner portion 7 of the antenna element 2 to be non-orthogonal to each polarized surface SA of vertically polarized waves and each polarized surface SB of horizontally polarized waves in the radio waves.

In addition, the antenna element 2 is located at the corner portion 4*b* of the inner surface 4*a* of the front windshield 4, which is close to the upper-right corner portion CP formed by the front edge of the roof panel 5 and the upper end of the windshield-side edge of the right front pillar 6.

This structure of the mobile antenna 1 mounted on the vehicle's body frame B allows vertically and horizontally polarized waves to be effectively received when they are transmitted from the front side of the vehicle 3.

Furthermore, when vertically and horizontally polarized waves are transmitted from the rear side of the vehicle 3, the mobile antenna 1 permits the transmitted vertically polarized waves, which are diffracted by the roof panel 5 to enter into the interior of the vehicle 3, to be effectively received by the antenna element 2. This is because the antenna element 2 is arranged close to the roof panel 5 of the vehicle and each polarized surface C of the inner portion 7 of the antenna element 2 is not to be orthogonal but to be crossed, at approximately 45 degrees, to each of the polarized surfaces SA of he vertically polarized waves. In contrast, if an inner portion (see X in FIG. 2B) is arranged such that each polarized surface D is orthogonal to polarized surfaces SA of each vertically polarized wave, the inner portion X cannot receive the vertically polarized waves.

In addition, the mobile antenna 1 permits the transmitted horizontally polarized waves, which are diffracted by the right-side of the vehicle to enter into the interior thereof, to be effectively received by the antenna element 2. This is because the antenna element 2 is arranged close to the right-side of the vehicle and each polarized surface of the inner portion 7 of the antenna element 2 is not to be orthogonal but to be crossed, at approximately 45 degrees, to each of the polarized surfaces SB of the horizontally polarized waves. In contrast, if an inner portion (see Y in FIG. 2B) is arranged such that each polarized surface E is orthogonal to polarized surfaces SB of each horizontally polarized wave, the inner portion Y cannot receive the horizontally polarized waves.

That is, it is possible for the mobile antenna 1 according to the first embodiment to effectively receive both the vertically polarized waves and the horizontally polarized waves transmitted from both the front side of the vehicle and the rear side thereof.

Moreover, the antenna current passing through the inner portion 7 branches to flow through the connection portion 10 and the outer portion 8 into the ground point 15 in loop, and to flow through the connection portion 11 and the outer connection element 9 into the ground point 16 in loop.

The current component flowing through the loop (first loop) formed by the inner portion 7, the connection portion 10, and the outer portion 8 allows detection of magnetic field components of the radio waves; these magnetic field components are directed to be orthogonal to the loop area. In addition, the current component flowing through the first loop allows detection of magnetic field formed by high-frequency currents flowing through the body frame B.

Similarly, the current component flowing through the loop (second loop) formed by the inner portion 7, the connection portion 11, and the outer portion 9 allows detection of magnetic field components of the radio waves; these magnetic field components are directed to be orthogonal to the loop area. In addition, the current component flowing through the second loop allows detection of magnetic field formed by the high-frequency currents flowing through the body frame B.

Figure 3A:
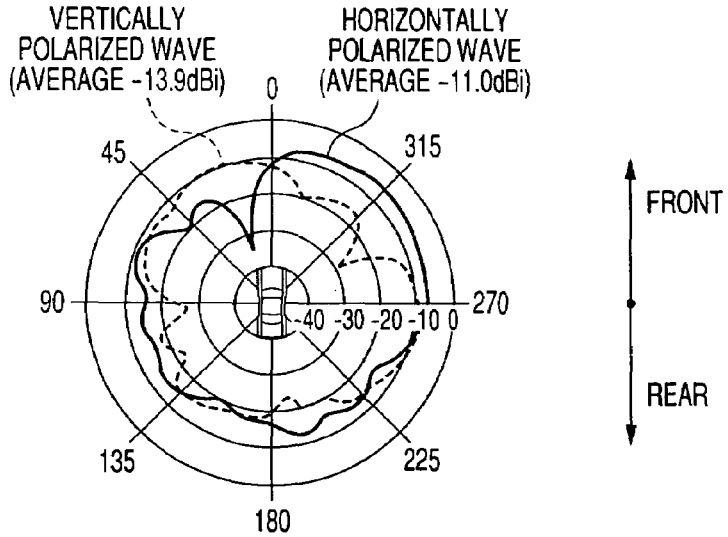
FIG. 3A is a view schematically illustrating the measurement result of horizontal-plane directional patterns of the mobile antenna according to the first embodiment.
Figure 3B:
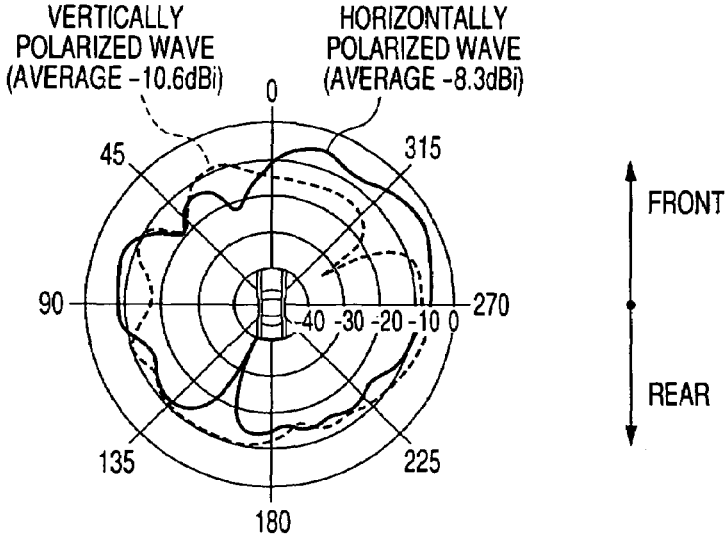
FIG. 3B is a view schematically illustrating the measurement result of horizontal-plane directional patterns of a mobile antenna illustrated in FIG. 14B.
Figure 3C:
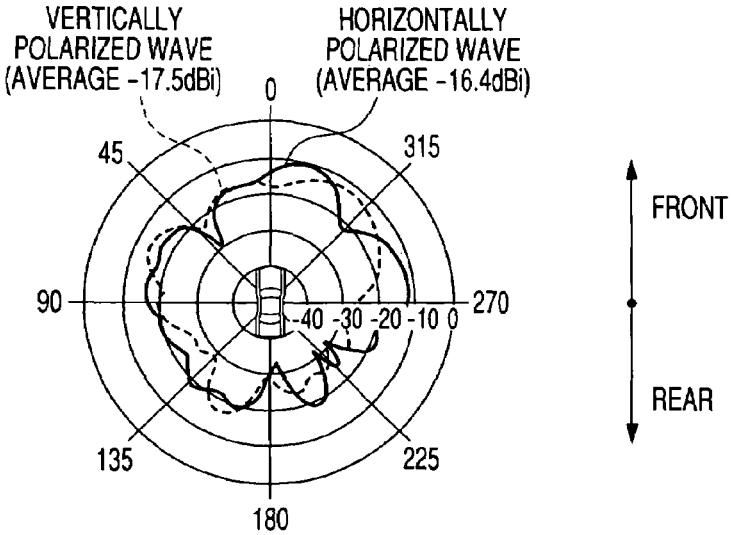
FIG. 3C is a view schematically illustrating the measurement result of horizontal-plane directional patterns of a mobile antenna illustrated in FIG. 4.
Figure 4:
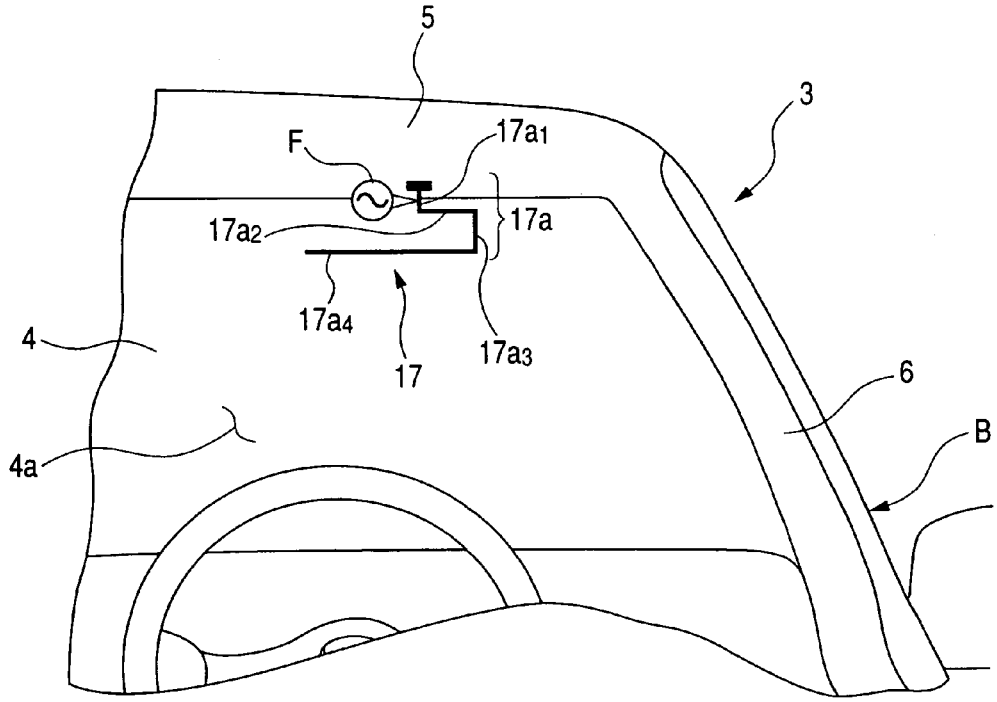
FIG. 4 is a view schematically illustrates a mobile antenna according to a comparative example with respect to the present invention.

FIG. 3 shows the measurement result of horizontal-plane directional patterns of the mobile antenna 1 and that of horizontal-plane directional patterns of a mobile antenna disclosed in FIG. 4, which is a comparative example. As illustrated in FIG. 4, a mobile antenna (monopole antenna) 17 according to the comparative example has an antenna element 17*a*. The antenna element 17*a* is attached on the inner surface 4*a* of the front windshield 4. The antenna element 17*a* is located at the upper edge of the inner surface 4*a* of the front windshield 4. The antenna element 17*a* is composed of a first linear portion 17*a*1 crept downwardly along the inner surface 4*a* of the windshield 4; one end of the first linear portion 17*a*1 is electrically connected to a feeding point F through which power is fed to the antenna element 17*a*.

The antenna element 17*a* is composed of a second linear portion 17*a*2 extending from the other end of the first linear portion 17*a*1 rightward along the inner surface 4*a* of the windshield 4. The antenna element 17*a* is composed of a third linear portion 17*a*3 extending from the extending end of the second linear portion 17*a*2 downwardly along the inner surface 4*a* of the windshield 4, In addition, the antenna element 17*a* is composed of a fourth linear portion 17*a*4 extending from the extending end of the third linear portion 17*a*3 in parallel to the first linear portion 17*a*1 along the inner surface 4*a* of the windshield 4. The mobile antenna 17 is designed as a harmonic exciting antenna such that an overall length of the antenna element 17*a* is designed to $$\left(\frac{1}{4}\lambda\right)$$

that resonates with half or quarter of a desired frequency.

Specifically, FIG. 3A illustrates the measurement result of horizontal-plane directional patterns of the mobile antenna 1, and FIG. 3C illustrates the measurement result of horizontal-plane directional patterns of the mobile antenna 17 shown in FIG. 4.

As apparent in FIGS. 3A and 3C, directional gains of the antenna 17 are biased to the front windshield side (the front side of the vehicle 3).

In contrast, in the first embodiment, high directional gains are obtained to not only the front windshield side (the front side of the vehicle 3) to which the mobile antenna 1 is mounted, but also to the opposite side (the rear side of the vehicle 3). That is, the mobile antenna 1 according to the first embodiment can provide good and hardly-biased directional gains. This is because the antenna 1 element 2 can effectively receive both the vertically polarized waves, which are transmitted from the rear side of the vehicle 3 to be diffracted by the roof panel 5, and the horizontally polarized waves, which are transmitted from the rear side thereof to be diffracted by the right side of the vehicle body B.

In addition, in the first embodiment, loss resistance of the antenna element 2 is smaller than that of the antenna element 17*a*, and receiving efficiency of the antenna element 2 is higher than that of the antenna element 17*a*. This may be because each current path length of the antenna element 2 is shorter than the current path length of the antenna element 17*a*. These characteristics cause an average gain of the mobile antenna 1 with respect to the vertically-polarized waves to become −13.9 dB, which is more improved than an average gain of −17.5 dB of the mobile antenna 17 with respect to vertically-polarized waves. Similarly, these characteristics cause an average gain of the mobile antenna 1 with respect to the horizontally-polarized waves to become −11.0 dB, which is more improved than an average gain of −16.4 dB of the mobile antenna 17 with respect to horizontally-polarized waves.

That is, the structure of the mobile antenna 1 allows its average gains with respect to vertically-polarized waves and horizontally-polarized waves to be improved as compared with the average gains of the mobile antenna 17 with respect to them.

Figure 5:
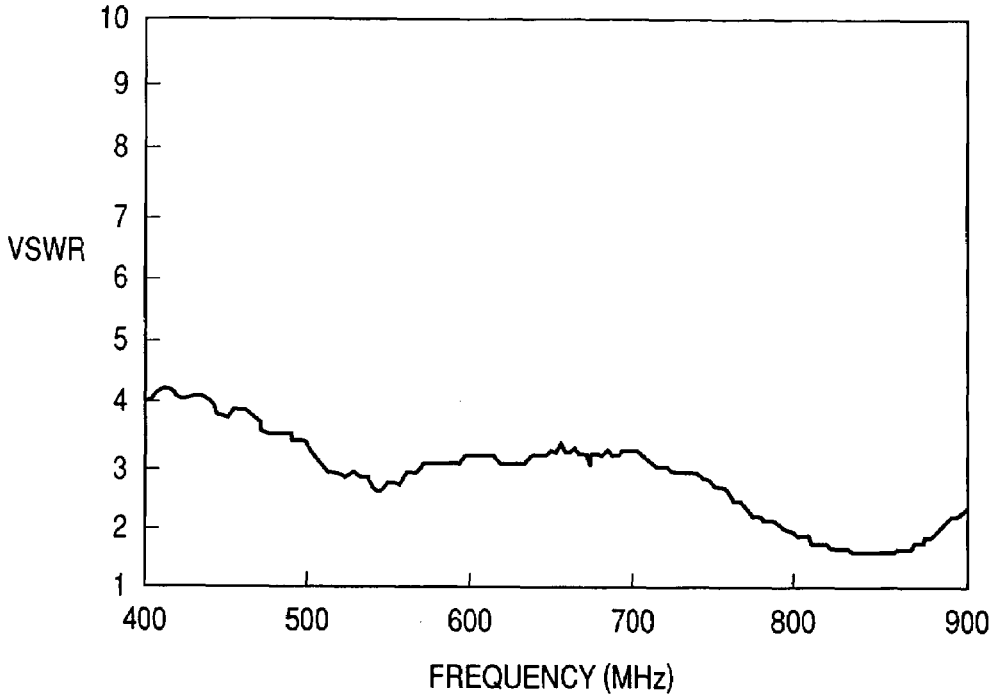
FIG. 5 is a graph schematically illustrating the measurement result of VSWRs of the mobile antenna according to the first embodiment.

In addition, FIG. 5 illustrates the measurement result of VSWRs (Voltage Standing Wave Ratios) of the mobile antenna 1 according to the first embodiment. The VSWR represents the ratio of the voltage (or current) maximum at any point on a transmission line in which reflection waves are generated due to impedance mismatching to the voltage (or current) minimum at that point.

As illustrated in FIG. 5, lower VSWRs of the mobile antenna 1 have been obtained within a target frequency range of, for example, 470 to 770 MHz corresponding to UHF band, allowing the bandwidth of the mobile antenna 1 to be smoothly wider.

Figure 6:
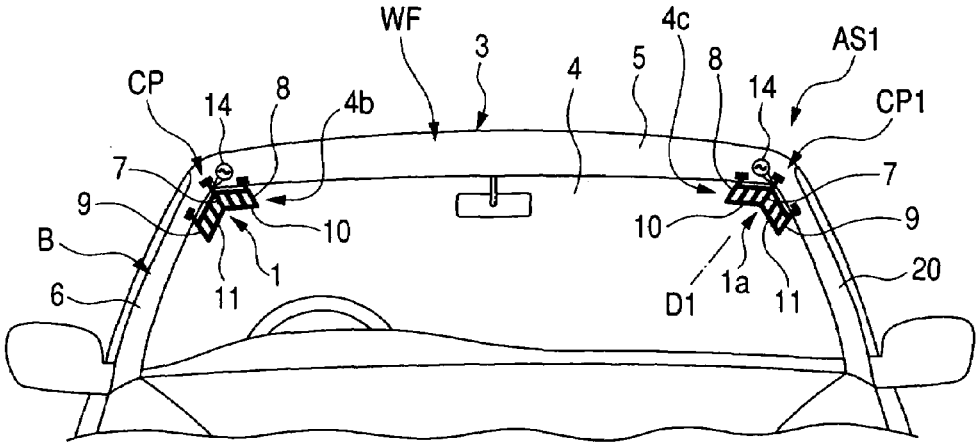
FIG. 6 is a view schematically illustrating an antenna system mounted on the body frame according to a first modification of the first embodiment.

FIG. 6 schematically illustrates an antenna system AS1 mounted on the body frame 3 according to a first modification of the first embodiment.

As illustrated in FIG. 6, the antenna system AS1 is provided with the mobile antenna 1 according to the first embodiment, which is mounted at the upper-right corner portion 4*b* of the inner surface 4*a* of the front windshield 4.

In addition, the antenna system AS1 is provided with a mobile antenna 1*a* whose structure is a substantially symmetrical to the structure of the mobile antenna 1, and each element of the mobile antenna 1*a* is substantially identical with that of the mobile antenna 1. Reference characters, which are assigned to the elements of the mobile antenna 1, are assigned to the corresponding elements of the mobile antenna 1*a*.

The mobile antenna 1*a* is substantially metrically placed in the vehicle 3 with respect to the mobile antenna 1 in the horizontal (lateral) direction of the vehicle 3.

Specifically, the mobile antenna 1*a* is mounted at the upper-left corner portion 4*c* of the inner surface 4*a* of the front windshield 4. The upper-left corner portion 4*c* is close to but away from the upper-left corner portion CP1 at which one end (left end) of the front edge of the roof panel 5 of the body frame B and the upper end of the windshield-side edge of the left front pillar 20 thereof meet.

The inner portion 7 of the antenna element 2 is arranged along the center direction D1 of a corner angle formed by the front edge of the roof panel 5 and the windshield-side edge of the left front pillar 20. The one end 7*a* of the inner portion 7 is located at the upper-left corner portion CP1. The other end 7*b* of the inner portion 7 is arranged on the center direction D1 of the corner angle. The connection portion 10 is arranged to be parallel to the front edge of the roof panel 5, and the connection portion 11 is arranged to be parallel to the windshield-side edge of the left front pillar 20. Because other structures of the antenna element 2 of the mobile antenna 1*a* are substantially the same as those of the antenna element 2 of the mobile antenna 1, descriptions of which are omitted.

As described above, the mobile antennas 1 and 1*a* of the antenna system AS1 are symmetrically mounted on the upper-right and upper-left corners 4*b* and 4*c* of the front windshield 4, which are horizontally spaced. The antenna system AS1 provides space diversity that can achieve space diversity effect, making it possible to further improve the receiving efficiency of the vehicle 3 with respect to radio waves transmitted from both the front side and rear side of the vehicle 3.

In addition, directions in which antenna current components flow through the antenna element 2 of the mobile antenna 1 and those in which antenna current components flow through the antenna element 2 of the mobile antenna 1*a* are different from each other. This can provide different polarized surfaces, making it possible to achieve polarization-diversity effect.

Figure 7:
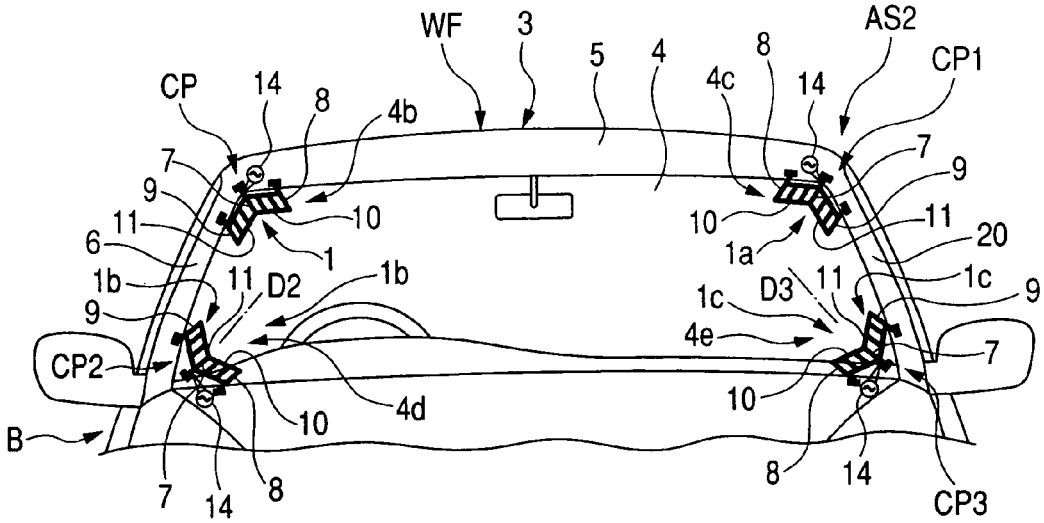
FIG. 7 is a view schematically illustrating an antenna system mounted on the body frame according to a second modification of the first embodiment.

FIG. 7 schematically illustrates an antenna system AS2 mounted on the body frame B according to a second modification of the first embodiment.

As illustrated in FIG. 7, the antenna system AS2 is provided with the mobile antenna 1, which is mounted at the upper-right corner portion 4*b* of the inner surface 4*a* of the front windshield 4, and the mobile antenna 1*a*, which is mounted at the upper-left corner portion 4*c* of the inner surface 4*a* of the front windshield 4.

In addition, the antenna system AS2 is provided with a mobile antenna 1*b* whose structure is a substantially symmetrical to the structure of the mobile antenna 1, and each element of the mobile antenna 1*b* is substantially identical with that of the mobile antenna 1. Reference characters, which are assigned to the elements of the mobile antenna 1, are assigned to the corresponding elements of the mobile antenna 1*b*.

The mobile antenna 1*b* is symmetrically placed in the vehicle 3 with respect to the mobile antenna 1 along the right front pillar 6.

Specifically, the mobile antenna 1*b* is mounted at the lower-right corner portion 4*d* of the inner surface 4*a* of the front windshield 4. The lower-right corner portion 4*d* is close to but away from a lower-right corner portion CP2 of the front windshield frame portion WF at which one end (right end) of the bottom portion BP and the lower end of the windshield-side edge of the right front pillar 6 meet.

The inner portion 7 of the antenna element 2 of the mobile antenna 1*b* is arranged along the center direction D2 of a corner angle formed by the bottom portion BP of the front windshield frame portion WF and the windshield-side edge of the right front pillar 6. The one end 7*a* of the inner portion 7 is located at the lower-right corner portion CP2. The other end 7*b* of the inner portion 7 is arranged on the center direction D2 of the corner angle.

The connection portion 10 is arranged to be parallel to the bottom portion BP of the front windshield frame portion WF, and the connection portion 11 is arranged to be parallel to the windshield-side edge of the right front pillar 6. Because other structures of the antenna element 2 of the mobile antenna 1*b* are substantially the same as those of the antenna element 2 of the mobile antenna 1, descriptions of which are omitted.

Furthermore, the antenna system AS2 is provided with a mobile antenna 1*c* whose structure is a substantially symmetrical to the structure of the mobile antenna 1, and each element of the mobile antenna 1*b* is substantially identical with that of the mobile antenna 1. Reference characters, which are assigned to the elements of the mobile antenna 1, are assigned to the corresponding elements of the mobile antenna 1*b*.

The mobile antenna 1*c* is symmetrically placed in the vehicle 3 with respect to the mobile antenna 1*a* along the left front pillar 20.

Specifically, the mobile antenna 1*c* is mounted at the lower-left corner portion 4*e* of the inner surface 4*a* of the front windshield 4. The lower-left corner portion 4*e* is close to but away from a lower-left corner portion CP3 of the front windshield frame portion WF at which one end (left end) of the bottom portion BP and the lower end of the windshield-side edge of the left front pillar 20 meet.

The inner portion 7 of the antenna element 2 of the mobile antenna 1*c* is arranged along the center direction D3 of a corner angle formed by the bottom portion BP of the front windshield frame portion WF and the windshield-side edge of the left front pillar 20. The one end 7*a* of the inner portion 7 is located at the lower-left corner portion CP3. The other end 7*b* of the inner portion 7 is arranged on the center direction D3 of the corner angle.

The connection portion 10 is arranged to be parallel to the bottom portion BP of the front windshield frame portion WF, and the connection portion 11 is arranged to be parallel to the windshield-side edge of the left front pillar 20. Because other structures of the antenna element 2 of the mobile antenna 1*b* are substantially the same as those of the antenna element 2 of the mobile antenna 1, descriptions of which are omitted.

As described above, the mobile antennas 1 and 1*a* are symmetrically mounted on the upper-right and upper-left corners 4*b* and 4*c* of the front windshield 4, which are horizontally spaced. In addition, the mobile antennas 1*b* and 1*c* are symmetrically mounted on the lower-right and lower-left corners 4*d* and 4*e* of the front windshield 4, which are horizontally spaced.

The mobile antennas 1 and 1*b* of the antenna system AS2 are symmetrically mounted on the upper-right and lower-right corners 4*b* and 4*d* of the front windshield 4, which are substantially vertically spaced. Furthermore, the mobile antennas 1*a* and 1*c* of the antenna system AS2 are symmetrically mounted on the upper-left and lower-left corners 4*c* and 4*e* of the front windshield 4, which are substantially vertically spaced.

The antenna system AS2, therefore, provides space diversity that can achieve space diversity effect, making it possible to further improve the receiving efficiency of the vehicle 3 with respect to radio waves transmitted from both the front side and rear side of the vehicle 3.

In addition, antenna-current flow directions in the antenna elements 2 of the mobile antennas 1, 1*a*, 1*b*, and 1*c* are different from each other. This can provide different polarized surfaces, making it possible to achieve polarization-diversity effect.

Figure 8:
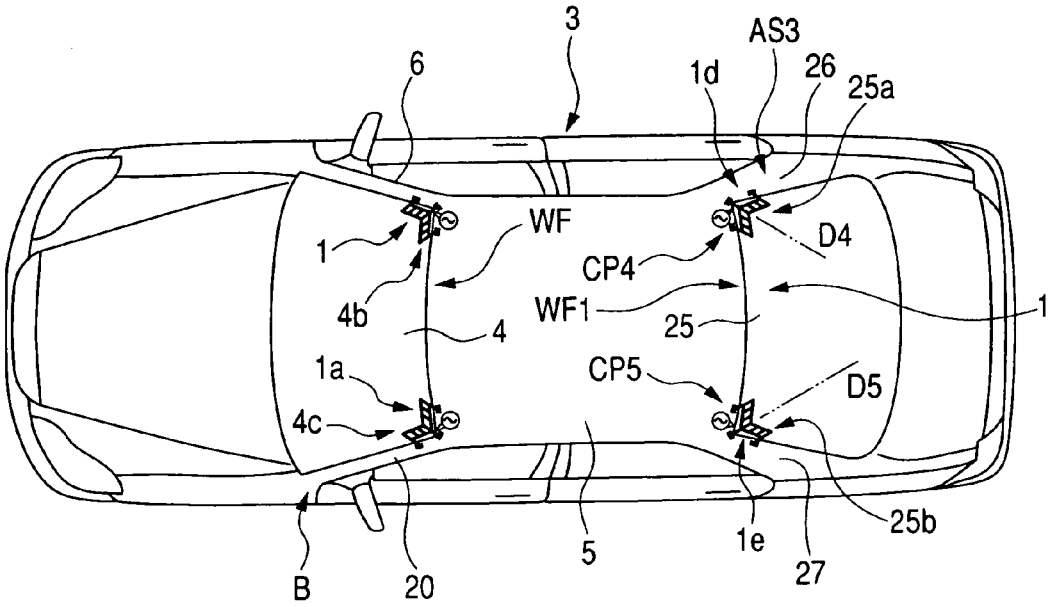
FIG. 8 is a view schematically illustrating an antenna system mounted on the body frame according to a third modification of the first embodiment.

FIG. 8 schematically illustrates an antenna system AS3 mounted on the body frame B according to a third modification of the first embodiment.

As illustrated in FIG. 8, the antenna system AS3 is provided with the mobile antenna 1 and the mobile antenna 1*a*, which are mounted at the upper-right and upper-left corner portions 4*b* and 4*c* of the inner surface 4*a* of the front windshield 4, respectively.

In addition, the antenna system AS3 is provided with mobile antennas 1*d* and 1*e* whose structures are substantially symmetrical to the structure of the mobile antenna 1, and each element of each of the mobile antennas 1*d* and 1*e* is substantially identical with that of the mobile antenna 1. Reference characters of the elements of each of the mobile antennas 1*d* and 1*e* are therefore omitted in FIG. 8, keeping the viewability of FIG. 8 clear.

The body frame B is provided with a rear window frame portion WF1. The rear window frame portion WF1 is composed of a rear edge of the roof panel 5 (top portion), and a bottom portion opposite to the top portion. The rear window frame portion WF1 is also composed of a right portion (right rear pillar 26) joined to the top and bottom portions, and a left portion (left rear pillar 27) joined to the top and bottom portions and opposite to the right portion. The rear window frame portion WF1 is configured to support the rear window 25.

The mobile antenna 1*d* is symmetrically placed in the vehicle 3 with respect to the mobile antenna 1 in the longitudinal direction of the vehicle 3.

Specifically, the mobile antenna 1*d* is mounted at the upper-right corner portion 25*a* of an inner surface of the rear window 25. The upper-right corner portion 25*a* is close to but away from the upper-right corner portion CP4 at which one end (right end) of the rear edge of the roof panel 5 of the body frame B and the upper end of the window-side edge of the right rear pillar 26 thereof meet The inner portion 7 of the antenna element 2 is arranged along the center direction D4 of a corner angle formed by the rear edge of the roof panel 5 and the window-side edge of the right rear pillar 26. The one end 7*a* of the inner portion 7 is located at the upper-right corner portion CP4. The other end 7*b* of the inner portion 7 is arranged on the center direction D4 of the corner angle. The connection portion 10 is arranged to be parallel to the rear edge of the roof panel 5, and the connection portion 11 is arranged to be parallel to the window-side edge of the right rear pillar 26. Because other structures of the antenna element 2 of the mobile antenna 1*d* are substantially the same as those of the antenna element 2 of the mobile antenna 1, descriptions of which are omitted.

In addition, the mobile antenna 1*e* is symmetrically placed in the vehicle 3 with respect to the mobile antenna 1*d* in the lateral (horizontal) direction of the vehicle 3.

Specifically, the mobile antenna 1*e* is mounted at the upper-left corner portion 25*b* of the inner surface of the rear window 25. The upper-left corner portion 25*b* is close to but away from the upper-left corner portion CP5 at which one end (left end) of the rear edge of the roof panel 5 of the body frame B and the upper end of the window-side edge of the left rear pillar 27 thereof meet.

The inner portion 7 of the antenna element 2 is arranged along the center direction D5 of a corner angle formed by the rear edge of the roof panel 5 and the window-side edge of the left rear pillar 27. The one end 7*a* of the inner portion 7 is located at the upper-left corner portion CP5. The other end 7*b* of the inner portion 7 is arranged on the center direction D5 of the corner angle.

The connection portion 10 is arranged to be parallel to the rear edge of the roof panel 5, and the connection portion 11 is arranged to be parallel to the window-side edge of the left rear pillar 27. Because other structures of the antenna element 2 of the mobile antenna 1*e* are substantially the same as those of the antenna element 2 of the mobile antenna 1, descriptions of which are omitted.

As described above, the mobile antennas 1 and 1*a* are symmetrically mounted on the upper-right and upper-left corners 4*b* and 4*c* of the front windshield 4, which are horizontally spaced. In addition, the mobile antennas 1*d* and 1*e* are symmetrically mounted on the upper-right and upper-left corners 25*a* and 25*b* of the rear window 25, which are horizontally spaced.

The mobile antennas 1 and 1*d* of the antenna system AS3 are symmetrically mounted on the upper-right corers 4*b* and 25*a* of the front windshield 4 and the rear window 25, which are spaced in the longitudinal direction of the vehicle 3. Similarly, the mobile antennas 1*a* and 1*e* of the antenna system AS3 are symmetrically mounted on the upper-left corers 4*c* and 25*b* of the front windshield 4 and the rear window 25, which are spaced in the longitudinal direction of the vehicle 3.

The antenna system AS3, therefore, provides space diversity that can achieve space diversity effect, making it possible to further improve the receiving efficiency of the vehicle 3 with respect to radio waves transmitted from both the front side and rear side of the vehicle 3.

In addition, antenna-current flow directions in the antenna elements 2 of the mobile antennas 1, 1*a*, 1*d*, and 1*e* are different from each other. This can provide different polarized surfaces, making it possible to achieve polarization-diversity effect.

Figure 9:
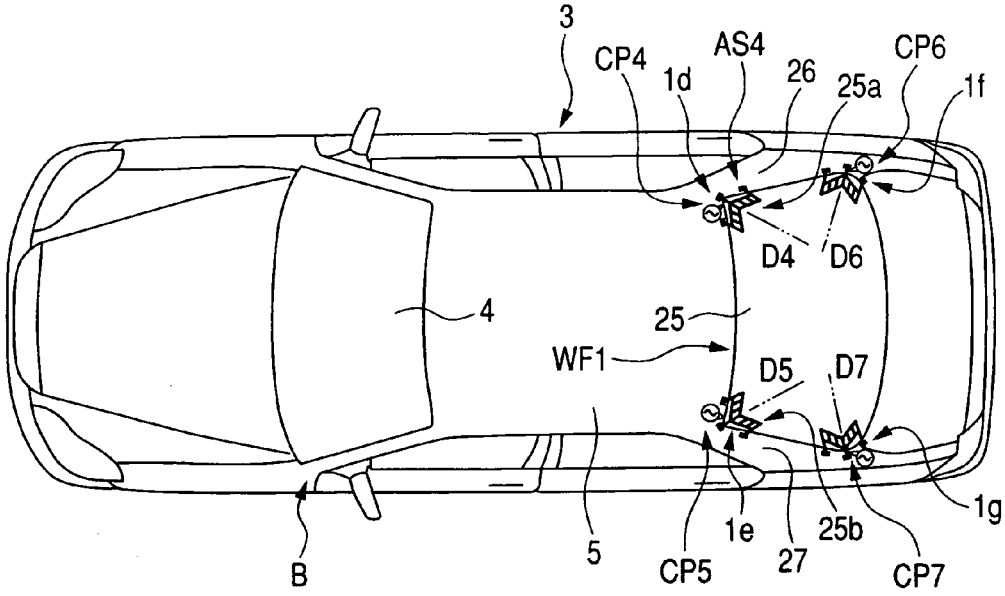
FIG. 9 is a view schematically illustrating an antenna system mounted on the body frame according to a fourth modification of the first embodiment.

FIG. 9 schematically illustrates an antenna system AS4 mounted on the body frame B according to a fourth modification of the first embodiment.

As illustrated in FIG. 9, the antenna system AS4 is provided with the mobile antennas 1*d* and 1*e*, which are mounted at the upper-right and upper-left corner portions 25*a* and 25*b* of the inner surface of the rear window 25.

In addition, the antenna system AS4 is provided with mobile antennas 1*f* and 1*g* whose structures are substantially symmetrical to the structure of the mobile antenna 1, and each element of each of the mobile antennas 1*f* and 1*g* is substantially identical with that of the mobile antenna 1. Reference characters of the elements of each of the mobile antennas 1*f* and 1*g* are therefore omitted in FIG. 9, keeping the viewability of FIG. 9 clear.

Specifically, the mobile antenna 1*f* is mounted at the lower-right corner portion 25*c* of the inner surface of the rear window 25. The lower-right corner portion 25*c* is close to but away from a lower-right corner portion CP6 of the rear window frame portion WF1 at which one end (right end) of the bottom portion and the lower end of the window-side edge of the right front pillar 26 meet.

The inner portion 7 of the antenna element 2 of the mobile antenna 1*f* is arranged along the center direction D6 of a corner angle formed by the bottom portion of the rear window frame portion WF1 and the window-side edge of the right rear pillar 26. The one end 7*a* of the inner portion 7 is located at the lower-right corner portion CP6. The other end 7*b* of the inner portion 7 is arranged on the center direction D6 of the corner angle. The connection portion 10 is arranged to be parallel to the bottom portion of the front window frame portion WF1, and the connection portion 11 is arranged to be parallel to the window-side edge of the right rear pillar 26. Because other structures of the antenna element 2 of the mobile antenna 1*f* are substantially the same as those of the antenna element 2 of the mobile antenna 1, descriptions of which are omitted.

The mobile antenna 1*g* is symmetrically placed in the vehicle-3 with respect to the mobile antenna 1*a* along the left rear pillar 27.

Specifically, the mobile antenna 1*g* is mounted at the lower-left corner portion 25*d* of the inner surface of the rear window 25. The lower-left corner portion 25*d* is close to but away from a lower-left corner portion CP7 of the rear window frame portion WF1 at which one end (left end) of the bottom portion and the lower end of the window-side edge of the left rear pillar 27 meet.

The inner portion 7 of the antenna element 2 of the mobile antenna 1*g* is arranged along the center direction D7 of a corner angle formed by the bottom portion of the rear window frame portion WF1 and the window-side edge of the left rear pillar 27. The one end 7*a* of the inner portion 7 is located at least adjacent to the lower-left corner portion CP7. The feeding point 14 is electrically connected to the one end 7*a* of the inner portion 7. The other end 7*b* of the inner portion 7 is arranged on the center direction D7 of the corner angle.

The connection portion 10 is arranged to be parallel to the bottom portion of the rear window frame portion WF1, and the connection portion 11 is arranged to be parallel to the window-side edge of the left rear pillar 27. Because other structures of the antenna element 2 of the mobile antenna 1*b* are substantially the same as those of the antenna element 2 of the mobile antenna 1, descriptions of which are omitted.

As described above, similar to the former described modifications, the antenna system AS4 according to the fourth modification of the first embodiment provides space diversity and different polarized surfaces because the mobile antennas 1*d* to 1*g* are symmetrically arranged on the inner surface of the rear window 25. This makes it possible to further improve the receiving efficiency of the vehicle 3 with respect to radio waves transmitted from both the front side and rear side of the vehicle 3.

Figure 10:
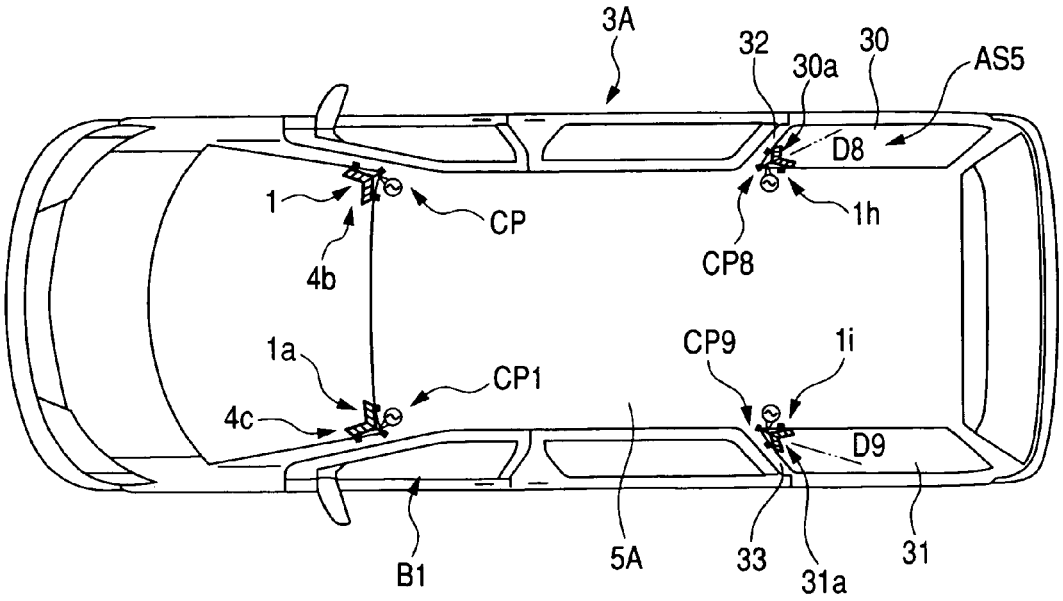
FIG. 10 is a view schematically illustrating an antenna system mounted on a body frame according to a fifth modification of the first embodiment.

FIG. 10 schematically illustrates an antenna system AS5 mounted on a body frame B1 of a station wagon vehicle 3A according to a fifth modification of the first embodiment.

As illustrated in FIG. 10, the antenna system AS5 is provided with the mobile antennas 1 and 1*a*, which are mounted at the upper-right and upper-left corner portions 4*b* and 4*c* of the inner surface of the front window 4.

In addition, the antenna system AS5 is provided with mobile antennas 1*h* and 1*i* whose structures are substantially symmetrical to the structure of the mobile antenna 1, and each element of each of the mobile antennas 1*h* and 1*i* is substantially identical with that of the mobile antenna 1. Reference characters of the elements of each of the mobile antennas 1*f* and 1*g* are therefore omitted in FIG. 10, keeping the viewability of FIG. 10 clear.

The mobile antenna 1*h* is symmetrically placed in the vehicle 3 with respect to the mobile antenna 1 in the longitudinal direction of the vehicle 3A.

Specifically, the mobile antenna 1*h* is mounted at one upper corner portion 30*a* of an inner surface of the right-quarter window 30. The upper-right corner portion 30*a* is close to but away from the portion CP8 at which the right-quarter window-side edge of a roof panel 5A of the body frame B1 and the upper end of the window-side edge of a right quarter pillar 32 thereof meet.

The inner portion 7 of the antenna element 2 is arranged along the center direction D8 of a corner angle formed by the right-quarter window-side edge of the roof panel 5A and the window-side edge of the right quarter pillar 32. The one end 7*a* of the inner portion 7 is located at least adjacent to the portion CP8. The feeding point 14 is electrically connected to the one end 7*a* of the inner portion 7. The other end 7*b* of the inner portion 7 is arranged on the center direction D8 of the corner angle.

The connection portion 10 is arranged to be parallel to the right-quarter window-side edge of the roof panel 5A, and the connection portion 11 is arranged to be parallel to the window-side edge of the right quarter pillar 32. Because other structures of the antenna element 2 of the mobile antenna 1*h* are substantially the same as those of the antenna element 2 of the mobile antenna 1, descriptions of which are omitted.

In addition, the mobile antenna 1*i* is symmetrically placed in the vehicle 3A with respect to the mobile antenna 1*h* in the lateral (horizontal) direction of the vehicle 3A.

Specifically, the mobile antenna 1*i* is mounted at one upper corner portion 31*a* of an inner surface of the left-quarter window 31. The corner portion 31*a* is close to but away from the portion CP9 at which the left-quarter window-side edge of the roof panel 5A of the body frame B1 and the upper end of the window-side edge of a left quarter pillar 33 thereof meet.

The inner portion 7 of the antenna element 2 is arranged along the center direction D9 of a corner angle formed by the left-quarter window-side edge of the roof panel 5A and the window-side edge of the left quarter pillar 33. The one end 7*a* of the inner portion 7 is located at least adjacent to the portion CP9. The feeding point 14 is electrically connected to the one end 7*a* of the inner portion 7. The other end 7*b* of the inner portion 7 is arranged on the center direction D9 of the corner angle.

The connection portion 10 is arranged to be parallel to the left-quarter window-side edge of the roof panel 5A, and the connection portion 11 is arranged to be parallel to the window-side edge of the left quarter pillar 33. Because other structures of the antenna element 2 of the mobile antenna 1*i* are substantially the same as those of the antenna element 2 of the mobile antenna 1, descriptions of which are omitted.

As described above, similar to the former described modifications, the antenna system AS5 according to the fifth modification of the first embodiment provides space diversity and different polarized surfaces because the mobile antennas 1, 1*a*, 1*h*, and 1*i* are symmetrically arranged on the upper side of the vehicle 3A. This makes it possible to further improve the receiving efficiency of the vehicle 3 with respect to radio waves transmitted from both the front side and rear side of the vehicle 3A.

Figure 11:
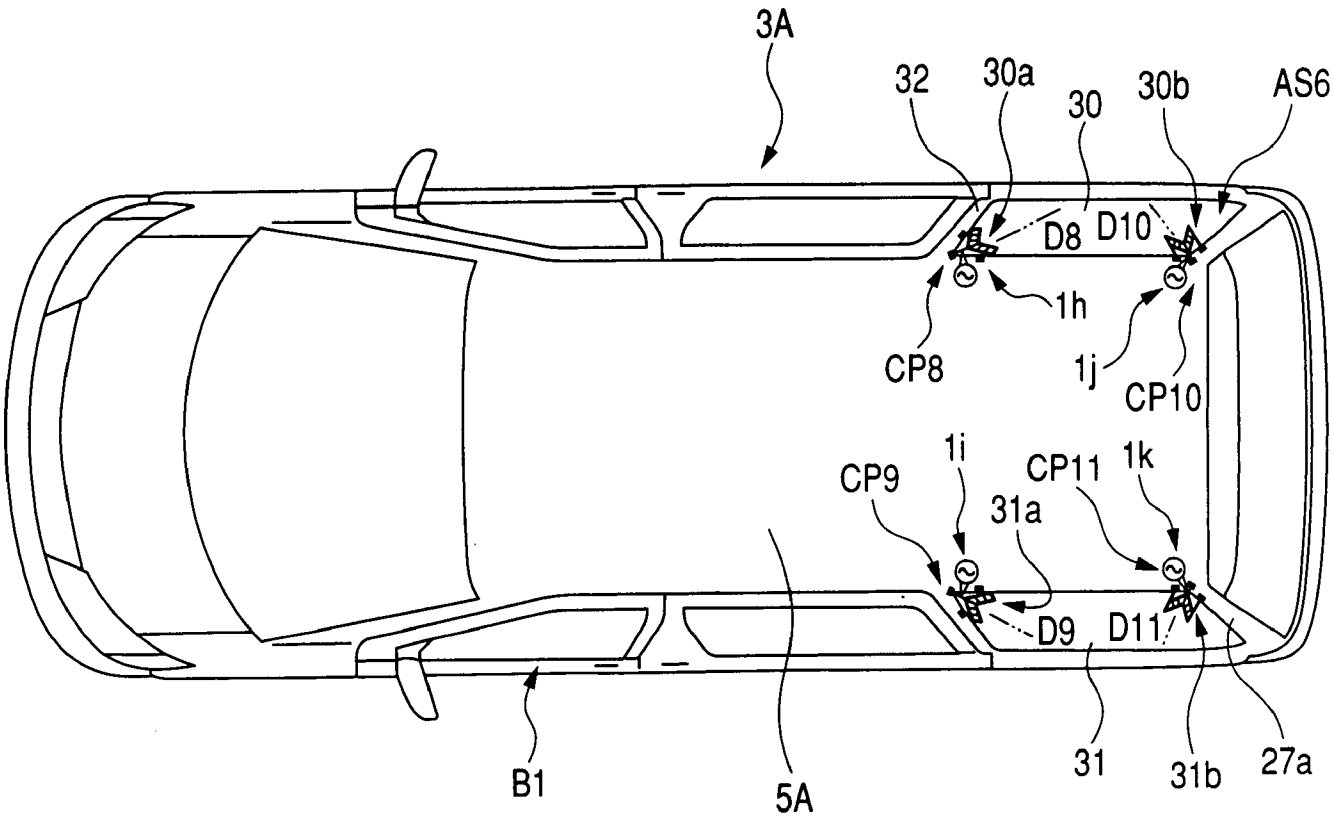
FIG. 11 is a view schematically illustrating an antenna system mounted on the body frame according to a sixth modification of the first embodiment.

FIG. 11 schematically illustrates an antenna system AS6 mounted on the body frame B1 of the station wagon vehicle 3A according to a sixth modification of the first embodiment.

As illustrated in FIG. 11, the antenna system AS6 is provided with the mobile antennas 1*h* and 1*i*, which are mounted at the one upper corner portion of the inner surface of the right quarter window 30 and that of the inner surface of the left quarter window 31.

In addition, the antenna system AS6 is provided with mobile antennas 1*j* and 1*k* whose structures are substantially symmetrical to the structure of the mobile antenna 1, and each element of each of the mobile antennas 1*j* and 1*k* is substantially identical with that of the mobile antenna 1. Reference characters of the elements of each of the mobile antennas 1*j* and 1*k* are therefore omitted in FIG. 11, keeping the viewability of FIG. 11 clear.

The mobile antenna 1*j* is symmetrically placed in the vehicle 3A with respect to the mobile antenna 1*h* in the longitudinal direction of the vehicle 3A.

Specifically, the mobile antenna 1*j* is mounted at the other upper corner portion 30*b* of the inner surface of the right-quarter window 30. The other upper corner portion 30*b* is close to but away from the right rear corner portion CP10 at which the right-quarter window-side edge of the roof panel 5A of the body frame B1 and the upper end of the right-quarter window-side edge of a right rear pillar 26*a* thereof meet.

The inner portion 7 of the antenna element 2 is arranged along the center direction D10 of a corner angle formed by the right-quarter window-side edge of the roof panel 5A and the right-quarter window-side edge of the right rear pillar 26*a*. The one end 7*a* of the inner portion 7 is located at the right rear corner portion CP10. The feeding point 14 is electrically connected to the one end 7*a* of the inner portion 7. The other end 7*b* of the inner portion 7 is arranged on the center direction D10 of the corner angle.

The connection portion 10 is arranged to be parallel to the right-quarter window-side edge of the roof panel 5A, and the connection portion 11 is arranged to be parallel to the right-quarter window-side edge of the right rear pillar 26*a*. Because other structures of the antenna element 2 of the mobile antenna 1*j* are substantially the same as those of the antenna element 2 of the mobile antenna 1, descriptions of which are omitted.

In addition, the mobile antenna 1*k* is symmetrically placed in the vehicle 3A with respect to the mobile antenna 1*j* in the lateral (horizontal) direction of the vehicle 3A.

Specifically, the mobile antenna 1*k* is mounted at the other upper corner portion 31*b* of the inner surface of the left-quarter window 31. The other upper corner portion 31*b* is close to but away from the left rear corner portion CP11 at which the left-quarter window-side edge of the roof panel 5A of the body frame B1 and the upper end of the left-quarter window-side edge of a left rear pillar 27*a* thereof meet.

The inner portion 7 of the antenna element 2 is arranged along the center direction D11 of a corner angle formed by the left-quarter window-side edge of the roof panel 5A and the left-quarter window-side edge of the left rear pillar 27*a*. The one end 7*a* of the inner portion 7 is located at least adjacent to the left rear corner portion CP11, The feeding point 14 is electrically connected to the one end 7*a* of the inner portion 7. The other end 7*b* of the inner portion 7 is arranged on the center direction D11 of the corner angle.

The connection portion 10 is arranged to be parallel to the left-quarter window-side edge of the roof panel 5A, and the connection portion 11 is arranged to be parallel to the left-quarter window-side edge of the left rear pillar 27*a*. Because other structures of the antenna element 2 of the mobile antenna 1*k* are substantially the same as those of the antenna element 2 of the mobile antenna 1, descriptions of which are omitted.

As described above, similar to the former described modifications, the antenna system AS6 according to the sixth modification of the first embodiment provides space diversity and different polarized surfaces because the mobile antennas 1*h* to 1*k* are symmetrically arranged on the upper-rear side of the vehicle 3A. This makes it possible to further improve the receiving efficiency of the vehicle 3 with respect to radio waves transmitted from both the front side and rear side of the vehicle 3A.

In the mobile antenna 1 according to the first embodiment set forth above, because the one end 7*a* of the inner portion 7 is located at the upper-right corner portion CP, and the other end 7*b* thereof is arranged on the center direction D of the corner angle θ, the inner portion 7 is arranged along the center direction D such that the inner portion 2 thereof to be inclined to the vertical and horizontal directions with respect to the ground surface.

This structure of the mobile antenna 1 allows, as shown in FIGS. 2A and 2B, polarized surfaces C of the inner portion 7 of the antenna element 2 to be non-orthogonal to polarized surfaces A of each vertically polarized wave and polarized surfaces B of each horizontally polarized wave in the radio waves. Specifically, the polarized surfaces C of the inner portion 7 of the antenna element 2 are inclined with respect to polarized surfaces A of each vertically polarized wave and polarized surfaces B of each horizontally polarized wave in the radio waves.

This structure of the mobile antenna 1 allows vertically polarized waves and horizontally polarized waves to be effectively received when they are transmitted from the front side of the vehicle 3.

Moreover, when vertically polarized waves and horizontally polarized waves are transmitted from the rear side of the vehicle 3, the mobile antenna 1 permits the transmitted vertically polarized waves, which are diffracted by the roof panel 5 to enter into the interior of the vehicle 3, to be effectively received by the antenna element 2.

Furthermore, the mobile antenna 1 permits the transmitted horizontally polarized waves, which are diffracted by the right-side of the vehicle to enter into the interior thereof, to be effectively received by the antenna element 2.

That is, it is possible for the mobile antenna 1 according to the first embodiment to effectively receive both the vertically polarized waves and the horizontally polarized waves transmitted from both the front side of the vehicle and the rear side thereof. Consequently, the mobile antenna 1 is capable of stably receiving radio waves independently of any direction of the vehicle's travel and/or any direction from which the radio waves are transmitted.

In addition, in the mobile antenna 1, the other end 8*a* of the outer portion 8 is electrically connected to the ground point 15 mounted on the roof panel 5 acting as ground. Similarly, the other end 9*a* of the outer portion 9 is electrically connected to the ground point 16 mounted on the right front pillar 6 acting as ground.

Specifically, the inner portion 7, the connection portion 10, and the outer portion 8 are configured to a folded monopole antenna in which the antenna current transmission line composed of the portions 7, 10, and 8 is folded so that the other end portion 8*a* thereof is grounded to the roof antenna 5.

Similarly, the inner portion 7, the connection portion 11, and the outer portion 9 are configured to a folded monopole antenna in which the antenna current transmission line composed of the portions 7, 11, and 9 is folded so that the other end portion 9*a* thereof is grounded to the right front pillar 6.

Each of the folded monopole antennas serves as a loop antenna. Specifically, the current component flowing through the loop (first loop) formed by the portions 7, 10, and 8 allows detection of magnetic field components of the radio waves; the magnetic field components are directed to be orthogonal to the loop area. In addition, the current component flowing through the first loop allows detection of magnetic field formed by high-frequency currents flowing through the body frame B.

Similarly, the current component flowing through the loop (second loop) formed by the portions 7, 11, and 9 allows detection of magnetic field components of the radio waves; the magnetic field components are directed to be orthogonal to the loop area. In addition, the current component flowing through the second loop allows detection of magnetic field formed by the high-frequency currents flowing through the body frame B.

Consequently, the mobile antenna 1 according to the first embodiment allows its sensitivity with respect to the radio waves to improve.

In addition, the loop areas formed by the antenna element 2 makes it possible for the mobile antenna 1 to improve the nondirectional characteristic thereof.

Furthermore, as illustrated in FIG. 1, the inner portion 7, the connection portion 10, the outer portion 8, and the mesh portions 12 provide the plurality of current paths whose path lengths are different from each other. Similarly, the inner portion 7, the connection portion 11, the outer portion 9, and the mesh portions 13 provide the plurality of current paths whose path lengths are different from each other.

These different path lengths (antenna lengths) provided by the antenna element 2 have corresponding different resonant frequencies, respectively; these different resonant frequencies correspond to a broad frequency band. Specifically, these different path lengths (antenna lengths) provided by the antenna element 2 allows the bandwidth of the mobile antenna 1 to be wider.

As illustrated in FIGS. 6 to 11, at least two of a plurality of the mobile antennas 1 and 1*a* to 1*k* can be mounted on the body frame B (B1) such that they are substantially symmetrically arranged in the space of the body frame B (B1). This structure provides space diversity that can achieve space diversity effect, making it possible to further improve the receiving efficiency of the vehicle 3 with respect to radio waves transmitted from both the front side and rear side of the vehicle 3.

In addition, at least two of a plurality of the mobile antennas 1 and 1*a* to 1*k* can be mounted on the body frame B (B1) such that directions in which antenna current components flow through the at least two antennas are different from each other. This structure can provide different polarized surfaces, making it possible to achieve polarization-diversity effect.

Note that, in the first embodiment, the inner portion 7, and the outer portions 8 and 9 are designed to have the same length L1 of 0.15λ, and the connection portions 10 and 11 are designed to have the same length L2 of 0.2λ. In addition, the length L1 of 0.15λ and the length L2 of the 0.2λ are amended by multiplying them by the fractional shortening value within the range from 0.7 to 0.8.

The present invention is not limited to the lengths of the L1 and L2.

Figure 12:
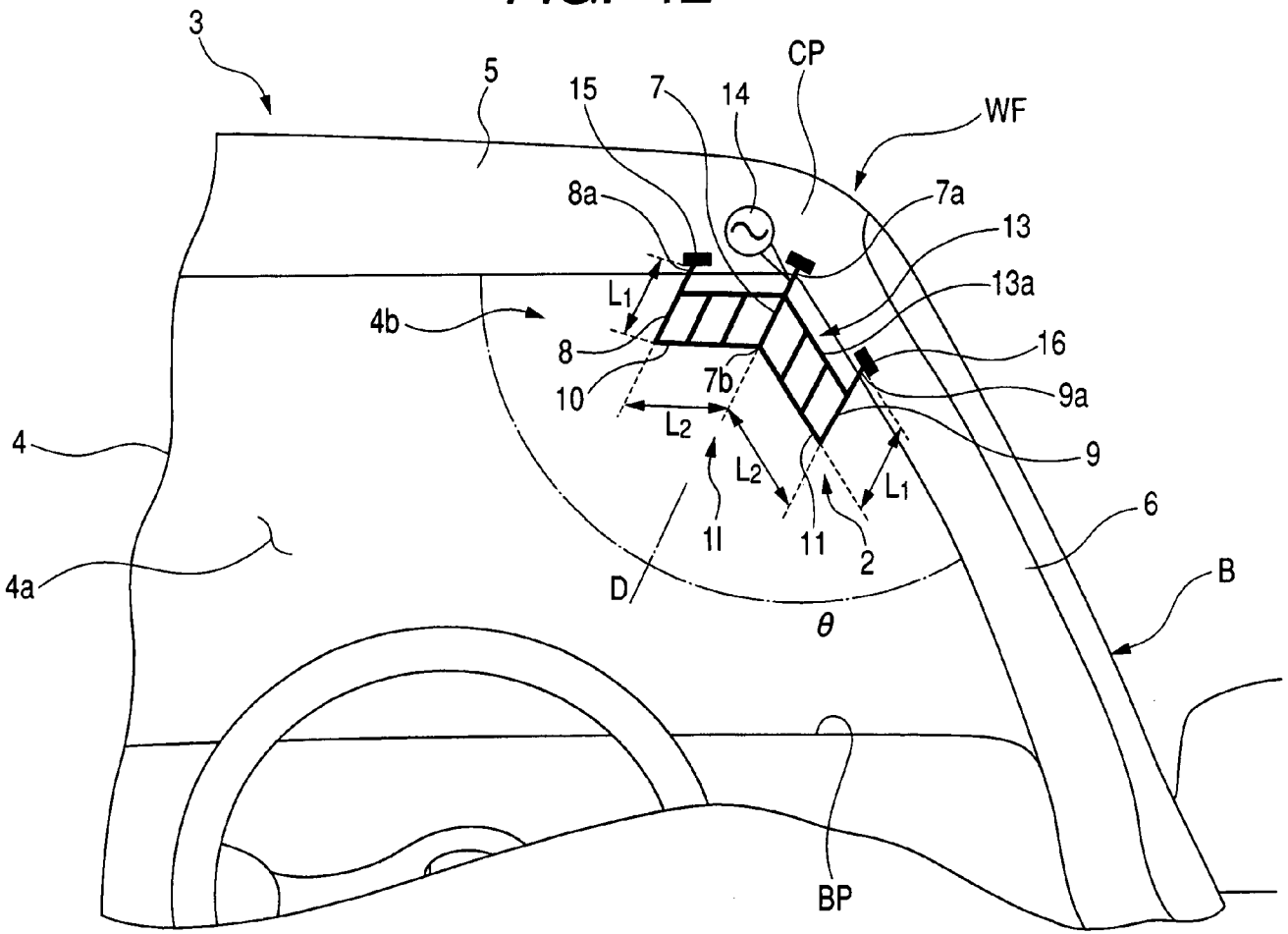
FIG. 12 is a view illustrating a mobile antenna according to a still further modification of the first embodiment.

Specifically, FIG. 12 illustrates a mobile antenna 1*l* according to a still further modification of the first embodiment. In the mobile antenna 1, the lengths of the L1 and L2 can be desirably determined on condition that the overall length of each of the first loop (portions 7, 10, and 8) and the second loop (portions 7, 11, and 9), which is represented as "L1×2+L2", becomes approximately $$\left(\frac{1}{2}\lambda 0\right).$$

Note that λ0 is a wavelength corresponding to the lowest frequency within a target frequency range of, for example, 470 to 770 MHz of target radio waves, corresponding to UHF band.

Incidentally, when considering the influence of the fractional shortening value within the range from 0.7 to 0.8, each of the overall lengths of the first and second loops can be amended based on the fractional shortening value within the range from 0.7 to 0.8.

The structure of the mobile antenna 1*l* allows the overall length of each of the first and second loops to be set to approximately $$\left(\frac{1}{2}\lambda 0\right)\times$$

the fractional shortening value within the range from 0.7 to 0.8.

This allows loss caused by the impedance matching in each of the first and second loops of the mobile antenna 1*l* to decrease, making it possible to further improve the reception performance of the mobile antenna 1*l*.

The configuration of the antenna element 2 of the mobile antennas according to the first embodiment and its modifications is not limited to the above configuration illustrated in FIG. 1.

Figure 13A:
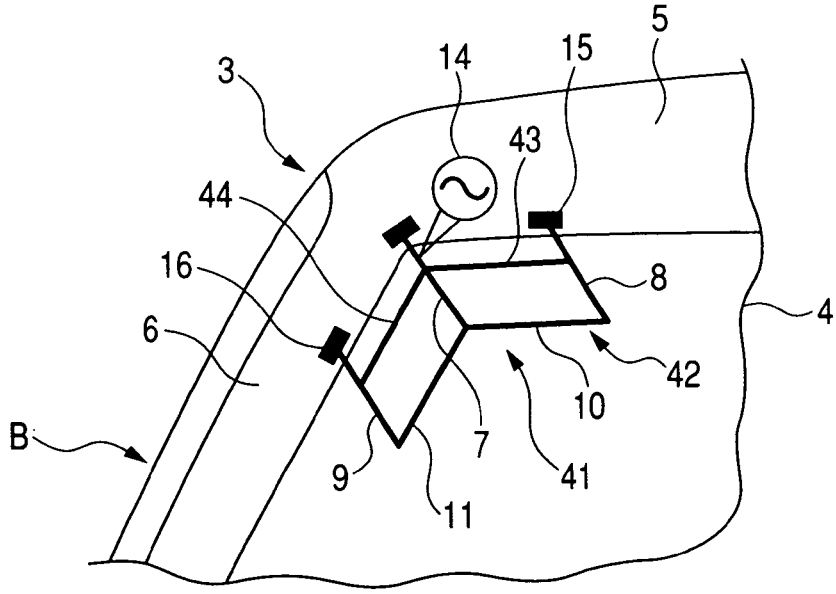
FIG. 13A is a view schematically illustrating a modification of a configuration of an antenna element of the mobile antenna according to the first embodiment.

Specifically, as illustrated in FIG. 13A, an antenna element 41 of a mobile antenna 40 has a pair of bypass portions 43 and 44 in place of the mesh portions 12 and 13.

The bypass portion 43 is an electrically conductive linear member and is joined between an intermediate portion of the inner portion 7 and that of the outer portion 8. The bypass portion 43 is arranged to be substantially parallel to the front edge of the roof panel 5 with clearances therebetween.

The bypass portion 44 is an electrically conductive linear member and is joined between an intermediate portion of the inner portion 7 and that of the outer portion 9. The bypass portion 44 is arranged to be substantially parallel to the windshield-side edge of the right front pillar 6 with clearances therebetween.

Other elements of the mobile antenna 40 are substantially identical with those of the mobile antenna 1, so that the descriptions of which are omitted.

The configuration of the antenna element 41 of the mobile antenna 40 can provide a plurality of different current paths whose path lengths are different from each other, which is similar to the antenna element 2 of the first embodiment.

These different path lengths (antenna lengths) provided by the antenna element 41 allows the bandwidth of the mobile antenna 40 to be wider.

Figure 13B:
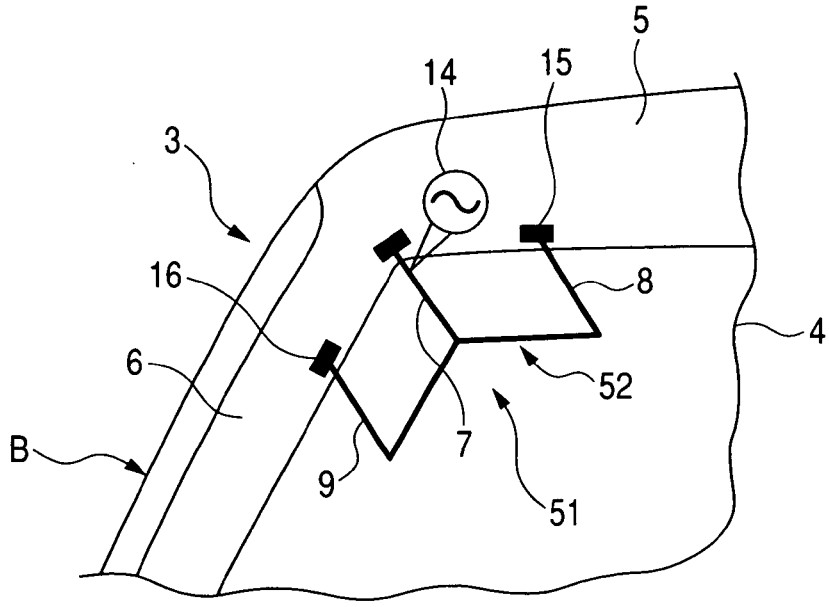
FIG. 13B is a view schematically illustrating another modification of the configuration of the antenna element of the mobile antenna according to the first embodiment.

In addition, as illustrated in FIG. 13B, an antenna element 51 of a mobile antenna 50 has no mesh portions 12 and 13, and bypass portions 43 and 44, as compared with the configurations of the antenna element 2 and the antenna element 41. Because the mobile antenna 50 has a more simple structure than the structures of the mobile antennas 2 and 40, it is useful in cases where there is no need for wider bandwidth of the mobile antenna 50.

Figure 14A:
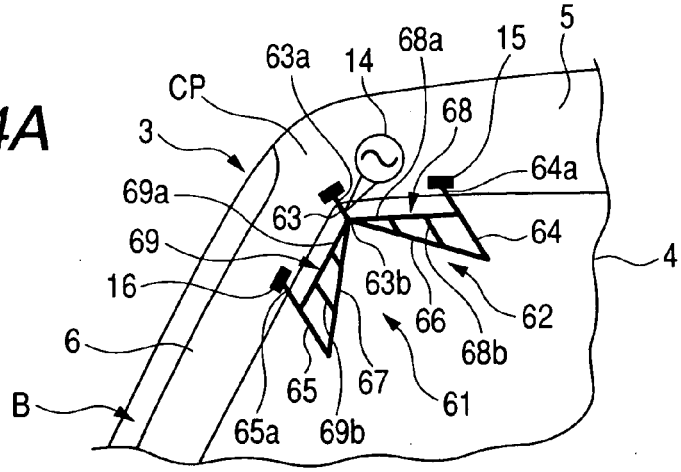
FIG. 14A is a view schematically illustrating a further modification of the configuration of the antenna element of the mobile antenna according to the first embodiment.

FIG. 14A illustrates a configuration of an antenna element 61 of a mobile antenna 60; this configuration of the antenna element 61 is a modification of the antenna element 2.

The antenna element 61 has a linear inner portion 63, a pair of linear outer portions 64 and 65, and a pair of linear connection portions 66 and 67.

The inner portion 63 has one end 63*a* and the other end 63*b*. The inner portion 63 is arranged along the center direction of a corner angle formed by the front edge of the roof panel 5 and the windshield-side edge of the right front pillar 6, which is similar to the antenna element 2. The one end 63*a* of the inner portion 63 is located at least adjacent to the upper-right corner portion CP. A feeding point 14 is electrically connected to the one end 63*a* of the inner portion 63. The other end 63*b* of the inner portion 63 is arranged on the center direction of the corner angle, which is similar to the antenna element 2.

The outer portions 64 and 65 are arranged to be parallel to the inner portion 63, and configured such that the length of each of the outer portions 64 and 65 is longer than that of the inner portion 63.

One end of each of the connection portions 66 and 67 is joined to the other end 63*b* of the inner portion 63. The connection portion 66 is arranged to be substantially parallel to the front edge of the roof panel 5, and the other end of the connection electric portion 66 is joined to one end of the outer portion 64. The connection portion 67 is arranged to be substantially parallel to the windshield-side edge of the right front pillar 6, and the other end of the connection portion 67 is joined to one end of the outer portion 65.

The other end 64*a* of the outer portion 64 extends onto the front edge of the roof panel 5 so as to be electrically connected to the ground point 15. Similarly, the other end portion 65*a* of the outer portion 65 extends onto the right front pillar 6 so as to be electrically connected to the ground point 16.

Furthermore, the antenna element 62 has a pair of mesh portions 68 and 69.

The mesh portion 68 is composed of a linear portion 68*a* arranged, for example, to be substantially parallel to the front edge of the roof panel with clearances therebetween. The linear portion 68*a* is joined between the other end 63*b* of the inner portion 63 and an intermediate portion of the outer portion 64.

The mesh portion 68 is also composed of a plurality of, such as two, bars 68*b*. The bars 68*b* are joined between the connection portion 66 and the linear portion 68*a* to be parallel to the outer portion 64 such that they have intervals along the linear portion 68*a*. Specifically, as illustrated in FIG. 14A, the inner portion 63, the connection portion 66, the outer portion 64, the linear portion 68*a*, and the bars 68*b* provide a plurality of current paths.

Similarly, the mesh portion 69 is composed of a linear portion 69*a* arranged, for example, to be substantially parallel to the windshield-side edge of the right front pillar 6 with clearances therebetween.

The linear portion 69*a* is joined between the other end 63*b* of the inner portion 63 and an intermediate portion of the outer portion 65.

In addition, the mesh portion 69 is also composed of a plurality of, such as two, bars 69*b*. The bars 69*b* are joined between the connection portion 67 and the linear portion 69*a* to be parallel to the outer portion 65 such that they have regular intervals along the connection portion 11 (linear portion 13*a*). Specifically, as illustrated in FIG. 14A, the inner portion 63, the connection portion 67, the outer portion 65, the linear portion 69*a*, and the bars 69*b* provide a plurality of current paths (loops).

Other elements of the mobile antenna 61 are substantially identical with those of the mobile antenna 1, so that the descriptions of which are omitted.

Figure 14B:
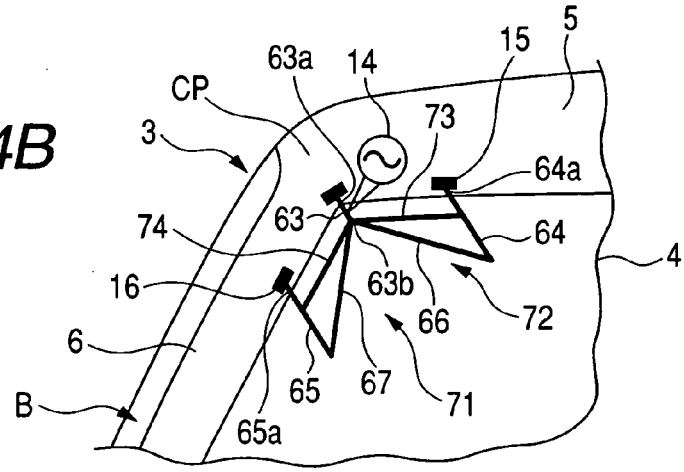
FIG. 14B is a view schematically illustrating a still further modification of the configuration of the antenna element of the mobile antenna according to the first embodiment.

In addition, as illustrated in FIG. 14B, an antenna element 72 of a mobile antenna 71 can be provided with a pair of bypass portions 73 and 74 in place of the mesh portions 68 and 69 of the antenna element 62.

The bypass portion 73 is an electrically conductive linear member and is joined between the other end 63*b* of the inner portion 63 and an intermediate portion of the outer portion 64. The bypass portion 73 is arranged to be substantially parallel to the front edge of the roof panel 5 with clearances therebetween.

The bypass portion 74 is an electrically conductive linear member and is joined between the other end 63*b* of the inner portion 63 and an intermediate portion of the outer portion 65. The bypass portion 74 is arranged to be substantially parallel to the windshield-side edge of the right front pillar 6 with clearances therebetween. Other elements of the mobile antenna 71 are substantially identical with those of the mobile antenna 61, so that the descriptions of which are omitted.

Figure 14C:
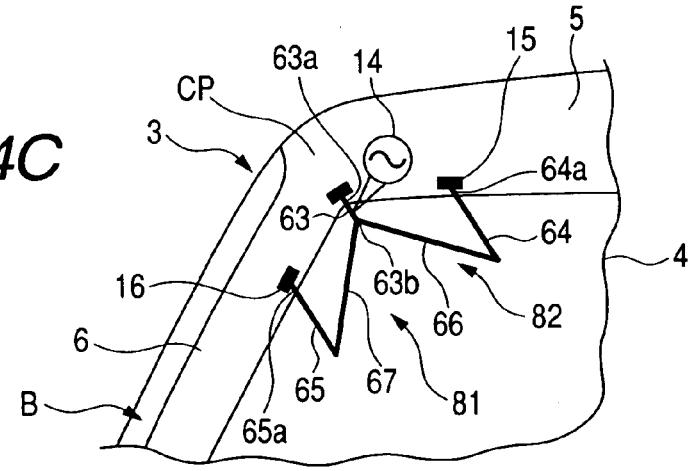
FIG. 14C is a view schematically illustrating a still further modification of the configuration of the antenna element of the mobile antenna according to the first embodiment.

Moreover, as illustrated in FIG. 14C, an antenna element 82 of a mobile antenna 81 can be provided with no mesh portions 68 and 69, and bypass portions 64 and 65, as compared with the configurations of the antenna element 62 and the antenna element 72. Other elements of the mobile antenna 81 are substantially identical with those of the mobile antenna 61, so that the descriptions of which are omitted.

For example, FIG. 3B illustrates the measurement result of horizontal-plane directional patterns of the mobile antenna 71 in which the length of each of the outer portions 64 and 65 is set to approximately 0.2λ×the fractional shortening value of 0.75, and the length of each of the connection portions 66 and 67 is set to approximately 0.3λ×the fractional shortening value of 0.75.

As illustrated in FIG. 3B, in the mobile antenna 71, high directional gains are obtained to not only the front windshield side (the front side of the vehicle 3) to which the mobile antenna 71 is mounted, but also to the opposite side (the rear side of the vehicle 3). That is, the mobile antenna 51 according to the modification of the first embodiment can provide good and hardly-biased directional gains.

In addition, in the mobile antenna 71, loss resistance of the antenna element 72 is smaller than that of the antenna element 17*a*, and receiving efficiency of the antenna element 72 is higher than that of the antenna element 17*a*. These characteristics cause an average gain of the mobile antenna 71 with respect to the vertically-polarized waves to become −10.6 dB, which is more improved than an average gain of −17.5 dB of the mobile antenna 17 with respect to vertically-polarized waves. Similarly, these characteristics cause an average gain of the mobile antenna 71 with respect to the horizontally-polarized waves to become −8.3 dB, which is more improved than an average gain of −16.4 dB of the mobile antenna 17 with respect to horizontally-polarized waves.

Figure 15A:
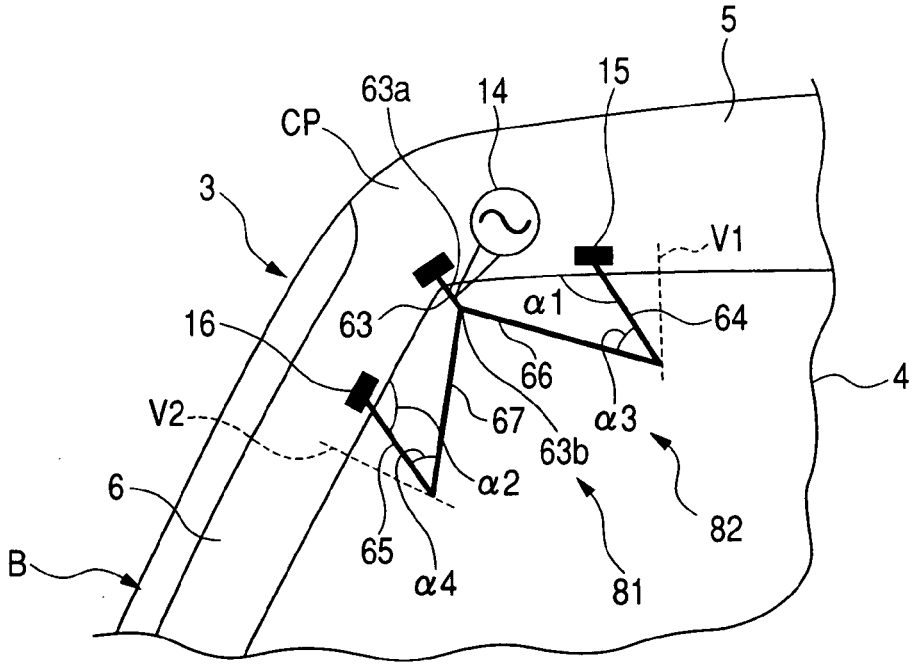
FIG. 15A is a view schematically illustrating a concrete example of the configuration of the antenna element of the mobile antenna illustrated in FIG. 14C.

In the configuration of the mobile antenna 81 illustrated in FIG. 14C, as illustrated in FIG. 15A, the antenna element 82 of the mobile antenna 81 is configured such that the ground point 15 is arranged between the inner portion 63 and a vertical line V1 orthogonal to the front edge of the roof panel 5. In other words, a ground angle α1 formed by the front edge of the roof panel 5 and the outer portion 64 is set to a right angle or an obtuse angle (≧90 degrees), and a folded angle α3 formed by the outer portion 64 and the connection portion 66 is set to an acute angle (<90 degrees).

Similarly, the antenna element 82 of the mobile antenna 81 is configured such that the ground point 16 is arranged between the inner portion 63 and a vertical line V2 orthogonal to the windshield-side edge of a right front pillar 6. In other words, a ground angle α2 formed by the windshield-side edge of a right front pillar 6 and the outer portion 65 is set to a right angle or an obtuse angle (≧90 degrees), and a folded angle α4 formed by the outer portion 65 and the connection portion 67 is set to an acute angle (<90 degrees).

In the configuration of the mobile antenna 81 illustrated in FIG. 15A, the ground angle α1 of the outer portion 64 with respect to the front edge of the roof panel 5 is an angle that allows capacity coupling to occur between the outer portion 64 and the front edge of the roof panel 5. In addition, the folded angle α3 of the connection portion 66 and the outer portion 64 is an angle that allows capacity coupling to occur therebetween.

Similarly, the ground angle α2 of the outer portion 65 with respect to the windshield-side edge of the right front pillar 6 is an angle that allows capacity coupling to occur between the outer portion 65 and the windshield-side edge of the right front pillar 6. In addition, the folded angle α4 of the connection portion 67 and the outer portion 65 is an angle that allows capacity coupling to occur therebetween.

In the configuration of the antenna eminent 82 of the mobile antenna 81, the capacity coupling can obtain the effects obtained in the antenna element 62 or antenna element 72 to which the mesh portions or the bypass portions are provided, making it possible to wide the bandwidth of the mobile antenna 81.

Incidentally, FIG. 16 illustrates the measurement result of impedance variation range with respect to the ground angle of the outer portion 64 with respect to the front edge of the roof panel 5 and the ground angle of the outer portion 65 with respect to the windshield-side edge of the right front pillar 6.

Figure 16A:
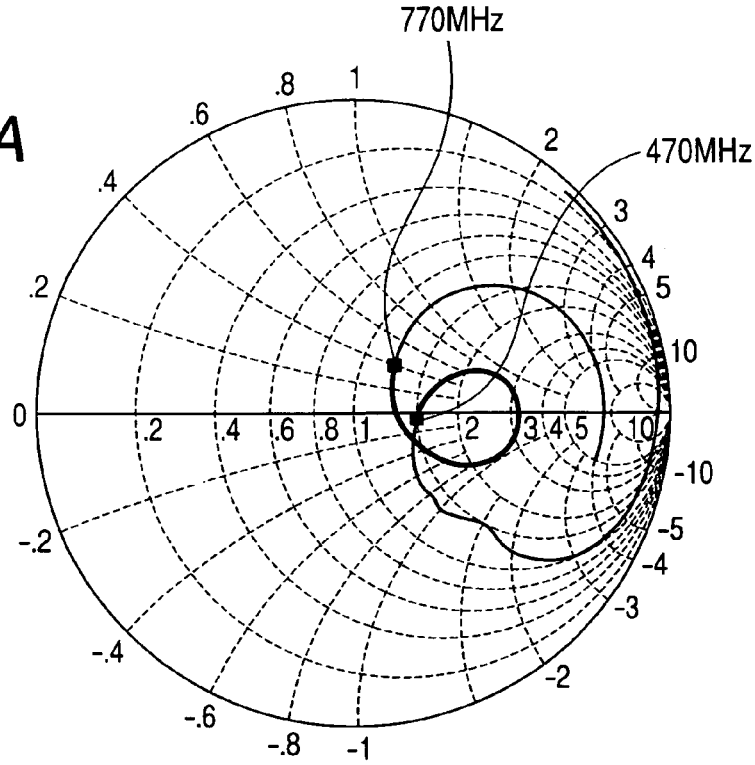
FIG. 16A is a smith chart illustrating the measurement result of impedance variation range with respect to ground angles of the antenna element illustrated in FIG. 15A.

In this case, when the ground angle α1 of the outer portion 64 with respect to the front edge of the roof panel 5 is set to an obtuse angle, and the ground angle α2 of the outer portion 65 with respect to the windshield-side edge of the right front pillar 6 is set to an obtuse angle (see FIG. 15A), as illustrated in FIG. 16A, the impedance variation range is approximately 98 Ω within the target radio wave's frequency range of 470 to 770 MHz corresponding to UHF band. Because the impedance variation range of 98 Ω is comparatively small, the mobile antenna 81 with a wide bandwidth can be obtained.

Figure 15B:
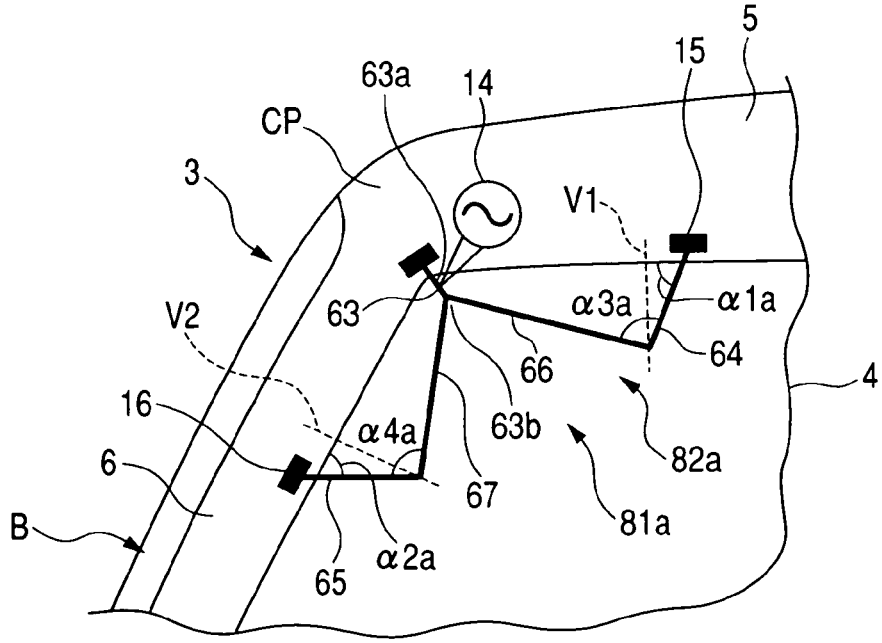
FIG. 15B is a view schematically illustrating a comparative example of an antenna element with respect to the antenna element illustrated in FIG. 15A.
Figure 16B:
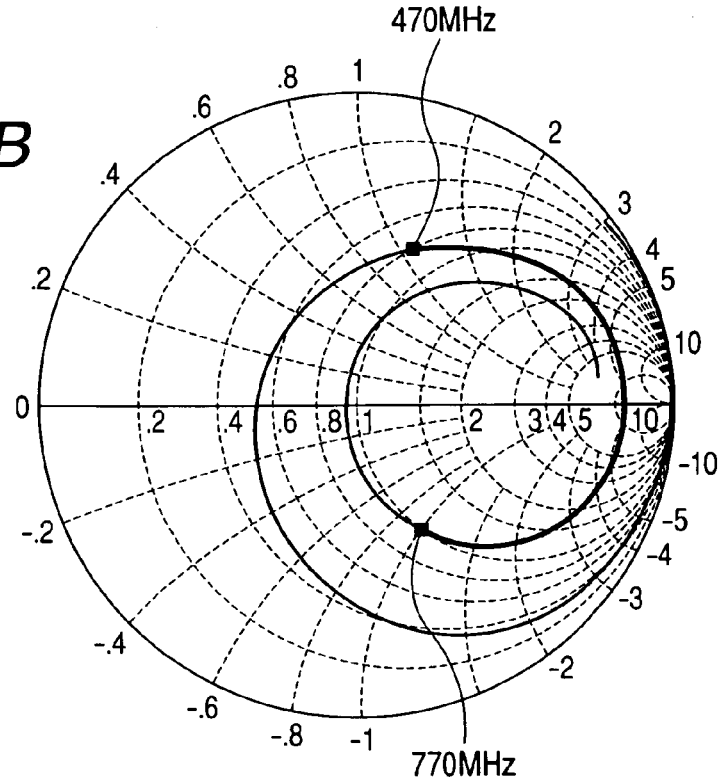
FIG. 16B is a smith chart illustrating the measurement result of impedance variation range with respect to corresponding ground angles of the antenna element illustrated in FIG. 15B.

In contrast, as illustrated as an antenna element 82*a* of a mobile antenna 81*a* in FIG. 15B, it is assumed that the ground angle α1*a* of the outer portion 64 with respect to the front edge of the roof panel 5 is set to an acute angle (the folded angle α3*a* is an obtuse angle). In addition, in the antenna element 82*a* of the mobile antenna 81*a*, it is assumed that the ground angle α2*a* of the outer portion 65 with respect to the windshield-side edge of the right front pillar 6 is set to an acute angle (the folded angle α4*a* is an obtuse angle). In the mobile antenna 81*a*, as illustrated in FIG. 16B, the impedance variation range is approximately 473 Ω within the target radio wave's frequency range of 470 to 770 MHz. Because the impedance variation range of 473 Ω is comparatively large, it is difficult for the mobile antenna 81*a* to obtain a wide bandwidth.

Figure 17A:
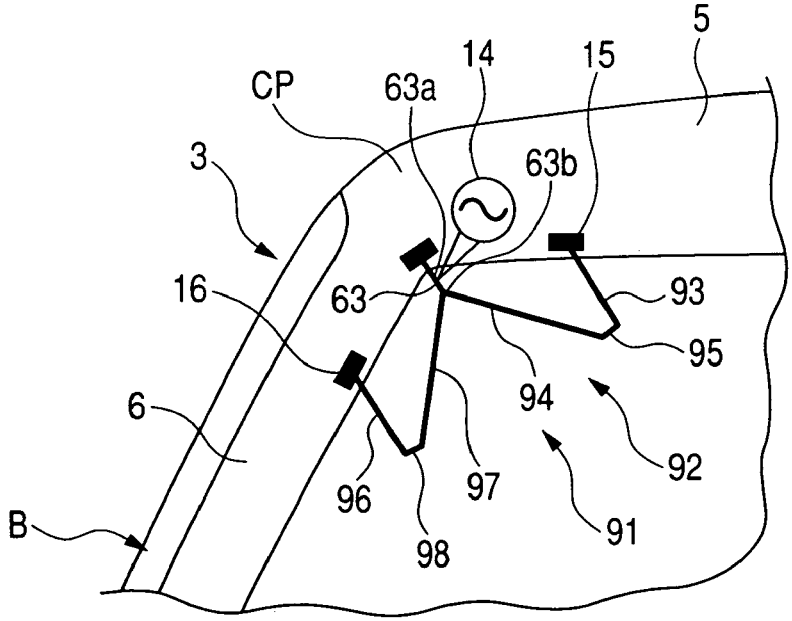
FIG. 17A is a view schematically illustrating a first modification of the antenna element of the mobile antenna illustrated in FIG. 14C or FIG. 15A.

As illustrated in FIG. 17A, as a first modification of the configuration of the mobile antenna 81, a mobile antenna 91 has an antenna element 92, which has substantially identical structure of the mobile antenna element 62 of the mobile antenna 61. Specifically, outer portions 93 and 96 correspond to the outer portions 64 and 65, respectively, and connection portions 94 and 97 correspond to the connection portions 66 and 67, respectively.

Specifically, the antenna element 92 of the mobile antenna 91 is configured such that capacity coupling occurs between the connection portion 94 and the outer portion 93, and between the connection portion 97 and the outer portion 96, which is similar to the antenna element 82.

In addition, the antenna element 92 is provided with a fold connection portion 95 connecting between the other end of the connection portion 94 and the one end of the outer portion 93. The antenna element 92 is also provided with a fold connection portion 98 connecting between the other end of the connection portion 97 and the one end of the outer portion 96.

Figure 17B:
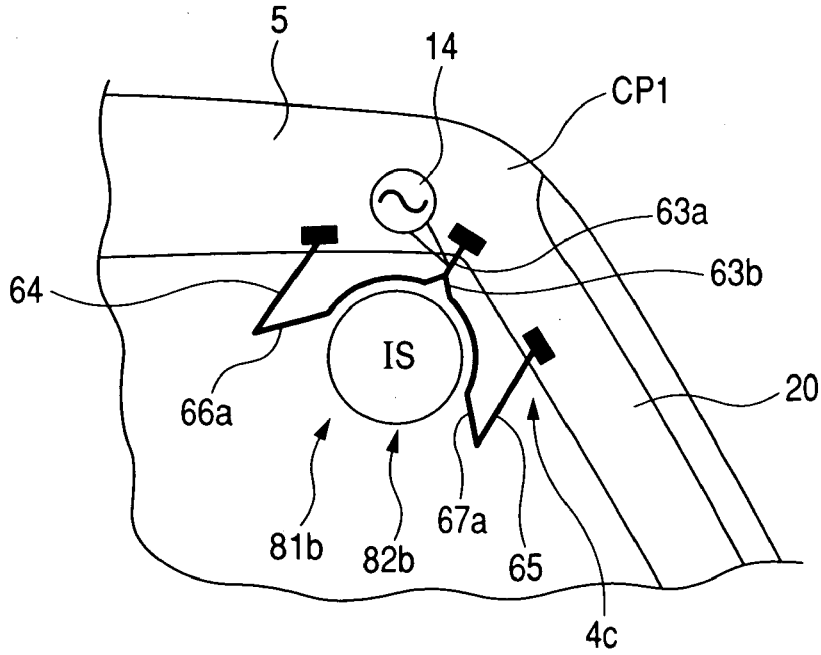
FIG. 17B is a view schematically illustrating another modification of the antenna element of the mobile antenna illustrated in FIG. 14C or FIG. 15A.

Moreover, as illustrated in FIG. 17B, it is assumed that a mobile antenna 81*b*, which is a modification of the mobile antenna 81, is mounted at the upper-left corner portion 4*c* of the inner surface 4*a* of the front windshield 4. Because a circular motor vehicle inspection sticker, referred to as "IS" has been already adhered on the upper-left corner portion 4*c* of the inner surface 4*a* of the front windshield 4, the mobile antenna 81*b* is mounted at the upper-left corner portion 4*c* of the inner surface 4*a* of the front windshield 4 such that connection portions 66*a* and 67*a* surround the motor vehicle inspection sticker.

Specifically, each of the connection portions 66*a* and 67*a* is partly curved around the outer circumference of the sticker IS. The remaining elements of the mobile antenna 81*b* are identical to corresponding elements of the mobile antenna 81 illustrated in FIG. 14C. In addition to obtaining the same effects as the structure of the mobile antenna 81, the structure of the mobile antenna 81*b* can prevent the connection portions 66*a* and 67*a* from being overlapped on the sticker IS.

Figure 18A:
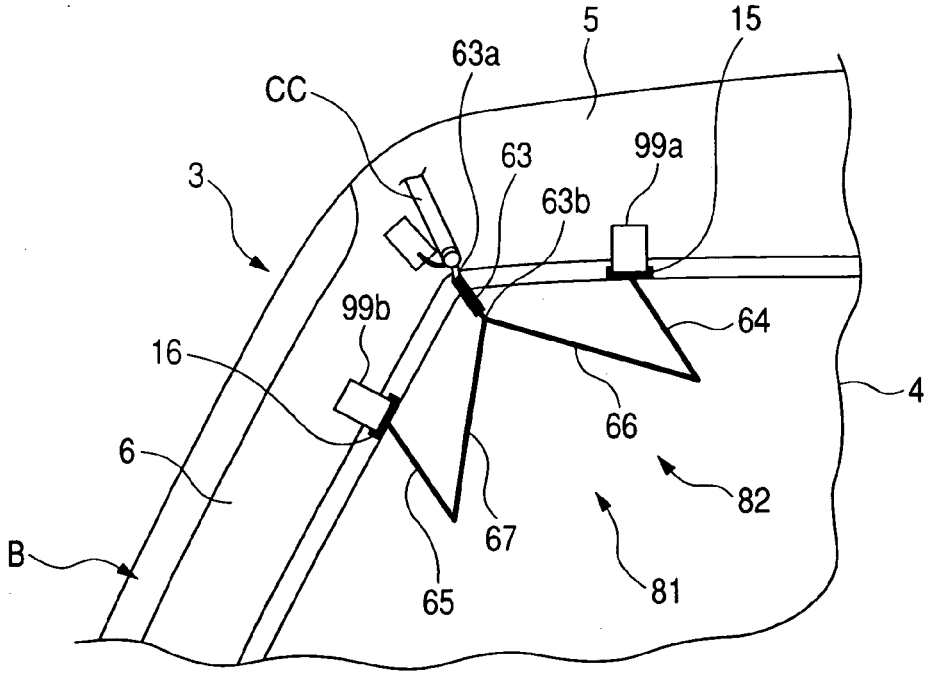
FIG. 18A is a view schematically illustrating an example of mount structures of ground points of the mobile antenna according to a second modification of the configuration of the mobile antenna illustrated in FIG. 14C or FIG. 15A.

FIG. 18A schematically illustrates a second modification of the configuration of the mobile antenna 81. FIG. 18A shows an example of mount structures of the ground points 15 and 16.

As illustrated in FIG. 18A, the ground point 15 can be mounted on the inner surface of the front edge of the roof panel 5 through a beaten copper tape 99*a*. In addition, the ground point 16 can be mounted on the inner surface of the windshield-side edge of the right front pillar 6 through a beaten copper tape 99*b*. Moreover, as the feeder 14, a coaxial cable CC is electrically connected to the one end 63*a* of the inner portion 63 of the antenna element 82.

The mount structures of the ground points 15 and 16 illustrated in FIG. 18A allow no use of ground terminals on the roof panel 5 and the right front pillar 6 of the vehicle body B, making it possible to prevent loss resistance from increasing and the mobile antenna's gain from decreasing. In addition, it is possible to reduce the cost of mounting the mobile antenna 81 on the vehicle 3.

Figure 18B:
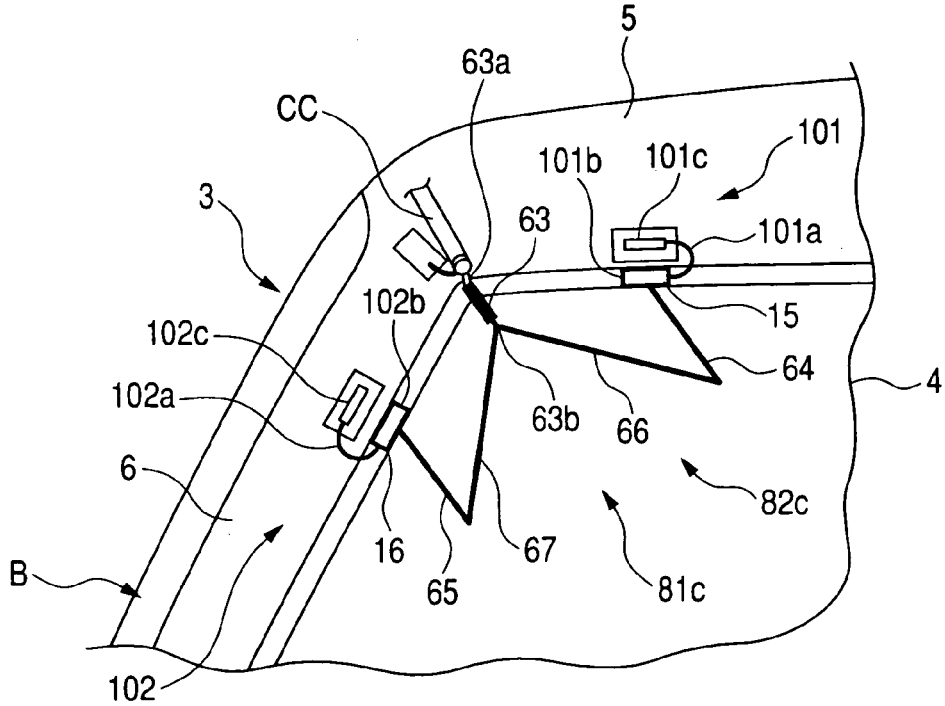
FIG. 18B is a view schematically illustrating another example of mount structures of the ground points of the mobile antenna according to a third modification of the configuration of the mobile antenna illustrated in FIG. 14C or FIG. 15A.

FIG. 18B schematically illustrates a mobile antenna 81*c* according to a third modification of the configuration of the mobile antenna 81. FIG. 18B shows another example of mount structures of the ground points 15 and 16.

As illustrated in FIG. 18B, the ground point is of the mobile antenna 81*c* is mounted on the inner surface of the front edge of the roof panel 5 through ground terminal 101, and the ground point 16 is mounted on the inner surface of the windshield-side edge of the right front pillar 6 through a ground terminal 102. The ground terminal 101 is provided with a first grounding wire 101*a*, a connector 101*b* electrically connected to the ground point 15 so that one end of the first grounding wire 101*a* is electrically connected to the connector 101*b*. The ground terminal 101 is also provided with a connector 101*c* electrically connected to the other end of the first grounding wire 101*a*.

Similarly, the ground terminal 102 is provided with a second grounding wire 102*a*, a connector 102*b* electrically connected to the ground point 16 so that one end of the second grounding wire 102*a* is electrically connected to the connector 102*b*. The ground terminal 102 is also provided with a connector 102*c* electrically connected to the other end of the second grounding wire 102*a*.

Second Embodiment

A second embodiment of the present invention will be described with reference to FIGS. 19 to 21. Note that descriptions of elements related to the second embodiment, which are substantially the same as those related to the first embodiment, are omitted so that remaining elements related to the second embodiment, which are different from the remaining elements related to the first embodiment, will be described.

Figure 19A:
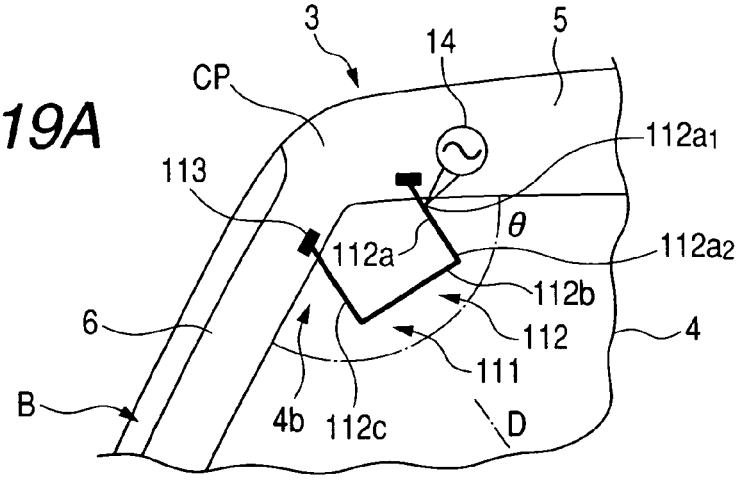
FIG. 19A is a view schematically illustrates a mobile antenna according to a second embodiment of the present invention.

FIG. 19A schematically illustrates a mobile antenna 111 according to a second embodiment of the present invention, which is mounted on the body frame B of the vehicle 3.

The mobile antenna 111 is provided with an antenna element 112 formed in a loop. The antenna element 112 is located at, for example, the upper-right corner portion 4*b* of the inner surface 4*a* of the front windshield 4.

The antenna element 112 has a first linear portion 112*a*, a second linear portion 112*b*, and a third linear portion 112*c*.

The first linear portion 112*a* has one end 112*a*1 and the other end 112*a*2. The first linear portion 112*a* is arranged parallel to the center direction D of the corner angle θ formed by the front edge of the roof panel 5 and the windshield-side edge of the right front pillar 6. A feeding point (feeder) 14 is electrically connected to the one end 112*a*1 of the first linear portion 112*a* such that power is fed to the antenna element 112 through the feeding point 14.

One end of the second linear antenna element 112*b* is joined to the other end 112*a*2 of the first linear portion 112*a* such that the second linear portion 112*b* is arranged to be orthogonal to the first linear portion 112*a*. The other end of the second linear portion 112*b* is joined to one end of the third linear portion 112*c*. The third linear portion 112*c* is arranged to be parallel to the first linear portion 112*a*. The other end of the third linear portion 112*c* extends onto the windshield-side edge of the right front pillar 6 to be electrically connected to a ground point 113. The ground point 113 is mounted on the inner surface of the windshield-side edge of the right front pillar 6 so as to be grounded thereto.

The overall length of the antenna element 112 is designed to 0.5λ

$$\left(\frac{\lambda}{2}\right)\times$$

the fractional shortening value within the range from 0.7 to 0.8; this λ is a wavelength of target radio waves.

In the structure of the mobile antenna 111, when power fed to the antenna element 112 through the feeding point 14 allows an antenna current to flow through the first linear antenna element 112*a* from the feeding point 14.

The first linear portion 112*a* is arranged parallel to the center direction D of the corner angle θ, so that it is inclined to the vertical and horizontal directions with respect to the ground surface.

This structure allows, as shown in FIGS. 2A and 2B, polarized surfaces C of the first linear portion 112*a* of the antenna element 112 to be non-orthogonal to each polarized surface A of each vertically polarized wave and each polarized surface B of each horizontally polarized wave in the radio waves, which is similar to the antenna element 2 according to the first embodiment.

Specifically, the mobile antenna 111 can effectively receive vertically and horizontally polarized waves when they are transmitted from the front side of the vehicle 3.

Furthermore, when vertically and horizontally polarized waves are transmitted from the rear side of the vehicle 3, the mobile antenna 111 permits the transmitted vertically polarized waves, which are diffracted by the roof panel 5 to enter into the interior of the vehicle 3, to be effectively received by the antenna element 112. This is because the antenna element 112 is arranged close to the roof panel 5 of the vehicle and each polarized surface C of the first linear portion 112*a* of the antenna element 112 is not to be orthogonal but to be crossed, at approximately 45 degrees, to each of the polarized surfaces A of he vertically polarized waves.

In addition, the mobile antenna 111 permits the transmitted horizontally polarized waves, which are diffracted by the right-side of the vehicle to enter into the interior thereof, to be effectively received by the antenna element 112. This is because the antenna element 112 is arranged close to the right-side of the vehicle and each polarized surface of the first linear portion 112*a* of the antenna element 112 is not to be orthogonal but to be crossed, at approximately 45 degrees, to each of the polarized surfaces B of the horizontally polarized waves.

That is, it is possible for the mobile antenna 111 according to the second embodiment to effectively receive both the vertically polarized waves and the horizontally polarized waves transmitted from both the front side of the vehicle and the rear side thereof.

Moreover, the antenna current passing through the first linear portion 112*a* flows through the second linear portion 112*b* and the third linear portion 112*c* into the ground point 113 in loop.

The current flowing through the loop formed by the antenna element 112 allows detection of magnetic field components of the radio waves; the magnetic field components are directed to be orthogonal to the loop area. In addition, the current flowing through the loop formed antenna element 112 allows detection of magnetic field formed by high-frequency currents flowing through the body frame B.

As described above, the mobile antenna 111 allows radio waves to be stably received independently of any direction of the vehicle's travel and/or any direction from which the radio waves are transmitted.

In addition, in the mobile antenna 111, the other end of the third linear portion 112*c* is folded to be electrically connected to the ground point 113 mounted on the right front pillar 6 acting as ground.

Specifically, the antenna element 112 is configured to a folded monopole antenna in which the antenna current transmission line composed of the antenna element 112 is folded so that the other end portion of the third linear portion 112*c* is grounded to the right front pillar 6.

The folded monopole antenna serves as a loop antenna. Specifically, the current flowing through the loop formed by the antenna element 112 allows detection of magnetic field components of the radio waves; the magnetic field components are directed to be orthogonal to the loop area. This makes it possible to improve the sensitivity of the mobile antenna 111 with respect to the radio waves.

Figure 19B:
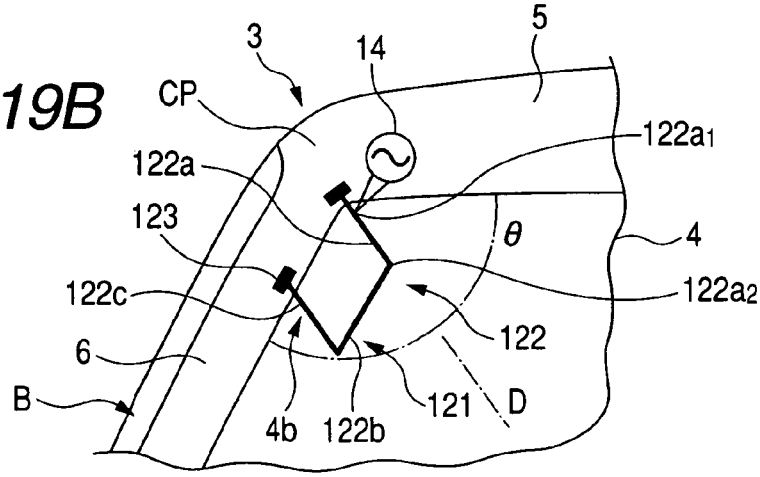
FIG. 19B is a view schematically illustrates a modification of the mobile antenna according to the second embodiment.

A modification of the mobile antenna 111 according to the second embodiment is illustrated in FIG. 193. As shown in FIG. 19B, a mobile antenna 121 according to the modification is provided with an antenna element 122 formed in a loop. The antenna element 122 is located at, for example, the upper-right corner portion 4*b* of the inner surface 4*a* of the front windshield 4.

The antenna element 122 has a first linear portion 122*a*, a second linear portion 122*b*, and a third linear portion 122*c*.

The first linear portion 122*a* has one end 122*a*1 and the other end 122*a*2. The first linear portion 122*a* is arranged along the center direction D of the corner angle θ formed by the front edge of the roof panel 5 and the windshield-side edge of the right front pillar 6. A feeding point (feeder) 14 is electrically connected to the one end 122*a*1 of the first linear portion 122*a* such that power is fed to the antenna element 122 through the feeding point 14.

One end of the second linear antenna element 122*b* is joined to the other end 122*a*2 of the first linear portion 122*a* such that the second linear portion 122*b* is arranged to be parallel to the windshield-side edge of the right front pillar 6. The other end of the second linear portion 122*b* is joined to one end of the third linear portion 122*c*. The third linear portion 122*c* is arranged to be parallel to the first linear portion 122*a*. The other end of the third linear portion 122*c* extends onto the windshield-side edge of the right front pillar 6 to be electrically connected to a ground point 123. The ground point 123 is mounted on the inner surface of the windshield-side edge of the right front pillar 6 so as to be grounded thereto.

This configuration of the mobile antenna 121 can obtain substantially the same effects obtained by the mobile antenna 111.

Figure 19C:
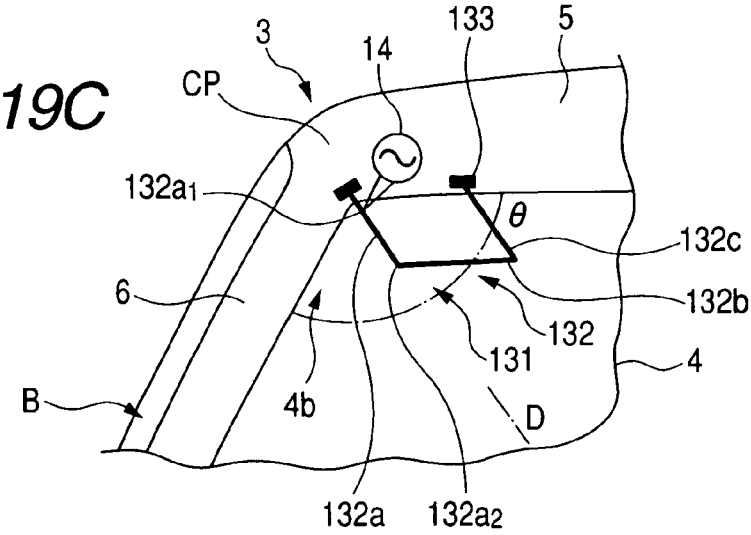
FIG. 19C is a view schematically illustrates another modification of the mobile antenna according to the second embodiment.

In addition, another modification of the mobile antenna 111 according to the second embodiment is illustrated in FIG. 19C. As shown in FIG. 19C, a mobile antenna 131 according to another modification is provided with an antenna element 132 formed in a loop. The antenna element 132 is located at, for example, the upper-right corner portion 4*b* of the inner surface 4*a* of the front windshield 4.

The antenna element 132 has a first linear portion 132*a*, a second linear portion 132*b*, and a third linear portion 132*c*.

The first linear portion 132*a* has one end 132*a*1 and the other end 132*a*2. The first linear portion 132*a* is arranged along the center direction D of the corner angle θ formed by the front edge of the roof panel 5 and the windshield-side edge of the right front pillar 6. A feeding point (feeder) 14 is electrically connected to the one end 132*a*1 of the first linear portion 132*a* such that power is fed to the antenna element 122 through the feeding point 14.

One end of the second linear antenna element 132*b* is joined to the other end 132*a*2 of the first linear portion 132*a* such that the second linear portion 132*b* is arranged to be parallel to the front edge of the roof panel 5. The other end of the second linear portion 132*b* is joined to one end of the third linear portion 132*c*. The third linear portion 132*c* is arranged to be parallel to the first linear portion 132*a*. The other end of the third linear portion 132*c* extends onto the front edge of the roof panel 5 to be electrically connected to a ground point 133. The ground point 133 is mounted on the inner surface of the front edge of the roof panel 5 so as to be grounded thereto.

This configuration of the mobile antenna 131 can obtain substantially the same effects obtained by the mobile antenna 111.

Figure 20A:
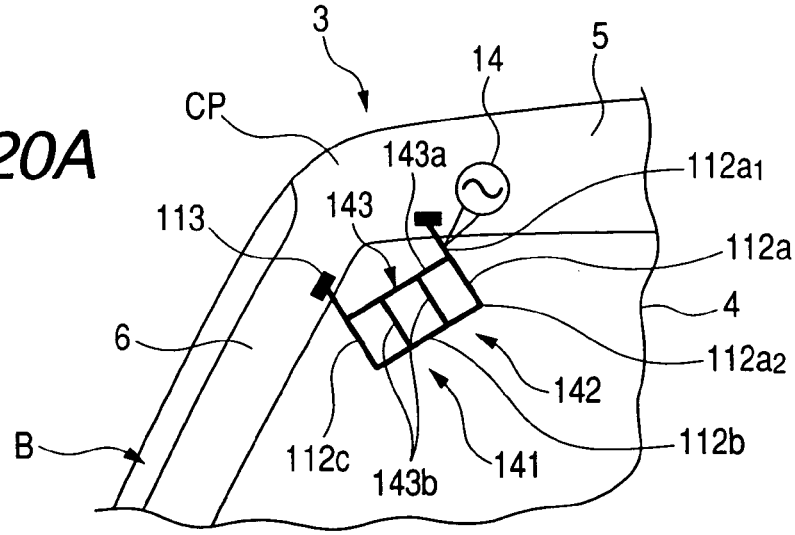
FIG. 20A is a view schematically illustrating a modification of the configuration of the antenna element of the mobile antenna according to the second embodiment.

FIG. 20A illustrates a configuration of an antenna element 142 of a mobile antenna 141; this configuration of the antenna element 142 is a modification of the antenna element 112.

Specifically, the antenna element 142 is provided with the first to third linear portions 112*a* to 112*c*.

In addition, the antenna element 142 has a mesh portion 143.

The mesh portion 143 is composed of a linear portion 143*a* arranged, for example, to be substantially parallel to the second linear portion 112*b*. The linear portion 143*a* is joined between an intermediate portion of the first linear portion 112*a* and that of the third linear portion 112*c*.

The mesh portion 143 is also composed of a plurality of, such as two, bars 143*b*. The bars 143*b* are joined between the second linear portion 112*b* and the linear portion 143*a* to be parallel to the first linear portion 112*a* such that they have intervals along the linear portion 143*a*. Specifically, as illustrated in FIG. 20A, the first to third linear portions 112*a* to 112*c*, the linear portion 143*a*, and the bars 143*b* can provide a plurality of current paths.

Figure 20B:
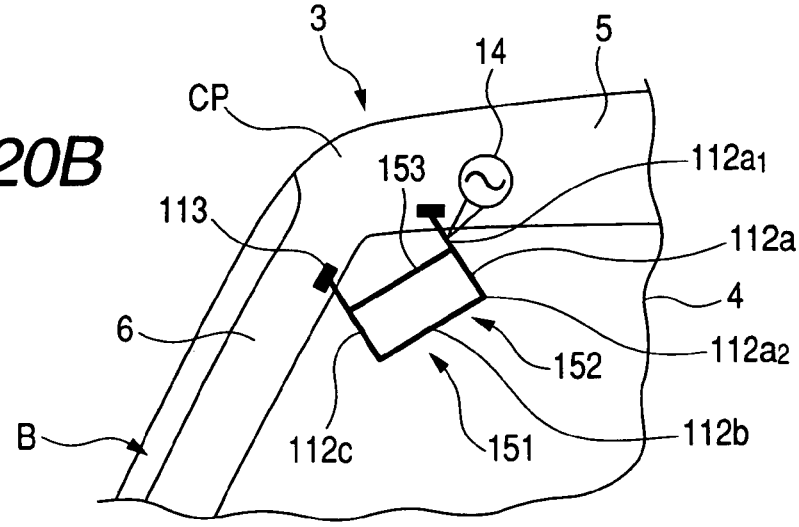
FIG. 20B is a view schematically illustrating another modification of the configuration of the antenna element of the mobile antenna according to the second embodiment.

In addition, as illustrated in FIG. 20B, an antenna element 152 of a mobile antenna 151 can be provided with a bypass portion 153 in place of the mesh portion 143 of the antenna element 142.

The bypass portion 153 is arranged, for example, to be substantially parallel to the second linear portion 112*b*. The bypass portion 153 is joined between an intermediate portion of the first linear portion 112*a* and that of the third linear portion 112*c*.

The first to third linear portions 112*a* to 112*c* and the bypass portion 153 can provide a plurality of current paths whose path lengths are different from each other.

Figure 20C:
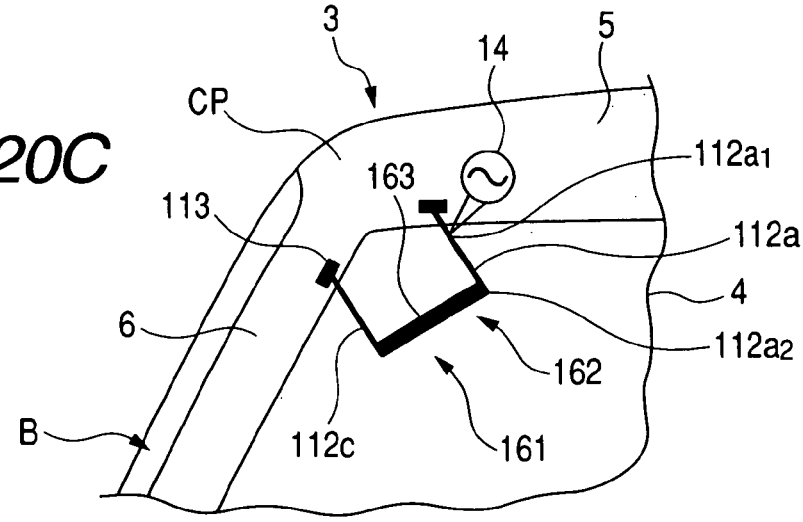
FIG. 20C is a view schematically illustrating a further modification of the configuration of the antenna element of the mobile antenna according to the second embodiment.

Moreover, as illustrated in FIG. 20C, an antenna element 162 of a mobile antenna 161 can be provided with a wide connection bar 163 in place of the second linear portion 112*b* of the antenna element 112.

The wide connection bar 163 has a width wider than that of each of the first and third linear portions 112*a* and 112*c*.

One end of the wide connection bar 163 is joined to the other end 112*a*2 of the first linear portion 112*a* such that the wide connection bar 163 is arranged to be orthogonal to the first linear portion 112*a*. The other end of the wide connection bar 163 is joined to one end of the third linear portion 112*c*.

The first and third linear portions 112*a* and 112*c* and the wide connection bar 163 can provide a plurality of current paths whose path lengths are different from each other.

These different path lengths (antenna lengths) provided by the antenna elements 142, 152, and 162 allow wideband radio waves to be effectively received, respectively.

Figure 21A:
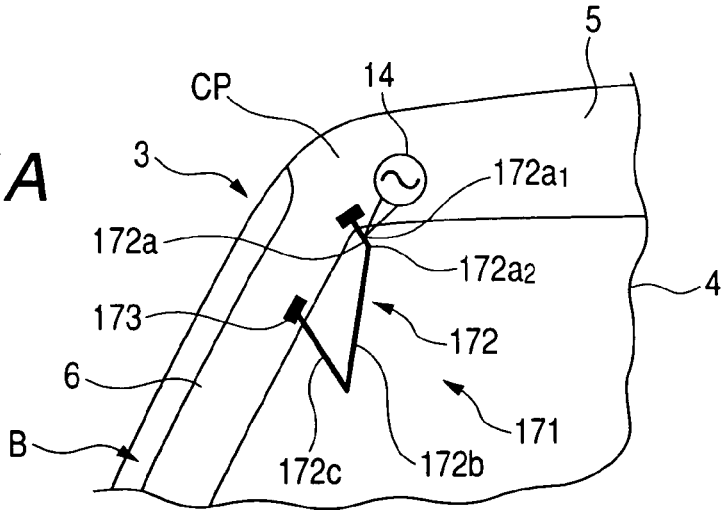
FIG. 21A is a view schematically illustrating a mobile antenna according to a further modification of the second embodiment.

FIG. 21A schematically illustrates a mobile antenna 171 according to a further modification of the second embodiment.

The mobile antenna 171 is provided with an antenna element 172 formed in a loop. The antenna element 172 is located at, for example, the upper-right corner portion 4*b* of the inner surface 4*a* of the front windshield 4.

The antenna element 172 has a first linear portion 172*a*, a second linear portion 172*b*, and a third linear portion 172*c*.

The first linear portion 172*a* has one end 172*a*1 and the other end 172*a*2. The one end 172*a*1 of the first linear portion 172*a* is arranged at least adjacent to the corner portion CP. The first linear portion 172*a* is arranged along the center direction of the corner angle formed by the front edge of the roof panel 5 and the windshield-side edge of the right front pillar 6. A feeding point (feeder) 14 is electrically connected to the one end 172*a*1 of the first linear portion 172*a* such that power is fed to the antenna element 172 through the feeding point 14.

The length of the third linear portion 172*c* is longer than that of the first linear portion 172*a*. One end of the second linear antenna element 172*b* is joined to the other end 172*a*2 of the first linear portion 172*a*. The other end of the second linear portion 172*b* is joined to one end of the third linear portion 172*c*. The third linear portion 172*c* is arranged to be parallel to the first linear portion 172*a*. The other end of the third linear portion 172*c* extends onto the windshield-side edge of the right front pillar 6 to be electrically connected to a ground point 173. The ground point 173 is mounted on the inner surface of the windshield-side edge of the right front pillar 6 so as to be grounded thereto.

Figure 21B:
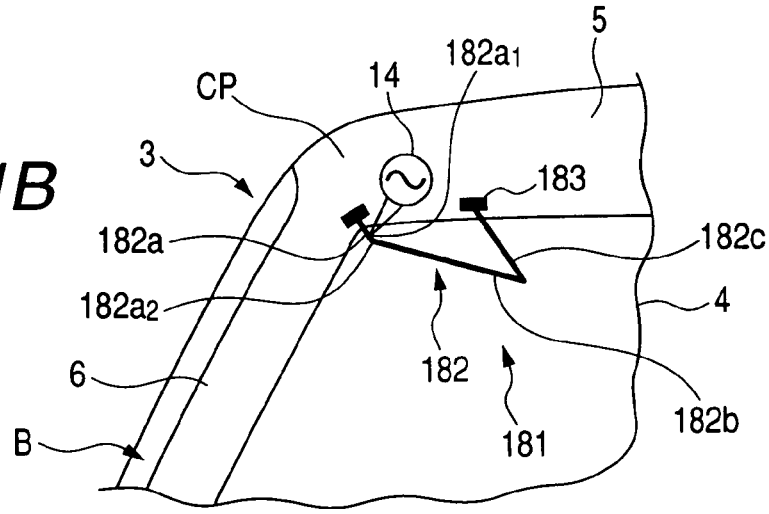
FIG. 21B is a view schematically illustrating a mobile antenna according to a still further modification of the second embodiment.

A still further modification of the mobile antenna 111 according to the second embodiment is illustrated in FIG. 21B. As shown in FIG. 21B, a mobile antenna 181 is provided with an antenna element 182 formed in a loop.

The antenna element 182 has a first linear portion 182*a*, a second linear portion 182*b*, and a third linear portion 182*c*.

The first linear portion 182*a* has one end 182*a*1 and the other end 182*a*2. The one end 182*a*1 of the first linear portion 182*a* is arranged at least adjacent to the corner portion CP. The first linear portion 182*a* is arranged along the center direction of the corner angle formed by the front edge of the roof panel 5 and the windshield-side edge of the right front pillar 6. A feeding point (feeder) 14 is electrically connected to the one end 182*a*1 of the first linear portion 182*a* such that power is fed to the antenna element 182 through the feeding point 14.

The length of the third linear portion 182*c* is longer than that of the first linear portion 182*a*. One end of the second linear antenna element 182*b* is joined to the other end 182*a*2 of the first linear portion 182*a*. The other end of the second linear portion 182*b* is joined to one end of the third linear portion 182*c*. The third linear portion 182*c* is arranged to be parallel to the first linear portion 182*a*. The other end of the third linear portion 182*c* extends onto the front edge of the roof panel 5 to be electrically connected to a ground point 183. The ground point 183 is mounted on the inner surface of the front edge of the roof panel 5 so as to be grounded thereto.

Figure 21C:
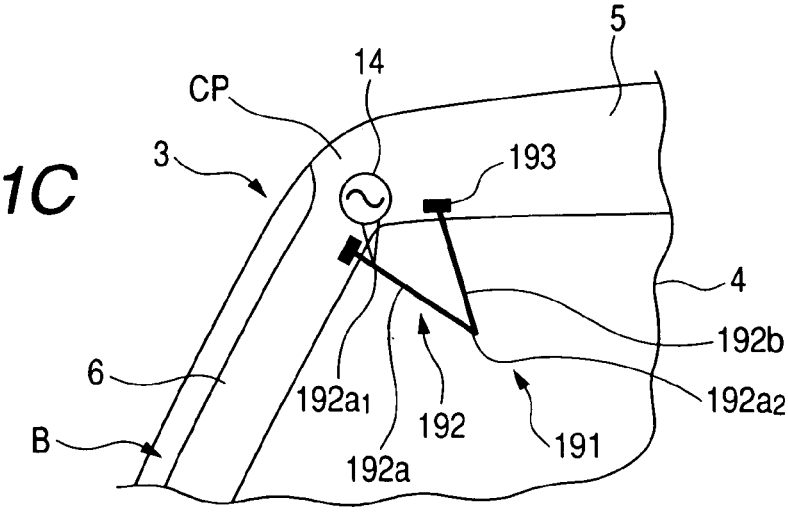
FIG. 21C is a view schematically illustrating a mobile antenna according to a still further modification of the second embodiment.

A still further modification of the mobile antenna 111 according to the second embodiment is illustrated in FIG. 21C. As shown in FIG. 21C, a mobile antenna 191 is provided with an antenna element 192 formed in a loop.

The antenna element 192 has a first linear portion 192*a* and a second linear portion 192*b*.

The first linear portion 192*a* has one end 192*a*1 and the other end 192*a*2. The one end 192*a*1 of the first linear portion 192*a* is mounted on the windshield-side edge of the right front pillar 6. The first linear portion 192*a* is arranged to be directed toward the center of the front windshield 4. A feeding point (feeder) 14 is electrically connected to the one end 192*a*1 of the first linear portion 192*a* such that power is fed to the antenna element 192 through the feeding point 14. One end of the second linear antenna element 192*b* is joined to the other end 192*a*2 of the first linear portion 192*a*. The other end of the second linear portion 192*b* extends onto the front edge of the roof panel 5 to be electrically connected to a ground point 193. The ground point 193 is mounted on the inner surface of the front edge of the roof panel 5 so as to be grounded thereto.

Third Embodiment

A third embodiment of the present invention will be described with reference to FIGS. 22A to 22C. Note that descriptions of elements related to the third embodiment, which are substantially the same as those related to the first and second embodiments, are omitted so that remaining elements related to the third embodiment, which are different from the remaining elements related to the first and second embodiments, will be described.

Figure 22A:
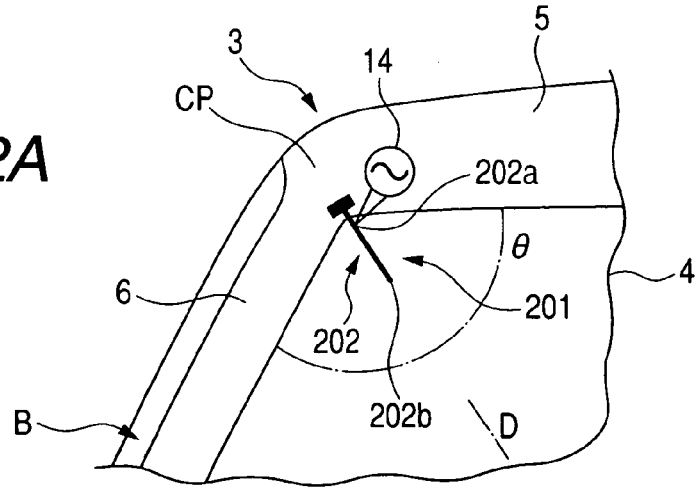
FIG. 22A is a view schematically illustrating a mobile antenna according to a third embodiment of the present invention.

FIG. 22A schematically illustrates a mobile antenna 201 according to a third embodiment of the present invention, which is mounted on the body frame B of the vehicle 3.

The mobile antenna 201 is provided with a linear antenna element 202 with one opening end 202*b*. The linear antenna element 202 is located at, for example, the upper-right corner portion 4*b* of the inner surface 4*a* of the front windshield 4.

The linear antenna element 202 is arranged along the center direction D of the corner angle θ formed by the front edge of the roof panel 5 and the windshield-side edge of the right front pillar 6. A feeding point (feeder) 14 is electrically connected to the other end 202*a* of the linear antenna element 202 such that power is fed to the antenna element 122 through the feeding point 14.

The overall length of the antenna element 202 is designed to $$\left(\frac{\lambda}{4}\right)$$

× the fractional shortening value within the range from 0.7 to 0.8; this λ is a wavelength of target radio waves.

In the structure of the mobile antenna 201, when power fed to the antenna element 201 through the feeding point 14 allows an antenna current to flow through the antenna element 202 from the feeding point 14.

The antenna element 202 is arranged along the center direction D of the corner angle θ, so that it is inclined to the vertical and horizontal directions with respect to the ground surface.

This structure allows, as shown in FIGS. 2A and 2B, polarized surfaces C of the antenna element 202 to be non-orthogonal to each polarized surface A of each vertically polarized wave and each polarized surface B of each horizontally polarized wave in the radio waves, which is similar to the antenna element 2 according to the first embodiment.

Specifically, the mobile antenna 201 can effectively receive vertically and horizontally polarized waves when they are transmitted from the front side of the vehicle 3.

Furthermore, when vertically and horizontally polarized waves are transmitted from the rear side of the vehicle 3, the mobile antenna 201 permits the transmitted vertically polarized waves, which are diffracted by the roof panel 5 to enter into the interior of the vehicle 3, to be effectively received by the antenna element 202. This is because the antenna element 202 is arranged close to the roof panel 5 of the vehicle and each polarized surface C of antenna element 202 is not to be orthogonal but to be crossed, at approximately 45 degrees, to each of the polarized surfaces A of he vertically polarized waves.

In addition, the mobile antenna 201 permits the transmitted horizontally polarized waves, which are diffracted by the right-side of the vehicle to enter into the interior thereof, to be effectively received by the antenna element 202. This is because the antenna element 202 is arranged close to the right-side of the vehicle and each polarized surface of the antenna element 202 is not to be orthogonal but to be crossed, at approximately 45 degrees, to each of the polarized surfaces B of the horizontally polarized waves.

That is, it is possible for the mobile antenna 201 according to the third embodiment to effectively receive both the vertically polarized waves and the horizontally polarized waves transmitted from both the front side of the vehicle and the rear side thereof.

As described above, the mobile antenna 201 allows radio waves to be stably received independently of any direction of the vehicle's travel and/or any direction from which the radio waves are transmitted.

In addition, because the overall length of the antenna element 202 is set to approximately $$\left(\frac{\lambda}{4}\right)\times$$

the fractional shortening value within the range from 0.7 to 0.8. This allows loss caused by the impedance matching in the antenna element 202 to decrease, making it possible to further improve the reception performance of the mobile antenna 201.

Figure 22B:
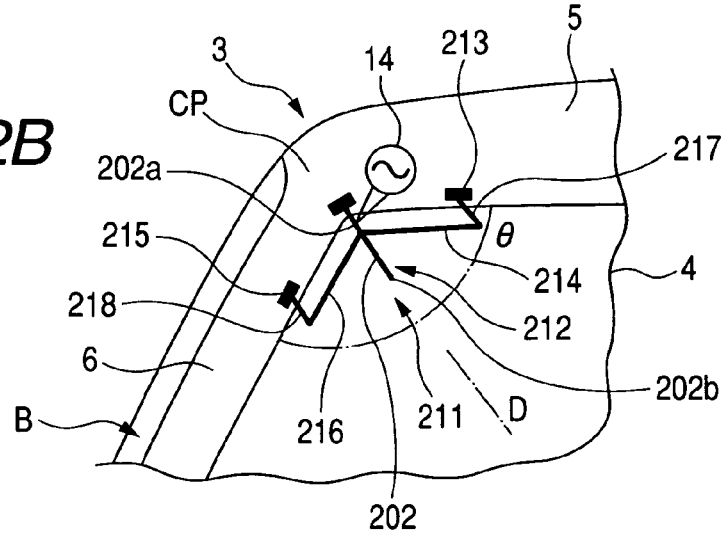
FIG. 22B is a view schematically illustrating a modification of the mobile antenna according to the third embodiment.

A modification of the mobile antenna 201 according to the third embodiment is illustrated in FIG. 22B. As shown in FIG. 22B, a mobile antenna 211 is provided with an antenna element 212 having a linear antenna portion 202 with one opening end 202*b*.

In addition, the antenna element 212 is provided with loop members 214, 216, 217, and 218. The loop member 214 is arranged to be parallel to the front edge of the roof panel 5, one end of which is joined to an intermediate portion of the linear antenna portion 202. The other end of the loop member 214 is joined to one end of the loop member 217, and the other end thereof extends onto the front edge of the roof panel 5 to be electrically connected to a ground point 213. The ground point 213 is mounted on the inner surface of the front edge of the roof panel 5 so as to be grounded thereto.

Moreover, the loop member 216 is arranged to be parallel to the windshield-side edge of the right front pillar 6, one end of which is joined to an intermediate portion of the linear antenna portion 202. The other end of the loop member 216 is joined to one end of the loop member 218, and the other end thereof extends onto the windshield-side edge of the right front pillar 6 to be electrically connected to a ground point 215. The ground point 215 is mounted on the inner surface of the windshield-side edge of the right front pillar 6.

Specifically, the antenna element 212 has a short-circuit configuration.

Figure 22C:
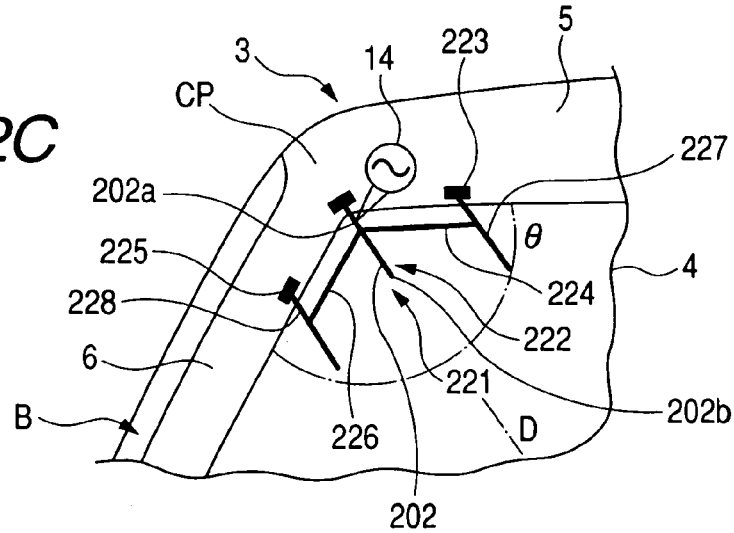
FIG. 22C is a view schematically illustrating another modification of the mobile antenna according to the third embodiment.

A modification of the mobile antenna 201 according to the third embodiment is illustrated in FIG. 22C. As shown in FIG. 22C, a mobile antenna 221 is provided with an antenna element 222 having a linear antenna portion 202 with one opening end 202*b*.

The antenna element 222 is provided with loop members 224, 226, 227, and 228. The configurations of the loop members 224 and 226 are substantially the same as those of the loop members 214 and 216.

The one end of the loop member 227 extends parallel to the antenna portion 202, and the one end of the loop member 228 extends parallel to the antenna portion 202.

Specifically, the antenna element 222 has an open-circuit configuration.

Fourth Embodiment

A mobile antenna 270 according to a fourth embodiment of the present invention will be described hereinafter.

The mobile antenna 270 according to the fourth embodiment is designed to meet different corner angles, such as θ1 and θ2, each formed by, for example, the front edge of the roof panel 6 and, for example, the windshield-side edge of the right front pillar 6 of one of different bodies B1 and B2 of various types of vehicles.

Figure 23A:
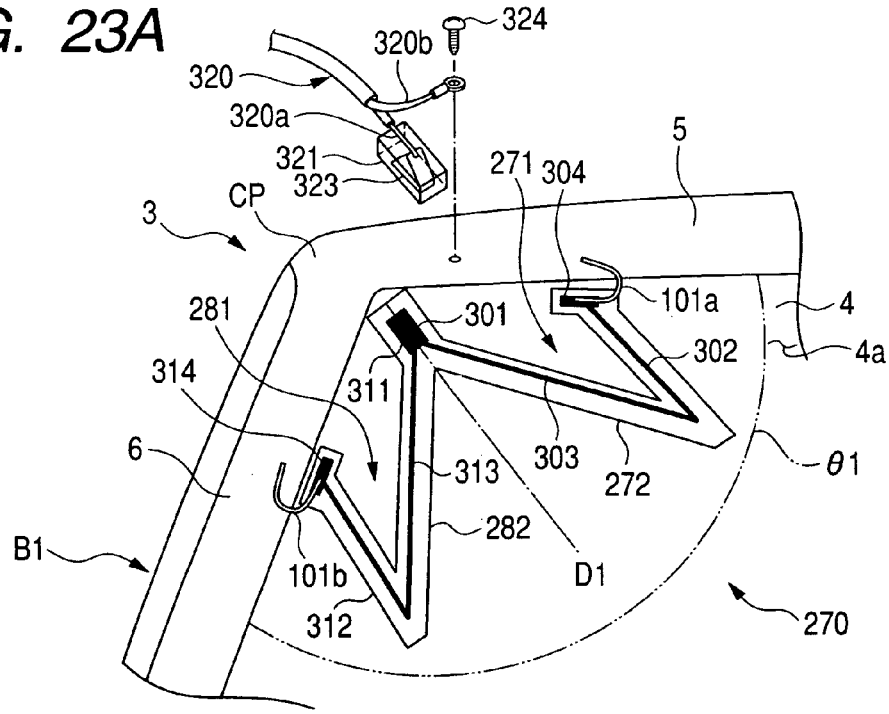
FIG. 23A is a view schematically illustrating a mobile antenna to be applied to one type of vehicles according to a fourth embodiment of the present invention.
Figure 23B:
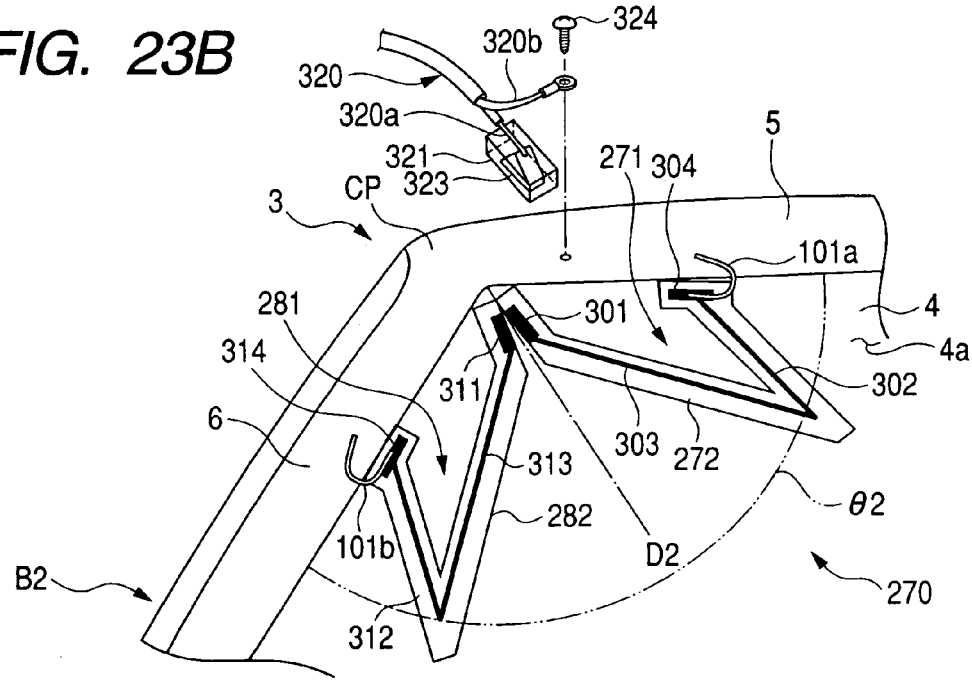
FIG. 23B is a view schematically illustrates the mobile antenna to be applied to another type of vehicles according to the fourth embodiment of the present invention.
Figure 24:
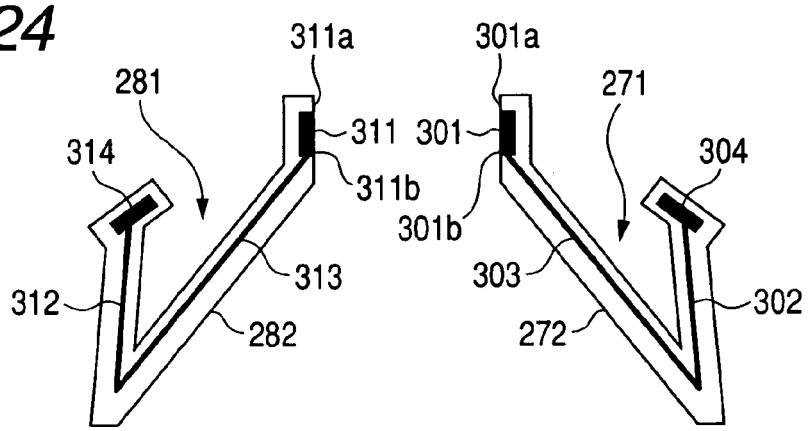
FIG. 24 is a view schematically illustrating first and second antenna elements of the mobile antenna according to the fourth embodiment.

For example, as illustrated in FIGS. 23A, 23B, and 24, the corner angle θ1 formed by the front edge of the roof panel 6 and the windshield-side edge of the right front pillar 6 of the body B1 is smaller than the corner angle θ2 formed by the front edge of the roof panel 6 and the windshield-side edge of the right front pillar 6 of the body B2.

As illustrated in FIGS. 23A, 23B, and 24, the mobile antenna 270 includes a pair of separate first and second antenna elements 271 and 281, and a pair of separate first and second film members 272 and 282 each of which has opposing one and the other surfaces. The first antenna element 271 is adhered onto the one surface of the first film member 272, and the second antenna element 281 is adhered onto the one surface of the second film member 282.

Like the first embodiment, each of the first and second antenna elements 271 and 281 can be produced from any electrically conductive member, such as a wire, a rod, a tube, or the like, and each of the first and second film members 272 and 282 can be made of, for example, a transparent insulation material, such as a transparent resin.

The first second antenna elements 271 and 281 have a folded linear shape symmetrical with each other. The first and second film member 272 and 282 are adhered at its other surface onto, for example, the upper-right corner portion 4*b* of the inner surface 4*a* of the front windshield 4 adjacent to the upper-right corner portion CP such that:

the first and second antenna elements 271 and 281 are arranged symmetrically on the roof-panel side and the right-front pillar side of the center direction D1 or D2, respectively.

Specifically, the first antenna element 271 has a first liner inner portion (first inner trace) 301, a first linear outer portion (first outer trace) 302, a first linear connection portion (first connection trace) 303, and a substantially rectangular first ground portion (first ground trace) 304. In addition, the second antenna element 281 has a second linear inner portion (second inner trace) 311, a second linear outer portion (second outer trace) 312, a second linear connection portion (second connection trace) 313, and a substantially rectangular second ground portion (second ground trace) 314.

The first inner trace 301 serves as a conductive feed trace, and has one end 301*a* and the other end 301*b*. Similarly, the second inner trace 311 serves as a conductive feed trace, and has one end 311*a* and the other end 311*b*.

The first and second inner traces 301 and 311 are disposed symmetrically on the roof-panel side and the right-front pillar side about the center direction D1 or D2, respectively, such that they abut with each other on the center direction D1 or D2.

The one ends 301*a* and 311*a* of the first and second inner traces 301 and 311 are located at least adjacent to the upper-right corner portion CP. A coaxial cable 320 having at its one end with a connector 321 is electrically connected through the connector 321 to the one ends 301*a* and 311*a* of the first and second inner traces 301 and 311, and the other ends 301*b* and 311*b* thereof are located such that they abut with each other on the center direction D1 or D2.

The first and second outer traces 302 and 312 are disposed symmetrically on the roof-panel side and the right-front pillar side of the center direction D1 or D2 and parallel to the corresponding first and second inner traces 301 and 311, respectively. The length of each of the first and second outer traces 302 and 312 is longer than that of a corresponding one of the first and second inner traces 301 and 311.

One end of each of the first and second connection traces 303 and 313 is joined to a corresponding one of the other ends 301*b* and 311*b*. The first and second connection traces 303 and 313 are arranged to be substantially parallel to the front edge of the roof panel 5 and the windshield-side edge of the right front pillar 6, respectively.

The other ends of the first and second connection traces 303 and 313 are joined to one ends of the first and second outer traces 302 and 312, respectively.

The first ground trace 304 is mounted on the roof-panel side edge of the inner surface 4*a* of the windshield grass 4, and the second ground trace 314 is mounted on the right-front pillar side of the inner surface 4*a* thereof.

The other ends of the first and second outer traces 302 and 312 are electrically connected to the first and second ground traces 304 and 314, respectively. The first and second ground traces 304 and 314 are electrically connected to the rood panel 5 and the right front pillar 6 through the first and second grounding wires 101*a* and 101*b*, respectively. This allows the other ends of the first and second outer traces 302 and 312 to be respectively grounded to the roof panel 5 and the right front pillar 6.

Like the antenna element 82 illustrated in FIG. 15A, for example, a folded angle $\alpha$3 formed by the first outer trace 302 and the first connection trace 303 is set to an acute angle (<90 degrees). Similarly, a folded angle $\alpha$4 formed by the second outer trace 312 and the second connection trace 313 is set to an acute angle (<90 degrees).

Like the first embodiment, the length of each of the first and second antenna elements 271 and 281 is so designed with fractional shortening of the wavelength $\lambda$ due to a dielectric constant of the windshield glass 4; this fractional shortening is set to a value within the range from 0.7 to 0.8 that the antenna element 270 can sensitively receive radio waves whose frequencies are within a target frequency range of, for example, 470 to 770 MHz corresponding to UHF band.

The first film member 272 has a folded linear shape similar to the first antenna element 271, and a width wider than that of the first antenna element 271. Similarly, the second film member 282 has a folded linear shape similar to the second antenna element 281, and a width wider than that of the second antenna element 281.

Next, how to adhere, onto, for example, the upper-right corner portion 4*b* of the inner surface 4*a* of the front windshield 4 adjacent to the upper-right corner portion CP, the first film member 272 attached as its one surface with the first antenna element 271 and the second film member 282 attached at its one surface with the second antenna element 272 will be described hereinafter.

First, let us describe how to adhere the first film member 272 and the second film member 282 onto the upper-right corner portion 4*b* of the inner surface 4*a* of the front windshield 4 of the vehicle body B1 illustrated in FIG. 23A.

The first and second film members 272 and 282 are located on the upper-right corner portion 4*b* of the inner surface 4*a* of the front windshield 4 such that:

the first and second inner traces 301 and 311 are disposed symmetrically on the roof-panel side and the right-front pillar side of the center direction D1, respectively;

the first and second inner traces 301 and 311 abut with each other on the center direction D1;

the first ground trace 304 is disposed to keep a predetermined first interval W1 between the one and the front edge of the roof panel 5; and the second ground trace 314 is disposed to keep a predetermined second interval between the one and the windshield-side edge of the right front pillar 6.

As illustrated in FIG. 25C, the first interval W1 is, for example, defined as a normal line connecting between the center of one side of the first ground trace 304 facing the roof panel 5 and the front edge thereof. The first interval W1 is determined to allow the first ground trace 304 and the roof panel 5 to be electrically matched with each other, such as impedance matched with each other.

the second interval W2 is, for example, defined as a normal line connecting between the center of one side of the second ground trace 314 facing the right front pillar 6 and the windshield-side edge thereof. The second interval W2 is determined to allow the second ground trace 314 and the right front pillar 6 to be electrically matched with each other, such as impedance matched with each other.

While the first and second film members 272 and 282 are located on the upper-right corner portion 4*b* of the inner surface 4*a* in such a state, they are adhered onto the upper-right corner portion 4*b* of the inner surface 4*a*.

Next, let us describe how to adhere the first film member 272 and the second film member 282 onto the upper-right corner portion 4*b* of the inner surface 4*a* of the front windshield 4 of the vehicle body B2 illustrated in FIG. 23B.

The first and second film members 272 and 282 are located on the upper-right corner portion 4*b* of the inner surface 4*a* of the front windshield 4 such that the first and second inner traces 301 and 311 are disposed symmetrically on the roof-panel side and the right-front pillar side of the center direction D1, respectively;

the other ends 301*b* and 311*b* of the first and second inner traces 301 and 311 are spaced from each other;

the first ground trace 304 is disposed to keep the first interval W1 between the one and the front edge of the roof panel 5; and the second ground trace 314 is disposed to keep the second interval W2 between the one and the windshield-side edge of the right front pillar 6.

While the first and second film members 272 and 282 are located on the upper-right corner portion 4*b* of the inner surface 4*a* of the front windshield 4 in such a state, they are adhered onto the upper-right corner portion 4*b* of the inner surface 4*a* thereof.

Specifically, as a result of comparison between both the film antenna adhering methods against the vehicle bodies B1 and B2, the first and second film members 272 and 282 are adhered onto the upper-right corner portion 4*b* of the inner surface 4*a* so that:

the first interval W1 and the second interval W2 are individually constant independently of the size of the corner angle.

In other words, adjustment of the interval between the other ends 301*b* and 311*b* of the first and second inner traces 301 and 311 depending on the size of the corner angle allows the first interval W1 and second interval W2 to be constant.

Figure 25:
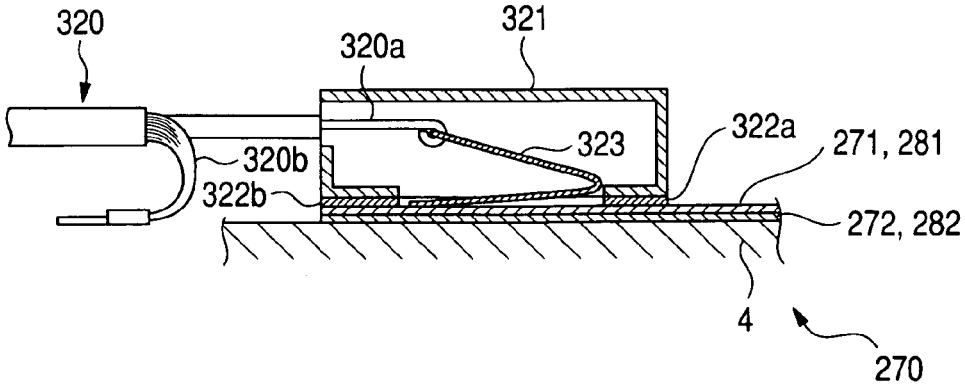
FIG. 25 is a cross sectional view schematically illustrating an example of connection between a coaxial cable and the first and second antenna elements using a connector according to the fourth embodiment.

After the attachment of the first and second film members 272 and 282 onto the upper-right corner portion 4*b* of the front windshield 4, the connector 321 of the coaxial cable 320 is adhered onto both the first and second antenna elements 271 and 281 with, for example, adhesive tapes 322*a* and 322*b* (see FIG. 25).

The attachment of the connector 321 of the coaxial cable 320 onto both the first and second antenna elements 271 and 281 permits:

a feeding terminal 323 composed of, for example, a conductive spring, electrically connected to an inner conductor 320*a* of the coaxial cable 320 to be electrically connected to both the first and second antenna elements 271 and 281; and an outer conductor 320*b* of the coaxial cable 320 to be electrically connected to a given ground point on, for example, the roof panel 5 of the vehicle body B1/B2 with a conductive screw 324.

As well as the first embodiment, the mobile antenna 270 according to the forth embodiment is disposed at the corner portion 4*b* of the inner surface 4*a* of the front windshield 4 to be substantially arranged along the center direction D1/D2 of the corner angle θ1/θ2.

This configuration of the mobile antenna 270 allows:

polarized surfaces of the first and second antenna elements 271 and 281 to be non-orthogonal to each polarized surface of vertically polarized waves and each polarized surface of horizontally polarized waves in the radio waves for the same reason as the first embodiment; and vertically and horizontally polarized waves to be effectively received when they are transmitted from the front side and/or rear side of the vehicle.

Particularly, in the mobile antenna 270, the separate first and second film members 272 and 282 onto which the first and second antenna elements 271 and 281 are respectively mounted are individually adhered onto the corner portion 4*b* of the inner surface 4*a* of the front windshield 4 of the vehicle body B1/B2 such that:

the first and second antenna elements 271 and 281 are arranged symmetrically about the center line D1/D2 of the corner angle θ1/θ2 of the corner portion CP of the vehicle body B1/B2.

Accordingly, when the first and second film members 272 and 282 are adhered onto the corner portion 4*b* of the inner surface 4*a* of the front windshield 4 of the vehicle body B1/B2, adjustment of the interval between the other ends 301*b* and 311*b* of the first and second inner traces 301 and 311 depending on the size of the corner angle can keep the first and second intervals W1 and W2 constant even if the size of the corner angle is changed depending on the change of vehicle types.

The constantly maintained first interval W1 allows the first ground trace 304 and the roof panel 5 to be electrically matched with each other, and the constantly maintained second interval W2 allows the second ground trace 314 and the windshield-side edge of the right front pillar 6 to be electrically matched with each other.

Moreover, the first and second film members 272 and 282 can be individually adhered onto the corner portion 4*b* of the inner surface 4*a* of the front windshield 4 of the vehicle body B1/B2, making it possible to improve the workability of mounting the film antenna 270 onto the vehicle body.

The feeding terminal 323 of the coaxial cable 320 for power supply can be electrically connected to both the first and second antenna elements 271 and 281, making it possible to easily supply power to both the first and second antenna elements 271 and 281

Fifth Embodiment

A mobile antenna according to a fifth embodiment of the present invention will be described with reference to FIGS. 26 to 28. Note that descriptions of elements related to the mobile antenna according to the fifth embodiment, which are substantially identical to those related to the mobile antenna according to the fourth embodiment, are omitted, and identical reference characters are assigned to substantially identical elements of the mobile antennas according to the fourth and fifth embodiments. The remaining elements related to the antenna element according to the fifth embodiment, which are different from those related to that according to the fourth embodiment, will be therefore mainly described.

In the fifth embodiment, a needle conductive screw 360 is so mounted on the corner portion 4*b* of the inner surface 4*a* of the front windshield 4 of the vehicle body B1/B2 as to project in a direction orthogonal to the inner surface 4*a* of the front windshield 4.

Figure 26A:
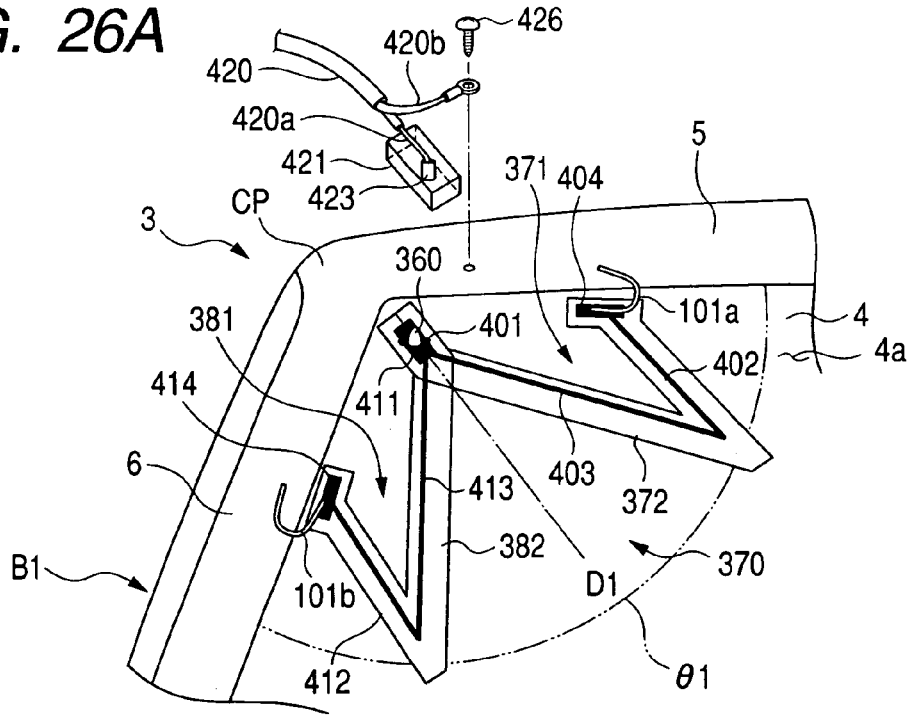
FIG. 26A is a view schematically illustrating a mobile antenna to be applied to one type of vehicles according to a fifth embodiment of the present invention.
Figure 26B:
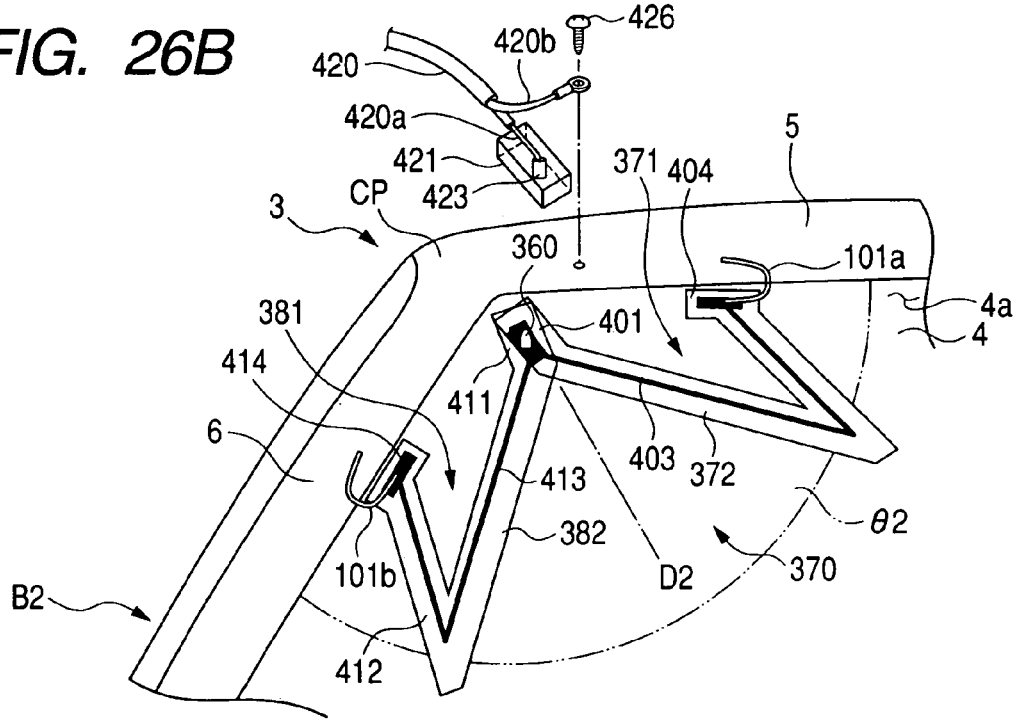
FIG. 26B is a view schematically illustrates the mobile antenna to be applied to another type of vehicles according to the fifth embodiment of the present invention.
Figure 27:
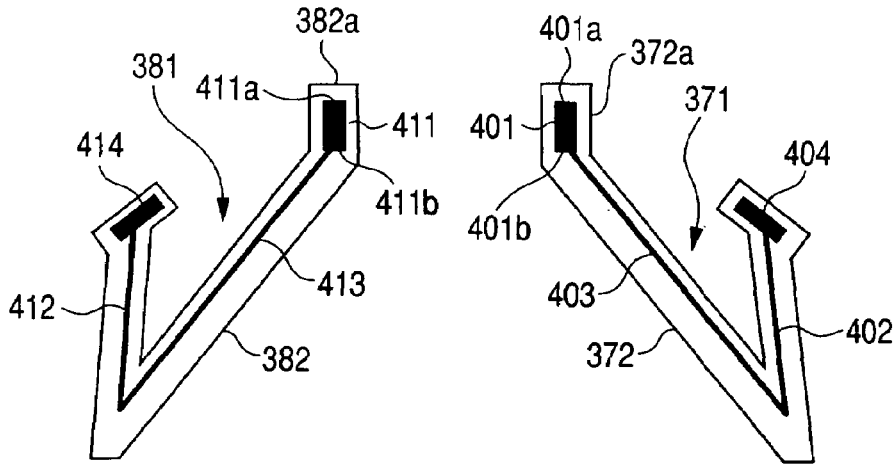
FIG. 27 is a view schematically illustrating first and second antenna elements of the mobile antenna according to the fifth embodiment.

As illustrated in FIGS. 26A, 26B, and 27, the mobile antenna 370 includes a pair of separate first and second antenna elements 371 and 381, and a pair of separate first and second film members 372 and 382 each of which has opposing one and the other surfaces. The first antenna element 371 is adhered onto the one surface of the first film member 372, and the second antenna element 381 is adhered onto the one surface of the second film member 382.

As in the case of the fourth embodiment, each of the first and second antenna elements 371 and 381 can be produced from any electrically conductive member, such as a wire, a rod, a tube, or the like, and each of the first and second film members 372 and 382 can be made of, for example, a transparent insulation material, such as a transparent resin.

The first second antenna elements 371 and 381 have a folded linear shape symmetrical with each other. The first and second film member 372 and 382 are adhered at its other surface onto the upper-right corner portion 4*b* of the inner surface 4*a* of the front windshield 4 adjacent to the upper-right corner portion CP such that:

the first and second antenna elements 371 and 381 are arranged symmetrically on the roof-panel side and the right-front pillar side of the center direction D1 or D2, respectively;

one end 372*a* of the first film member 372, a corresponding one end of the first antenna element 371, a corresponding one end 382*a* of the second film member 382, and a corresponding one end of the second antenna element 381 are laminated (overlapped) with each other on the conductive screw 360 of the upper-right corner portion 4*b*. This allows the conductive screw 360 to penetrate through the laminated members 372*a*, 371, 382*a*, and 381.

The first antenna element 371 has a first inner trace 401, a first outer trace 402, a first connection trace 403, and a first ground trace 404. In addition, the second antenna element 381 has a second inner trace 411, a second outer trace 412, a second connection trace 413, and a second ground trace 414

The first inner trace 401 has one end 401*a* and the other end 401*b*, and the second inner trace 411 has one end 411*a* and the other end 411*b*.

The first and second inner traces 401 and 411 are disposed symmetrically on the roof-panel side and the right-front pillar side about the center direction D1 or D2, respectively. In other words, the first and second inner traces 401 and 411 correspond to the laminated one ends of the first and second antenna elements 371 and 381.

The one ends 401*a* and 411*a* of the first and second inner traces 401 and 411 are located at least adjacent to the upper-right corner portion CP. A coaxial cable 420 having at its one end with a connector 421 is electrically connected through the connector 421 to the one ends 401*a* and 411*a* of the first and second inner traces 401 and 411, and the other ends 401*b* and 411*b* thereof are located such that they are overlapped with each other on the center direction D1 or D2.

The structure and arrangement of the first and second outer traces 402 and 412 are substantially identical to those of the first and second outer traces 302 and 402, respectively, and therefore the descriptions of the structure and arrangement of each of the first and second outer traces 402 and 412 are omitted.

Similarly, the structure and arrangement of each of the first and second connection traces 403 and 413 are substantially identical to those of a corresponding one of the first and second connection traces 303 and 313, respectively, and therefore the descriptions of the structure and arrangement of each of the first and second outer traces 402 and 412 are omitted.

The first ground trace 404 is mounted on the roof-panel side edge of the inner surface 4*a* of the windshield grass 4, and the second ground trace 414 is mounted on the right-front pillar side of the inner surface 4*a* thereof.

One ends of the first and second outer traces 402 and 412 are connected to the first and second connection traces 403 and 413, respectively, and the other ends thereof are electrically connected to the first and second ground traces 404 and 414, respectively.

The first and second ground traces 404 and 414 are electrically connected to the rood panel 5 and the right front pillar 6 through the first and second grounding wires 101*a* and 101*b* so that the other ends of the first and second outer traces 402 and 412 are respectively grounded to the roof panel 5 and the right front pillar 6.

The first film member 372 has a folded linear shape similar to the first antenna element 371, and a width wider than that of the first antenna element 371. Similarly, the second film member 382 has a folded linear shape similar to the second antenna element 381, and a width wider than that of the second antenna element 381.

Figure 23C:
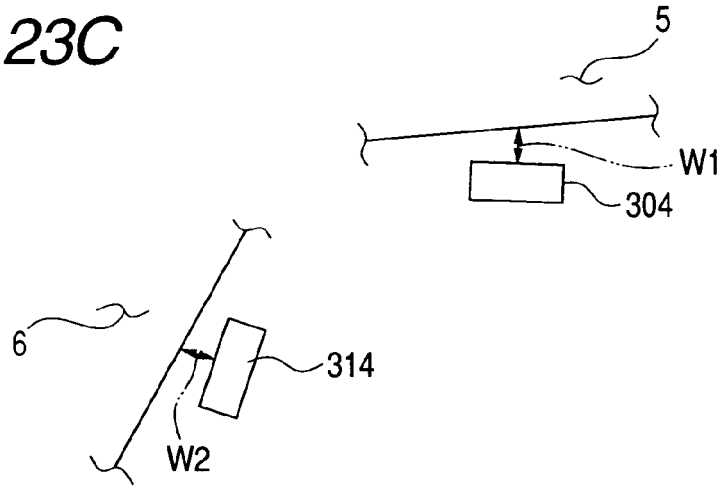
FIG. 23C is schematic view showing the location of ground traces on a windshield according to the fourth embodiment.

As in the case of the fourth embodiment, when the first and second film member 372 and 382 are adhered onto the upper-right corner portion 4*b* of the inner surface 4*a* of the front windshield 4 of the vehicle body B1 illustrated in FIG. 23A, the first and second film members 372 and 382 are located on the upper-right corner portion 4*b* of the inner surface 4*a* of the front windshield 4 such that:

the one end 372*a* of the first film member 372, the first inner trace 401, the one end 382*a* of the second film member 382, and the second inner trace 411 are laminated with each other on the conductive screw 360 of the upper-right corner portion 4*b;* the conductive screw 360 penetrates through the laminated members 372*a*, 371, 382*a*, and 382;

the pair of the first outer trace 402 and the first connection trace 403 and the pair of the second outer trace 402 and the second connection trace 413 are disposed symmetrically on the roof-panel side and the right-front pillar side of the center direction D1, respectively;

the first ground trace 404 is disposed to keep the first interval W1 (see FIG. 23C) between the one and the front edge of the roof panel 5; and the second ground trace 414 is disposed to keep the second interval W2 (see FIG. 23C) between the one and the windshield-side edge of the right front pillar 6.

While the first and second film members 372 and 382 are located on the upper-right corner portion 4*b* of the inner surface 4*a* in such a state, they are adhered onto the upper-right corner portion 4*b* of the inner surface 4*a*.

On the other hand, when the first and second film member 372 and 382 are adhered onto the upper-right corner portion 4*b* of the inner surface 4*a* of the front windshield 4 of the vehicle body B2 illustrated in FIG. 23B, the first and second film members 372 and 382 are located on the upper-right corner portion 4*b* of the inner surface 4*a* of the front windshield 4 such that:

the one end 372*a* of the first film member 372, the first inner trace 401, the one end 382*a* of the second film member 382, and the second inner trace 411 are laminated in this order on the conductive screw 360 of the upper-right corner portion 4*b;* the conductive screw 360 penetrates through the laminated members 372*a*, 371, 382*a*, and 382;

the pair of the first outer trace 402 and the first connection trace 403 and the pair of the second outer trace 402 and the second connection trace 413 are disposed symmetrically on the roof-panel side and the right-front pillar side of the center direction D2, respectively;

the first ground trace 404 is disposed to keep the first interval W1 between the one and the front edge of the roof panel 5; and the second ground trace 414 is disposed to keep the second interval W2 between the one and the windshield-side edge of the right front pillar 6.

While the first and second film members 372 and 382 are located on the upper-right corner portion 4*b* of the inner surface 4*a* of the front windshield 4 in such a state, they are adhered onto the upper-right corner portion 4*b* of the inner surface 4*a* thereof.

Specifically, as a result of comparison between both the film antenna adhering methods against the vehicle bodies B1 and B2, the first and second film members 372 and 382 are adhered onto the upper-right corner portion 4*b* of the inner surface 4*a* so that:

the first interval W1 and the second interval W2 are individually constant independently of the size of the laminated area between first and second inner traces 401 and 411 and between the one ends 372*a* and 382*a* of the first and second film members 372 and 382.

In other words, adjustment of the size of the laminated area between first and second inner traces 401 and 411 and/or between the one ends 372*a* and 382*a* of the first and second film members 372 and 382 depending on the size of the corner angle allows the first interval W1 and the second interval W2 to be constant.

Figure 28:
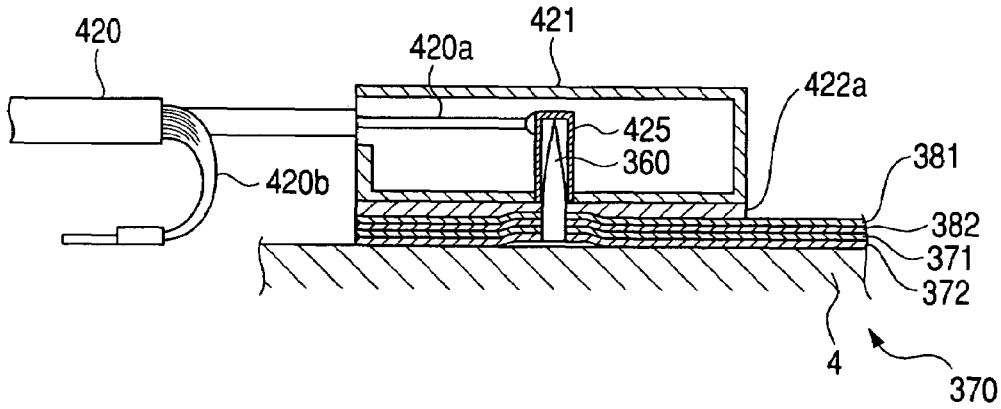
FIG. 28 is a cross sectional view schematically illustrating an example of connection between a coaxial cable and the first and second antenna elements using a connector according to the fifth embodiment.

After the attachment of the first and second film members 372 and 382 onto the upper-right corner portion 4*b* of the front windshield 4, the connector 421 of the coaxial cable 420 is adhered onto the second antenna element 381 with, for example, an adhesive tape 422*a* (see FIG. 28).

The attachment of the connector 421 of the coaxial cable 420 onto the second antenna element 381 permits:

the conductive screw 360 to be fitted into a feeding terminal 425, which is composed of, for example, a cylindrical conductive member, of an inner conductor 420*a* of the coaxial cable 420 so that the inner conductor 420*a* is electrically connected to both the first and second antenna elements 371 and 381; and an outer conductor 420*b* of the coaxial cable 420 to be electrically connected to a given ground point on, for example, the roof panel 5 of the vehicle body B1/B2 with a conductive screw 426, As well as the first embodiment, the mobile antenna 370 according to the fifth embodiment is disposed at the corner portion 4*b* of the inner surface 4*a* of the front windshield 4 to be substantially arranged along the center direction D1/D2 of the corner angle θ1/θ2.

This configuration of the mobile antenna 370 allows:

polarized surfaces of the first and second antenna elements 371 and 381 to be non-orthogonal to each polarized surface of vertically polarized waves and each polarized surface of horizontally polarized waves in the radio waves for the same reason as the first embodiment; and vertically and horizontally polarized waves to be effectively received when they are transmitted from the front side and/or rear side of the vehicle.

Particularly, in the mobile antenna 370, the separate first and second film members 372 and 382 onto which the first and second antenna elements 371 and 381 are respectively mounted are individually adhered onto the corner portion 4*b* of the inner surface 4*a* of the front windshield 4 of the vehicle body B1/B2 such that:

the first and second antenna elements 371 and 381 are arranged to be laminated at their first and second inner traces 401 and 411 with each other on the center line D1/D2 of the corner angle θ1/θ2 of the corner portion CP of the vehicle body B1/B2.

Accordingly, when the first and second film members 372 and 382 are adhered onto the corner portion 4*b* of the inner surface 4*a* of the front windshield 4 of the vehicle body B1/B2, adjustment of the size of the laminated area between the first and second inner traces 401 and 411 depending on the size of the corner angle can keep the first and second intervals W1 and W2 constant even if the size of the corner angle is changed depending on the change of vehicle types.

The constantly maintained first interval W1 allows the first ground trace 404 and the roof panel 5 to be electrically matched with each other, and the constantly maintained second interval W2 allows the second ground trace 414 and the windshield-side edge of the right front pillar 6 to be electrically matched with each other.

Moreover, the first and second film members 372 and 382 can be individually adhered onto the corner portion 4*b* of the inner surface 4*a* of the front windshield 4 of the vehicle body B1/B2, making it possible to improve the workability of mounting the film antenna 370 onto the vehicle body.

Sixth Embodiment

Figure 29:
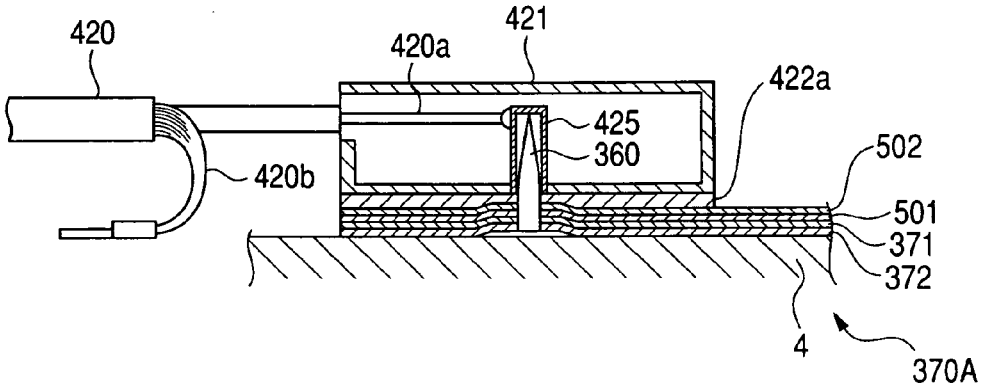
FIG. 29 is a cross sectional view schematically illustrating an example of connection between a coaxial cable and first and second antenna elements using a connector according to a sixth embodiment of the present invention.

A mobile antenna according to a sixth embodiment of the present invention will be described with reference to FIG. 29. Note that descriptions of elements related to the mobile antenna according to the sixth embodiment, which are substantially identical to those related to the mobile antenna according to the fifth embodiment, are omitted. Identical reference characters are assigned to substantially identical elements of the mobile antennas according to the fifth and sixth embodiments. The remaining elements related to the antenna element according to the sixth embodiment, which are different from those related to that according to the fifth embodiment, will be therefore mainly described.

The mobile antenna 370A according to the seventh embodiment includes a pair of separate first and second antenna elements 371 and 501, and a pair of separate first and second film members 372 and 502 each of which has opposing one and the other surfaces.

The first antenna element 371 is adhered onto the one surface of the first film member 372, and the second antenna element 501 is adhered onto the one surface of the second film member 502.

The first film member 372 is adhered at its other surface onto the upper-right corner portion 4*b* of the inner surface 4*a* of the front windshield 4 adjacent to the upper-right corner portion CP.

In contrast, in the seventh embodiment, the second film member 502 is adhered at its one surface onto the upper-right corner portion 4*b* of the inner surface 4*a* of the front windshield 4 adjacent to the upper-right corner portion CP such that:

the first and second antenna elements 371 and 501 are arranged symmetrically on the respective roof-panel side and the right-front pillar side of the center direction D1 or D2; and one end of the first film member 372, a corresponding one end of the first antenna element 371, a corresponding one end of the second antenna element 501, and a corresponding one end of the second film member 502 are laminated in this order on the conductive screw 360 of the upper-right corner portion 4*b*. This allows the conductive screw 360 to penetrate through the laminated members 372, 371, 501, and 502.

In the configuration of the mobile antenna 370A according to the seventh embodiment, as illustrated in FIG. 28, the first antenna element 501 and the second antenna element 371 are directly contacted to each other to establish electrical continuity therebetween.

In addition, the conductive screw 360 is fitted into the feeding terminal 425 of the inner conductor 420*a* of the coaxial cable 420 so that the inner conductor 420*a* is electrically connected to both the first and second antenna elements 371 and 381.

As described above, in the mobile antenna 370A according to the sit embodiment, while the first film member 372 and the second film member 502 are adhered onto the upper-right corner portion 4*b* of the inner surface 4*a* of the front windshield 4, the first antenna element 371 and the second antenna element 501 are directly contacted to each other. This makes it possible to properly ensure electrical continuity between the first antenna element 371 and the second antenna element 501.

In the first embodiment of the present invention, the inner portion 7, the connection portion 10, the outer portion 8, the connection portion 11, and the outer portion 9 provide two current paths (loops), but the present invention is not limited to the structure. Specifically, an antenna element of a mobile antenna can be configured to provide three or more current loops.

At least two of a plurality of the mobile antennas according to the second to sixth embodiments and their modifications can be mounted on the body frame B (B1, B2) such that they are substantially symmetrically arranged in the space of the body frame B (B1, B2). This structure provides space diversity that can achieve space diversity effect Moreover, at least two of a plurality of the mobile antennas according to the second to sixth embodiments and their modifications can be mounted on the body frame B (B1, B2) such that directions in which antenna current components flow through the at least two antennas are different from each other. This structure can provide different polarized surfaces, making it possible to achieve polarization-diversity effect.

Figure 30:
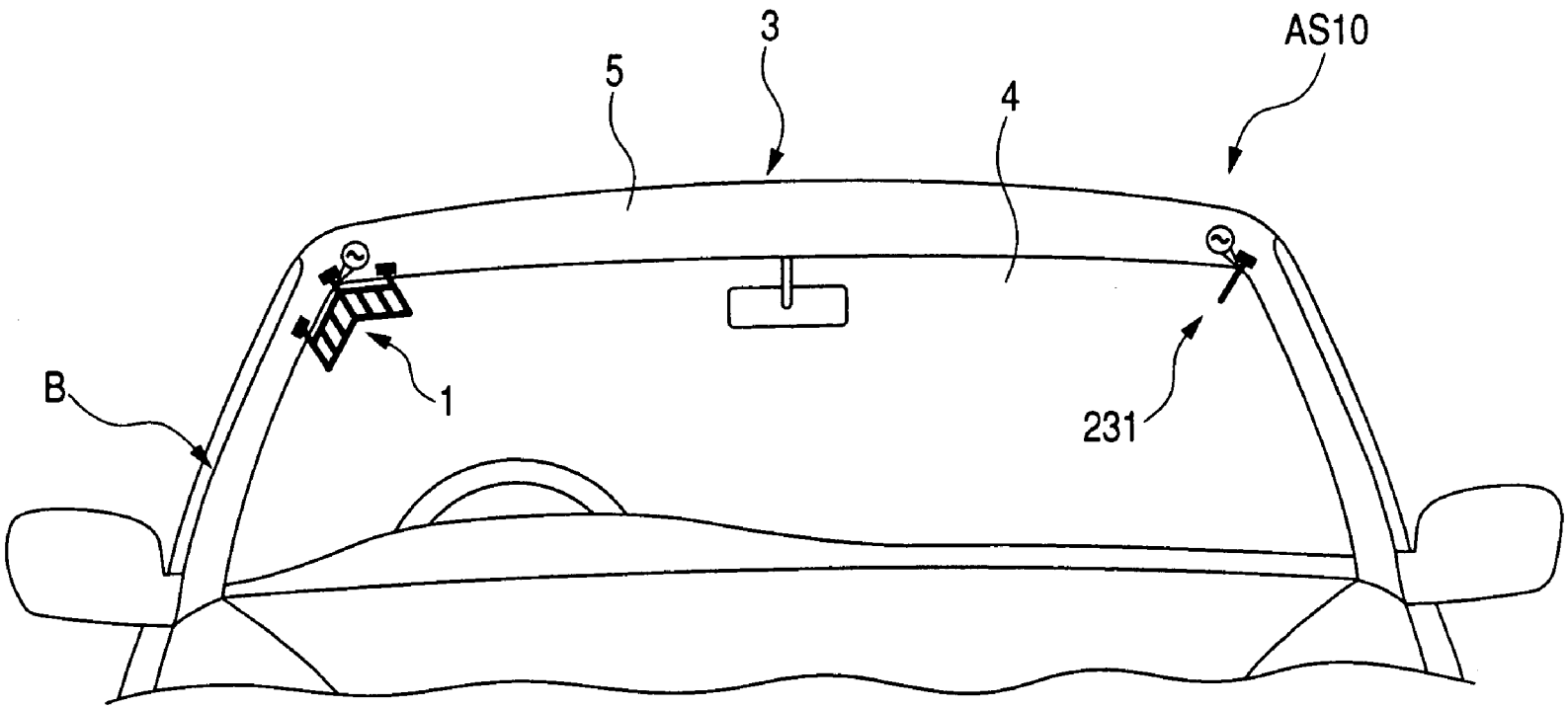
FIG. 30 is a view schematically illustrating an antenna system according to a modification of the present invention.

Furthermore, as illustrated in FIG. 30, an antenna system AS10 can be mounted on the body frame B of the vehicle 3. The antenna system AS10 is provided with the mobile antenna 1 according to the first embodiment, which is mounted at the upper-right corner portion 4*b* of the inner surface 4*a* of the front windshield 4.

In addition, the antenna system AS10 is provided with the mobile antenna 231 symmetrically placed in the vehicle 3 with respect to the mobile antenna 1 in the horizontal (lateral) direction of the vehicle 3.

Moreover, as illustrated in FIG. 14C, an antenna element 82 of a mobile antenna 81 can be provided with wide connection bars in place of the connection portions 66 and 67.

Each of the wide connection bars has a width wider than that of each of the inner portion 63 and the outer portions 64 and 65.

The inner portion 63, the outer portions 64 and 65, and the wide connection bars can provide a plurality of current paths whose path lengths are different from each other.

In the third embodiment, the linear antenna element 202 has a wide width portion whose width is wider than that of the remaining portion of the linear antenna element 202 (see FIG. 20C).

In the third embodiment and its modifications, the linear antenna element (portion) 202 can extend in a curved line along the center direction D of the corner angle θ.

In the fourth to sixth embodiments, each of the mobile antennas 270, 370, and 370A are designed to have a loop type configuration, but can be designed to have an open type configuration, such as one of the configurations illustrated in FIGS. 22A to 22C.

In the fourth to sixth embodiments, the first and second ground traces 304 and 314 are electrically connected to the rood panel 5 and the right front pillar 6 through the first and second grounding wires 101*a* and 101*b*. The present invention is however not limited to the structure. Specifically, the first and second ground traces 304 and 314 are electrically connected to the rood panel 5 and the right front pillar 6 by capacitive coupling without using the ground wires 101*a* and 101*b*.

The mobile antennas according to the fourth to sixth embodiments can be designed to have any one of various configurations of the mobile antennas according to the first to third embodiments and their modifications.

The mobile antennas according to the first to sixth embodiments are preferably applicable to radio antennas, GPS antennas, antennas for VICS (Vehicle Information and Communication System), ETC (Electronic toll collection system) antennas, and other antennas of various uses While there has been described what is at present considered to be these embodiments and modifications of the present invention, it will be understood that various modifications which are not described yet may be made therein, and it is intended to cover in the appended claims all such modifications as fall within the true spirit and scope of the invention.

What is claimed is:

1. A mobile antenna mounted on an electrically conductive body of a vehicle, in which the body of the vehicle has a first support portion extending substantially parallel to the around on which the vehicle is to be disposed, a second support portion extending substantially orthogonal to the ground, a corner portion at which the first support portion and the second support portion meet, the first support portion, the second support portion, and the corner portion support at least corner portion of a window of the vehicle, the mobile antenna comprising an electrically conductive antenna element having a first portion with one end and the other end extending therefrom, the one end of the first portion being arranged at least adjacent to any one of the first support portion, the second support portion, and the corner portion and being electrically connected to a feeding point, the other end of the first portion being arranged along a surface of the window such that polarized surfaces formed by the antenna element are non-orthogonal to a polarized surface of each of a vertically polarized wave and a horizontally polarized wave in radio waves, wherein the first support portion is a roof portion of the vehicle body, and the second support portion is a pillar portion of the vehicle body.

2. A mobile antenna according to claim 1, wherein the antenna element includes a second portion with one end joined to the first portion to form a first loop, and the other end of the second portion is grounded to any one of the first support portion, the second support portion, and the corner portion.

3. A mobile antenna according to claim 2, wherein the antenna element includes a third portion with one end joined to the first portion to form a second loop, the other end of the third portion is grounded to another one of the first support portion, the second support portion, and the corner portion.

4. A mobile antenna according to claim 2, wherein the antenna element includes a plural-pat forming portion configured to allow the first portion, the second portion, and the plural-path forming portion to form a plurality of current paths.

5. A mobile antenna according to claim 4, wherein the plural-path forming portion has any one of:

a mesh structure composed of a plurality of loops, the loops being contained in the current paths; and a bypass structure joined between the first portion and the second portion.

6. A mobile antenna according to claim 4, wherein the second portion has a connection bar such that the one end of the second portion is joined to the first portion through the connection bar, and the connection bar has a width wider than that of each of the first portion and the second portion, the connection bar allowing the current pats to be formed therethrough.

7. A mobile antenna according to claim 2, wherein a first angle formed by the second portion and a window-side edge of any one of the first support portion, the second support portion, and the corner portion to which the other end is wounded is set to any one of a right angle and an obtuse angle so that capacity coupling occurs between the second portion and the window-side edge of any one of the first support portion, the second support portion, and the corner portion.

8. A mobile antenna according to claim 2, wherein a second angle formed by the first portion and the second portion is set to an acute angle so that capacity coupling occurs between the first and second portions.

9. A mobile antenna according to claim 1, wherein the window is made of glass, and an overall length of the antenna element is set to a length obtained by multiplying $$\left(\frac{1}{2}\lambda 0\right)$$

by a fractional shortening value of the glass, the λ0 representing a wavelength corresponding to the lowest frequency within a target frequency range.

10. A mobile antenna mounted on an electrically conductive body of a vehicle, in which the body of the vehicle has a first support portion extending substantially parallel to the ground on which the vehicle is to be disposed, a second support portion extending substantially orthogonal to the ground, a corner portion at which the first support portion and the second support portion meet, the first support portion, the second support portion, and the corner portion supporting at least corner portion of a window of the vehicle, the mobile antenna comprising an electrically conductive antenna element having a first portion with one end and the other end extending therefrom, the one end of the first portion being arranged at least adjacent to any one of the first support portion, the second support portion, and the corner portion and being electrically connected to a feeding point, the other end of the first portion being arranged along surface of the window such that polarized surfaces formed by the antenna element are non-orthogonal to a polarized surface of each of a vertically polarized wave and a horizontally notarized wave in radio waves, wherein a corner angle of the corner portion is formed by a window-side edge of the first support portion and a window-side edge of the second support portion, and the first portion of the antenna element is ranged in parallel to a center direction of the corner angle.

11. A mobile antenna according to claim 10, wherein the antenna element includes a second portion with one end joined to the first portion to form a first loop, and the other end of the second portion is grounded to any one of the first support portion, the second support portion, and the corner portion.

12. A mobile antenna according to claim 11, wherein the antenna element includes a third portion with one end joined to the first portion to form a second loop, the other end of the third portion is grounded to another one of the first support portion, the second support portion, and the corner portion.

13. A mobile antenna according to claim 11, wherein the antenna element includes a plural-path forming portion configured to allow the first portion, the second portion, and the plural-path forming portion to form a plurality of current paths.

14. A mobile antenna according to claim 13, wherein the plural-path forming portion has any one of:

a mesh structure composed of a plurality of loops, the loops being contained in the current pats; and a bypass structure joined between the first portion and the second portion.

15. A mobile antenna according to claim 13, wherein the second portion has a connection bar such that the one end of the second portion is joked to the first portion through the connection bar, and the connection bar has a width wider than that of each of the first portion and the second portion, the connection bar allowing the current paths to be formed therethrough.

16. A mobile antenna according to claim 10, wherein the window is made of glass, and an overall length of the antenna element is set to a length obtained by multiplying (½λ0) by a fractional shortening value of the glass, the λ0 representing a wavelength corresponding to the lowest frequency within a target frequency range.

17. A mobile antenna mounted on an electrically conductive body of a vehicle, in which the body of the vehicle bas a first support portion extending substantially parallel to the around on which the vehicle is to be disposed, a second support portion extending substantially orthogonal to the ground, a corner portion at which the first support portion and the second support portion meet, the first support portion, the second support portion, and the corner portion supporting at least corner portion of a window of the vehicle, the mobile antenna comprising an electrically conductive antenna element having a first portion with one end and the other end extending therefrom, the one end of the first portion being arranged at least adjacent to any one of the first support portion, the second support portion, and the corner portion and being electrically connected to a feeding point, the other end of the first portion being arranged along a surface of the window such that polarized surfaces formed by the antenna element are non-orthogonal to a polarized surface of each of a vertically polarized wave and a horizontally polarized wave in radio waves, wherein the other end of the first portion extends from the one end thereof in any one of a line and a curve.

18. A mobile antenna according to claim 17, wherein the antenna element has a loop portion with one end and the other end, the one end of the loop portion being joined to the first portion, the other end of the loop portion being grounded to any one of the first support portion, the second support portion, and the corner portion.

19. A mobile antenna according to claim 17, wherein the first portion has a portion whose width is wider than that of the remaining portion thereof.

20. A mobile antenna according to claim 17, wherein the window is made of glass, and an overall length of the first portion is set to a length obtained by multiplying $$\left(\frac{1}{4}\lambda 0\right)$$

by a fractional shortening value of the glass, the λ0 representing a wavelength corresponding to the lowest frequency within a target frequency range.

21. A mobile antenna mounted on an electrically conductive body of a vehicle, in which the body of the vehicle has a first support portion extending substantially parallel to the around on which the vehicle is to be disposed, a second support portion extending substantially orthogonal to the ground, a corner portion at which the first support portion and the second support portion meet, the first support portion, the second support portion, and the corner portion supporting at least corner portion of a window of the vehicle, mobile antenna comprising an electrically conductive antenna element having a first portion with one end and the other end extending therefrom, the one end of the first portion being arranged at least adjacent to any one of the first support portion, the second support portion, and the corner portion and being electrically connected to a feeding point, the other end of the first portion being arranged along a surface of the window such that polarized surfaces formed by the antenna element are non-orthogonal to a polarized surface of each of a vertically polarized wave and a horizontally polarized wave in radio waves, wherein a corner angle of the corner portion is formed by a window-side edge of the first support portion and a window-side edge of the second support portion, and the first portion of the electrical conductive antenna element includes a first conductive trace and a second conductive trace, further comprising:

a first film member having opposing first and second surfaces, the first conductive trace being mounted onto the first surface of the first film member; and a second film member having opposing first and second surfaces, the second conductive trace being mounted onto the first surface of the second film member, the first and second film members being individually adhered onto the surface of the window such that:

the first conductive trace is located between the window-side edge of the first support portion and a center line of the corner angle, and the second conductive trace is located between the window-side edge of the second support portion and the center line of the corner angle.

22. A mobile antenna according to claim 21, wherein the first conductive trace includes a first feed trace, and the second conductive trace includes a second feed trace, the first and second feed traces are so arranged as to abut with each other, further comprising a feed terminal electrically connected to both the first and second feed traces while the first and second feed traces are in contact with each other.

23. A mobile antenna according to claim 21, wherein the first conductive trace includes a first feed trace, and the second conductive trace includes a second feed trace, the first and second feed traces are so arranged as to be laminated with each other via one of the first and second film members, further comprising a feed terminal electrically connected to both the first and second feed traces while the first and second feed traces are laminated with each other.

24. A mobile antenna according to claim 23, wherein one of the first and second film members is adhered at the second surface onto the surface of the window, and the other of the first and second film members is adhered at the first surface onto the first surface of the one of the first and second film members such that the first feed trace mounted onto the first surface of the one of the first and second film members directly abuts on the second feed trace mounted onto the first surface of the other of the first and second film members.

25. A mobile antenna according to claim 21, wherein the first and second conductive traces are arranged symmetrically with each other about the center line of the corner angle.

26. A mobile antenna system mounted on an electrically conductive body of a vehicle, in which the body of the vehicle has a first support portion extending substantially parallel to the ground on which the vehicle is to be disposed, a second support portion extending substantially orthogonal to the ground, and a corner portion at which the first support portion and the second support portion meet) the first support portion, the second support portion, and the corner portion supporting at least corner portion of a first window of the vehicle, and the first support portion supporting a second window of the vehicle, the mobile antenna system comprising:

a first mobile antenna comprising:

a first electrically conductive antenna element having a first portion with one end and the other end extending therefrom, the one end of the first portion, being arranged at least adjacent to any one of the first support portion, the second support portion, and the corner portion and being electrically connected to a first feeding point, the other end of the first portion being ranged along a surface of the first window such that polarized surfaces formed by the first antenna element are non-orthogonal to a polarized surface of each of a vertically polarized wave and a horizontally polarized wave in radio waves, a second mobile antenna comprising:

a second electrically conductive antenna element having a second portion with one end and the other end extending therefrom, the one end of the second portion being electrically connected to a second feeding point, the oilier end of the second portion being arranged along a surface of any one of the first window and the second window such that polarized surfaces formed by the second antenna element are non-orthogonal to a polarized surface of each of a vertically polarized wave and a horizontally polarized wave in radio waves, the second mobile antenna being arranged such that the first and second mobile antennas are symmetric with each other in the body of the vehicle.

27. A mobile antenna system according to claim 26, wherein, when first current is fed to the first antenna element through the first feeding point and second current is fed to the second antenna element through the second feeding point, the second mobile antenna is arranged in the vehicle body such that a direction of the first current flowing through the first antenna element is different from that of the second current flowing through the second antenna element.

28. A method of installing a mobile antenna in an electrically conductive body of a vehicle, in which the body of the vehicle has a first support portion extending substantially parallel to the ground on which the vehicle is to be disposed, a second support portion extending substantially orthogonal to the ground, a corner portion at which the first support portion and the second support portion meet, the first support portion, the second support portion, and the corner portion supporting at least corner portion of a window of the vehicle, and a corner angle of the corner portion is formed by a window-side edge of the first support portion and a window-side edge of the second support portion, the method comprising:

providing a first film member having opposing first and second surfaces, a first conductive trace with one end and the other end being mounted onto the first surface of the first film member;

providing a second film member having opposing first and second surfaces, a second conductive trace with one and the other end being mounted onto the first surface of the second film member;

individually adhering the first and second film members onto the surface of the window such that:

the one end of the first conductive trace is arranged at least adjacent to the corner portion and the other end thereof is located between the window-side edge of the first support portion and a center line of the corner angle, and the one end of the second conductive trace is arranged at least adjacent to the corner portion and the other end thereof and the other end thereof is located between the window-side edge of the second support portion and the center line of the corner angle.

29. A method according to claim 28, wherein the adhering includes:

locating the first and second film members onto the surface of the window such that:

the one end of the first conductive trace is arranged at least adjacent to the corner portion and the other end thereof is located between the window-side edge of the first support portion and a center line of the corner angle, and the one end of the second conductive trace is arranged at least adjacent to the corner portion to be at least partially overlapped with the one end of the first conductive trace and the other end thereof and the other end thereof is located between the window-side edge of the second support portion and the center line of the corner angle, a size of the partially overlapped area between the one ends of the first and second conductive traces being determined depending on a size of the corner angle; and adhering the located first and second film members onto the surface of the window.

30. A method according to claim 28, further comprising:

electrically connecting a feeder to both the one ends of the first and second conductive traces to allow power to be fed to both the first and second conductive traces.

* * * * *